US011492562B2

(12) United States Patent
Benham et al.

(10) Patent No.: US 11,492,562 B2
(45) Date of Patent: Nov. 8, 2022

(54) INTEGRATED THERMAL PROCESS FOR HEAVY OIL AND GAS TO LIQUIDS CONVERSION

(71) Applicant: Suncor Energy Inc., Calgary (CA)

(72) Inventors: Kelly Benham, Calgary (CA); Bernard Mark Archer, Calgary (CA); Nicholas Daniel Benham, Calgary (CA)

(73) Assignee: SUNCOR ENERGY INC., Alberta (CA)

( * ) Notice: Subject to any disclaimer, the term of this patent is extended or adjusted under 35 U.S.C. 154(b) by 0 days.

(21) Appl. No.: 16/509,337

(22) Filed: Jul. 11, 2019

(65) Prior Publication Data

US 2020/0017777 A1 Jan. 16, 2020

(30) Foreign Application Priority Data

Jul. 11, 2018 (CA) ..... CA 3011027

(51) Int. Cl.

| | |
|---|---|
| ***C10G 47/34*** | (2006.01) |
| ***C10G 47/22*** | (2006.01) |
| ***C10G 47/36*** | (2006.01) |
| ***C10G 65/10*** | (2006.01) |

(52) U.S. Cl.

CPC ..... *C10G 47/34* (2013.01); *C10G 47/22* (2013.01); *C10G 47/36* (2013.01); *C10G 65/10* (2013.01); *C10G 2300/206* (2013.01)

(58) Field of Classification Search

CPC ... C10G 47/22; C10G 47/32–34; C10G 65/10
See application file for complete search history.

(56) References Cited

U.S. PATENT DOCUMENTS

| | | | | |
|---|---|---|---|---|
| 5,925,235 | A * | 7/1999 | Habib | C10G 65/10 208/111.35 |
| 2005/0284796 | A1 | 12/2005 | Benham | |
| 2011/0210045 | A1 * | 9/2011 | Kou | C10G 65/02 208/59 |
| 2013/0026067 | A1 * | 1/2013 | Koseoglu | C10G 49/007 208/85 |
| 2013/0072730 | A1 | 3/2013 | Knuuttila et al. | |
| 2017/0152445 | A1 | 6/2017 | Van Der Merwe et al. | |

FOREIGN PATENT DOCUMENTS

CA PCT/CA2014/050653 1/2016

OTHER PUBLICATIONS

Abdelsayed, Victor et al., "Microwave-assisted conversion of low rank coal under methane environment" (Year: 2019).*
Mukherjee, Ujjal and Gillis, Dan, Chevron Lummus Global. 2018. Advances in residue hydrocracking. PTQ (Q1):75-83.

* cited by examiner

*Primary Examiner* — Renee Robinson

(57) ABSTRACT

The present disclosure generally relates to upgrading difficult to process heavy-oil. In particular, the disclosure relates to upgrading heavy oil and other high carbon content materials by using an integrated thermal-process (ITP) that utilizes anti-coking management and toluene insoluble organic residues (TIOR) management to directly incorporate lighter hydrocarbons into high molecular weight, low hydrogen content hydrocarbons such as thermally processed heavy oil products. This process can be integrated with other thermal processing schemes, such as cokers and visbreakers, to improve the conversion and yields from these integrated processes.

30 Claims, 30 Drawing Sheets

FIG. 15A
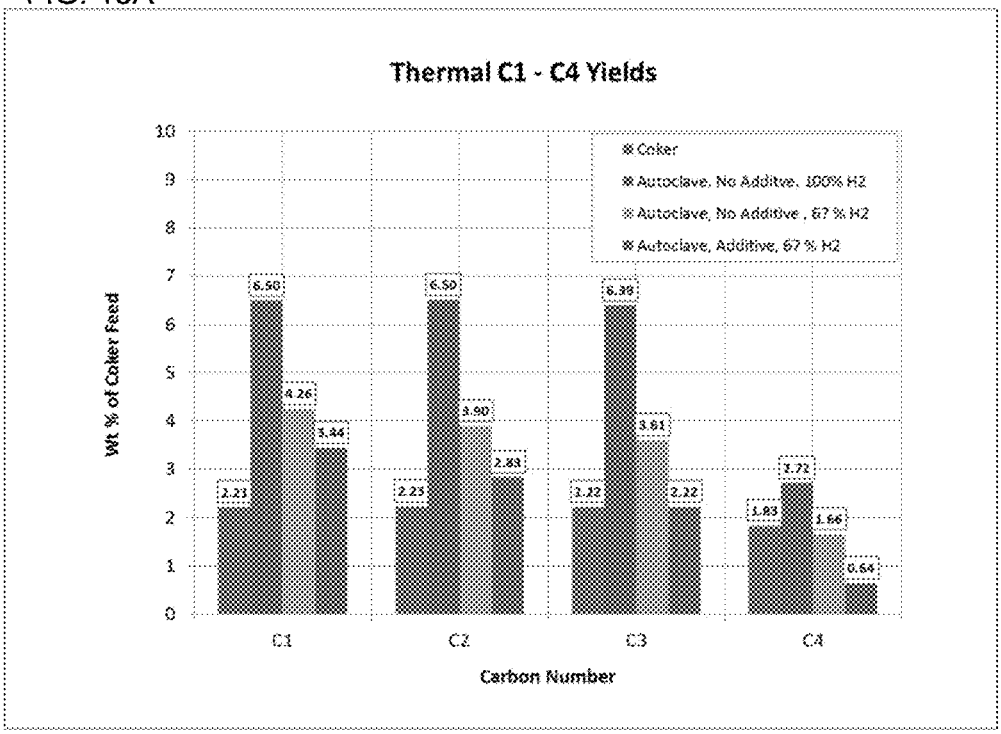
FIG. 15B
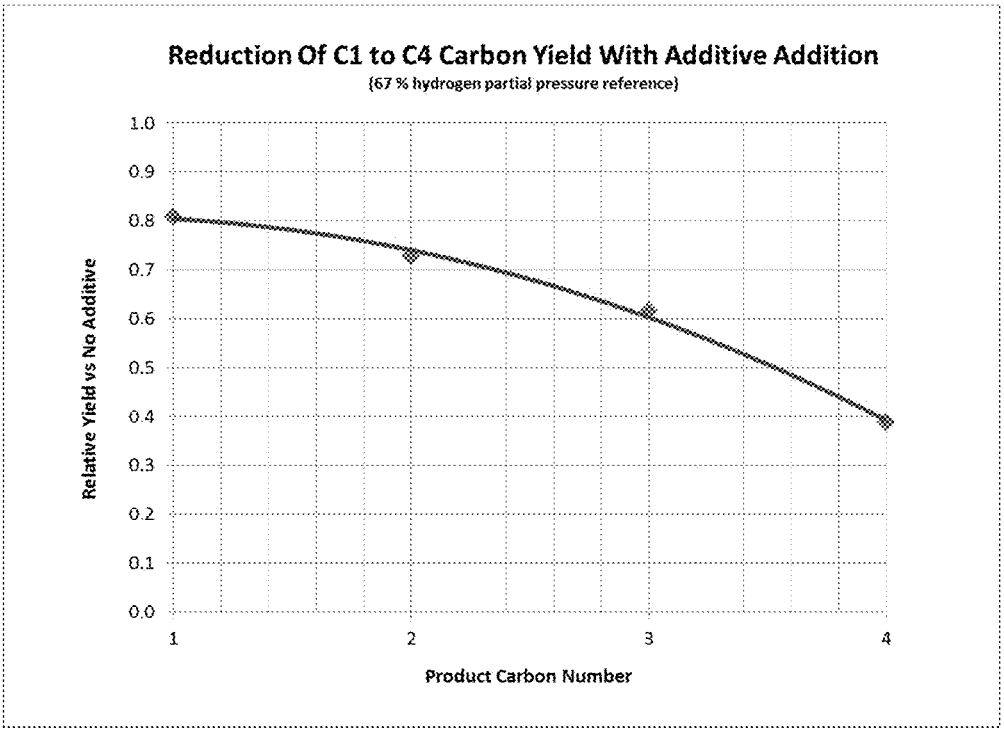
FIG. 15

| Properties | Cold Lake VTB | Cold Lake VTB | Isthmus Mayan VTB | Mene Mota VTB | Mene Mota Visbreaker Bottoms | Mene Mota Visbreaker Bottoms | Iran Light Visbreaker Bottoms |
|---|---|---|---|---|---|---|---|
| Specific Gravity | 1.041 | 1.050 | 1.058 | 1.024 | 1.066 | 1.090 | 1.073 |
| Hydrogen (wt%) | 10.5 | 9.5 | - | - | - | - | |
| Carbon (wt%) | 83.0 | 82.4 | - | - | - | - | |
| Sulphur (wt%) | 5.14 | 6.0 | 4.4 | 3.2 | 3.4 | 3.4 | 3.6 |
| Nitrogen (wt%) | 0.62 | .7 | - | - | - | - | |
| Oxygen (wt%) | 0.69 | 1.2 | - | - | - | - | |
| CCR | 20.6 | 24.1 | - | - | - | - | |
| Polar Aromatics | - | 51.8 | 23.1 | NA | - | 19.8 | 16.5 |
| nC7 Asphaltene (wt%) | 15.5 | 20.4 | 33.5 | 17.1 | 31.7 | 34.5 | 36.6 |
| Polar Aromatics/ Asphaltenes | - | 2.5 | 0.69 | NA | - | 0.56 | 0.45 |
| FLOCC Ratio | - | - | - | 0.25 | 0.69 | 0.80 | - |
| 950+ F Conversion | - | - | - | 0 | 23.3 | 27.8 | - |
| Viscosity at 275 F (cSt) | 1080 | - | - | 454 | 3,823 | 14,165 | - |
| Viscosity at 300 F (cSt) | 490 | - | - | 244 | 1,407 | 4,014 | - |

FIG. 19

FIG. 29A

| VTB Fraction | 1256 F - | 1256 F + | Blended |
|---|---|---|---|
| VTB Cut wt% | 42.6 | 57.4 | 100 |
| VTB Cut vol % | 44.9 | 55.1 | 100 |
| SG | 1.0089 | 1.1090 | 1.0664 |
| **CCR** | **8.8** | **39.9** | **26.6** |
| **Asphaltenes** | **0.2** | **37.5** | **21.6** |
| Carbon/Hydrogen (wt/wt) | 7.59 | 8.86 | 8.32 |
| Sulphur (wt%) | 4.87 | 7.12 | 6.16 |
| Nitrogen (wt%) | 0.40 | 0.80 | 0.63 |
| Carbon (wt%) | 82.96 | 81.35 | 82.03 |
| Hydrogen (wt%) | 10.92 | 9.18 | 9.92 |
| Oxygen (wt%) | 0.85 | 1.55 | 1.25 |
| By Product Hydrogen Content | | | |
| Hydrogen (wt%) | 1.60 | 3.78 | 2.93 |
| Hydrogen (SCFB) | 1193 | 2756 | 2090 |

| Product | Vol % | Vol % | Blended |
|---|---|---|---|
| C3 | 3.3 | 5.4 | 4.5 |
| C3o | 0.3 | 0.4 | 0.3 |
| iC4 | 0.7 | 1.0 | 0.9 |
| nC4 | 1.7 | 2.3 | 2.0 |
| C4o | 0.3 | 0.4 | 0.4 |
| C5-400 F | 30.1 | 35.1 | 33.0 |
| 400- 650 F | 35.1 | 34.9 | 35.0 |
| 650- 975 F | 28.0 | 32.1 | 30.4 |
| Pitch (975+ F) | 6.2 | 8.8 | 7.7 |
| Total | 105.8 | 120.3 | 114.1 |
| C3s | 3.6 | 5.8 | 4.9 |
| C4-400 | 32.9 | 38.7 | 36.2 |
| 400-650 | 35.1 | 34.9 | 35.0 |
| C4-650 | 67.9 | 73.6 | 71.2 |
| 975+ Conv | 91.8 | 89.4 | 90 |
| Hydrogen in C4- Gases | 1.99 | 2.31 | 2.17 |

FIG. 29B

| Product Quality | | |
|---|---|---|
| | 1256- F VTB | 1256+ F VTB |
| 975+ Conv | 91.8 | 89.4 |
| **C5-400 F** | 100.00 | 100.00 |
| SG | 0.762 | 0.750 |
| Sulphur | 0.72 | 0.45 |
| Nitrogen | 0.07 | 0.13 |
| Carbon | 84.44 | 84.29 |
| Hydrogen | 14.77 | 15.13 |
| Oxygen | 0.00 | 0.00 |
| Bromine # | 26.4 | 15.9 |
| **400-650 F** | 100.00 | 100.00 |
| SG | 0.891 | 0.886 |
| Sulphur | 2.67 | 2.36 |
| Nitrogen | 0.13 | 0.21 |
| Carbon | 85.29 | 84.89 |
| Hydrogen | 11.91 | 12.54 |
| Oxygen | 0 | 0 |
| Bromine # | 9.8 | 8.7 |
| **650-975 F** | 100.00 | 100.00 |
| SG | 1.019 | 0.977 |
| Sulphur | 3.61 | 2.64 |
| Nitrogen | 0.53 | 0.56 |
| Carbon | 86.24 | 85.17 |
| Hydrogen | 9.31 | 11.33 |
| Oxygen | 0.30 | 0.30 |
| Bromine # | 7.9 | 7.6 |
| **975+ F** | 100.00 | 100.00 |
| SG | 1.097 | 1.110 |
| Sulphur | 5.29 | 5.98 |
| Nitrogen | 1.21 | 1.62 |
| Carbon | 85.33 | 84.15 |
| Hydrogen | 7.30 | 6.62 |
| Oxygen | 0.87 | 1.44 |
| CCR | 54.5 | 59.3 |
| Pentane Insoluable | 66.0 | 82.6 |
| **Nitrogen Ratio (650-975 F)/(975+ F) (wt % / wt %)** | **2.28** | **2.91** |

| Properties | Athabasca Bitumen | Athabasca Bitumen VTB 975+ F | Delayed Coker Fractionator Bottoms | Fluid Coker Heavy Gasoil |
|---|---|---|---|---|
| Specific Gravity | 1.02 | 1.066 | 1.074 | 1.008 |
| Hydrogen (wt%) | 10.3 | 9.4 | 8.3 | 7.8 |
| Carbon (wt%) | 83.2 | 82.1 | 85.1 | 86.7 |
| Sulphur (wt%) | 5.1 | 6.4 | 5.0 | 4.6 |
| Nitrogen (wt%) | 0.5 | 0.7 | 0.6 | 0.3 |
| Oxygen (wt%) | 0.8 | 1.2 | 1.0 | 0.6 |
| nC7 Asphaltene (wt%) | 13.5 | 17.6 | 2.5 | 0.0 |

FIG. 30

INTEGRATED THERMAL PROCESS FOR HEAVY OIL AND GAS TO LIQUIDS CONVERSION

TECHNICAL FIELD

The present disclosure generally relates to upgrading difficult to process heavy-oil. In particular, the disclosure relates to upgrading heavy oil and other high carbon content materials by using one or more processes that directly incorporate lighter hydrocarbons into high molecular weight, low hydrogen content hydrocarbons such as thermally processed heavy oil products.

BACKGROUND

Heavy oil can be upgraded and ultimately refined into various commercially valuable products, including fuels and chemicals. The goals of conventional heavy-oil upgrading systems and processes, each of which systems are also referred to as a heavy-oil thermal processor, include: removing impurities such as nitrogen and sulfur; hydrogenating (saturating) olefins; opening aromatic structures; and, cracking long chain, high molecular-weight compounds into shorter chain, lower molecular-weight compounds.

An initial step in upgrading heavy oil is typically a low-temperature distillation process, such as atmospheric-pressure distillation, which separates valuable precursor materials from heavier materials referred to as Atmospheric Tower Distillation Bottoms (ATB). ATB can be further exposed to vacuum distillation for separating vacuum gas-oils from vacuum bottoms, which are also called Vacuum Tower Bottoms (VTB). The lighter, more valuable precursor materials from the atmospheric distillation and the vacuum gas-oils from the vacuum distillation can be subjected to various kinds of hydro-treatment processes for removing impurities and to further increase the value of the lighter products. The VTB constituents are high molecular-weight aromatic and non-aromatics that require further upgrading to make fuels, chemicals or other products.

The VTB can be subjected to a thermal-cracking process whereby high temperatures and pressures are used to convert the high molecular-weight compounds into smaller molecular-weight compounds that are more valuable. Thermal cracking is typically achieved by one or more of visbreaking, delayed coking, fluid coking, or fluid catalytic-cracking. These processes all create lower molecular-weight compounds that can be separated into various valuable products by boiling-point separation and/or other processes.

At least one of the challenges of thermal cracking is to create an environment where the temperatures are high enough to cause the high-molecular weight molecules to break down while regulating the generation of unstable heavy liquids and coke, a high carbon-content solid. The generation of unstable heavy (cracked) liquids, in a process such as visbreaking, can cause fouling and coke production in the equipment and in downstream processes, which in turn can limit the generation of valuable products. Increasing the thermal severity, as in the case of a coker, generates substantial quantities of coke, which is a less valuable product.

A further challenge in upgrading heavy oil is the source of hydrogen gas for hydro-treatment processes are typically produced by one or more reformer processes. For example, the hydrogen-rich gas produced in a steam methane-reformer results in the production of greenhouse gases, such as carbon dioxide ($CO_2$). Furthermore, current upgrading systems and processes can direct valuable carbon and hydrogen into less valuable products, such as coke, and/or a waste stream, such as a flare stack.

SUMMARY

Upgrading of difficult to process heavy-oil is typically performed through one or more thermal processors that perform carbon-rejection processes, one or more hydrogen-addition processes, or combinations of both. Some implementations of the present disclosure relate to a process for upgrading difficult to process heavy-oil feedstocks that integrates carbon rejection and hydrogen addition processes in a manner that achieves improved yields by both increasing conversion capability and substantially reducing the hydrogen input requirements. Some implementations of the present disclosure relate to an integrated process relates that directly incorporates higher hydrogen-content hydrocarbons into thermally processed heavy-oil while simultaneously controlling Toluene Insoluble Organic Residue (TIOR) levels within the process. Implementations of the present disclosure relate to an integration of heavy-oil processes that results in heavy-oil upgrading with greatly increased liquid volumetric gain while reducing the hydrogen uptake requirement, as compared with typical carbon-rejection processes and hydrogen-addition process. As will be appreciated by one skilled in the art, the direct incorporation of high hydrogen-content hydrocarbons into the thermally processed heavy-oil is not limited to just alkylation reactions. Various other types of reactions can occur during the integrated process so that the high hydrogen content hydrocarbons are incorporated and result in volumetric gains of the liquid products while reducing the hydrogen uptake requirements.

Conventional heavy oil upgrading technologies are based on either carbon rejection or hydrogen addition. Implementations of the present disclosure directly incorporate a feedstock of intermediate hydrogen-content hydrocarbons and/or high hydrogen-content hydrocarbons with difficult to process heavy-oil feedstocks—with multiple aromatic structures and low hydrogen content—to yield intermediate hydrogen-containing products. This direct incorporation can substantially reduce or eliminate the majority of the conventional hydrogen-addition processing and the associated $CO_2$ generation. In some implementations of the present disclosure, the carbon that would otherwise have been eliminated as $CO_2$ is incorporated into an increased volume of the liquid hydrocarbon products, which can further reduce the overall greenhouse gas impact of the process.

Implementations of the present disclosure can result in substantially lower carbon dioxide ($CO_2$) generation per volume of produced liquid product, as compared to known processes. In some implementations of the present disclosure, the integrated processes of the present disclosure can result in a synergistic coupling of gas to liquids and heavy-oil upgrading technologies.

Some implementations of the present disclosure relate to directly incorporating higher hydrogen-content light hydrocarbons into thermally generated, difficult to process heavy-oils produced in satellite thermal processing units, such as cokers, visbreakers and/or a hydro-visbreakers. In the case of coking, a very low hydrogen content and high carbon-content petroleum coke can be isolated and the high hydrogen content light gases can be directly incorporated with the heavy thermal liquid from the coker to produce a relatively high quality hydrocarbon stream. Beyond achieving the direct incorporation within an integrated thermal processing system and/or process, use of a coker-fractionator source of heavy-oil based feedstocks can reduce or remove the volume of fractionator-tower bottoms that are recycled back into the coker-coke drum feed. This reduced recycle volume can provide an increased volume and processing capacity of the coker-fractionator unit.

Some implementations of the present disclosure relate to a method of upgrading a heavy oil feedstock including the steps of: generating a high hydrogen-content light hydrocarbon feedstock in a thermal processor; and feeding the heavy oil feedstock and light hydrocarbon feedstock into a reaction vessel to thereby incorporate the light hydrocarbon feedstock into the heavy oil feedstock to produce a mixed effluent.

Some implementations of the present disclosure relate to a method of upgrading a heavy oil feedstock including the steps of: generating the heavy oil feedstock in a thermal processor; and feeding the heavy oil feedstock and a high hydrogen-content light hydrocarbon feedstock into a reaction vessel to thereby incorporate the light hydrocarbon feedstock into the heavy oil feedstock to produce a mixed effluent.

Some implementations of the present disclosure relate to a method of upgrading a heavy oil feedstock including the steps of: generating the heavy oil feedstock and a high hydrogen-content light hydrocarbon feedstock in a thermal processor; and feeding the heavy oil feedstock and the light hydrocarbon feedstock into a reaction vessel to thereby incorporate the light hydrocarbon feedstock into the heavy oil feedstock to produce a mixed effluent.

Some implementations of the present disclosure relate to a method of upgrading a heavy oil feedstock including a step of: feeding the heavy oil feedstock, a light hydrocarbon feedstock, and $H_2$ into a reaction vessel to thereby incorporate at least some of the light hydrocarbon feedstock into the heavy oil feedstock to produce a mixed effluent.

Some implementations of the present disclosure relate to a system for upgrading a heavy oil feedstock. The system includes: a thermal processor; a reaction vessel; a light hydrocarbon feedstock conduit configured to feed a high hydrogen-content light hydrocarbon feedstock from the thermal processor to the reaction vessel; and a heavy oil feedstock conduit to feed the heavy oil feedstock into the reaction vessel.

Some implementations of the present disclosure relate to a system for upgrading a heavy oil feedstock. The system including: a thermal processor; a reaction vessel; a heavy oil conduit configured to transfer the heavy oil feedstock from the thermal processor to the reaction vessel; and a light hydrocarbon feedstock feed to feed a high hydrogen-content light hydrocarbon feedstock into the reaction vessel.

Some implementations of the present disclosure relate to a system for upgrading a heavy oil feedstock. The system including: a thermal processor; a reaction vessel; a heavy oil conduit configured to transfer the heavy oil feedstock from the thermal processor to the reaction vessel; and a light hydrocarbon feedstock conduit to transfer a high hydrogen-content light hydrocarbon feedstock from the thermal processor into the reaction vessel.

Some implementations of the present disclosure relate to a system for upgrading a heavy oil feedstock. The system including: a thermal processor; a reaction vessel; a heavy oil conduit configured to transfer the heavy oil feedstock from the thermal processor to the reaction vessel; a light hydrocarbon feedstock conduit to transfer a high hydrogen-content light hydrocarbon feedstock from the thermal processor into the reaction vessel; and an $H_2$ feed to feed an $H_2$ source into the reaction vessel.

Some implementations of the present disclosure relate to a reactor unit for upgrading a first hydrocarbon-feedstock. The reactor unit includes a first end, a second end and a sidewall that defines a plenum between the first end and the second end. The reactor unit also includes a feedstock inlet, a first gas-inlet and a first outlet. The feedstock inlet is configured to introduce a low hydrogen-content hydrogen feedstock and an anti-coking additive into the plenum proximal the first end. The first gas-inlet is configured to introduce a high hydrogen-content light hydrocarbon into the plenum at an inlet temperature of at least about 800° F. The first outlet is configured to remove a mixed effluent from the plenum proximal the second end.

Some implementations of the present disclosure relate to a system for upgrading a difficult to process heavy-oil feedstock. The system includes a reactor unit according implementations of the present disclosure; a first separator that is configured to receive and to separate the mixed effluent into a first liquid-stream and a first vapor-stream; a first hydrotreater that is configured to receive the first vapor-stream and/or a vacuum unit light product stream for increasing a hydrogen content thereof as a first hydrotreater product; a second separator that is configured to receive and to separate the first hydrotreater product into a second liquid-stream and a second vapor-stream; a third separator that is configured to receive and separate the second vapor-stream from the second separator into a third liquid-stream and a third vapor-stream; and a product fractionator that is configured to receive at least a portion of the third-liquid stream and to produce products.

Some implementations of the present disclosure relate to a system for upgrading a difficult to process heavy-oil feedstock. The system includes a reactor unit according to implementations of the present disclosure; a first separator that is configured to receive and to separate the mixed effluent into a first liquid-stream and a first vapor-stream; a second separator that is configured to receive and to separate the first vapor-stream into a second liquid-stream and a second vapor-stream; a third separator that is configured to receive and separate the first liquid-stream into a third liquid-stream and a third vapor-stream; and a second reactor unit. The second reactor unit has a first end; a second end; a sidewall that defines a plenum between the first end and the second end; an inlet that is configured to receive the third liquid-stream and/or the low hydrogen-content hydrogen feedstock; an additive inlet that is configured to introduce an anti-coking additive into the plenum proximal the first end; a first gas-inlet that is configured to introduce a high hydrogen-content light hydrocarbon into the plenum at a temperature of at least about 800° F. between the second end and the feedstock inlet, and an outlet that is configured to remove a mixed effluent from the plenum proximal the second end.

Some implementations of the present disclosure relate to a method of upgrading a difficult to process heavy-oil feedstock that includes steps of directly incorporating a first low molecular weight hydrocarbon feedstock into a thermally processed heavy-oil feedstock for producing a mixed effluent; performing at least one separating step on the mixed effluent for producing a liquid stream and a gas stream; and separating the gas stream into one or more products.

Some implementations of the present disclosure allow for upgrading of difficult to process heavy-oil feedstocks. The implementations of the present disclosure can use intermediate hydrogen content hydrocarbons and/or high hydrogen content hydrocarbons for upgrading the difficult to process heavy-oil feedstocks rather than other sources of hydrogen that produce $CO_2$. The implementations of the present disclosure increase the hydrogen content of the feed through the direct incorporation of the high hydrogen content hydrocarbons. The present disclosure provides systems and processes to upgrade difficult to process heavy-oil feedstocks that is not carbon rejection or hydrogenation, but rather is systems and processes that directly integrate higher hydrogen content hydrocarbons into the difficult to process heavy-oil feedstocks for generating pipeline transportable products.

Some implementations of the present disclosure relate to a process that provides a sizeable volumetric gain of liquid products through both direct incorporation and expansion of the product volume by the generation of smaller, less dense molecules through cracking. Many of the difficult to process heavy-oil feedstocks include metals that can impair downstream refining processes. In some implementations of the present disclosure, these metals can be utilized as a quasi-catalyst during processing. The metals can be incorporated into an ash product that can act as a catalyst within linked steps (or satellite processes) of the process. Ultimately, the metals can be isolated as a metal concentrate product. In some implementations of the present disclosure, a heavy gasoil can be generated and used as a carrier medium for moving the ash between different process steps or processes so that the ash containing stream can act as both a catalyst and a hydrogen-donor source.

Without being bound by any particular theory, implementations of the present disclosure can provide direct incorporation of one or more rich fuel gases, such as C1 through C7, into lower hydrogen content heavy oils to produce valuable intermediate hydrogen-content products. This direct incorporation can reduce the overall $CO_2$ production that is typically associated with operating heavy-oil processes by reducing the reliance on sources of hydrogen that are associated with the production of $CO_2$. In order to optimally utilize the relatively higher hydrogen content rich fuel gas as the hydrogen source, a heavy oil can be utilized as a feedstock. Preferably, this heavy oil would have a high resin to asphaltene ratio to inhibit the asphaltenes within the heavy oil from coking. This mitigation of the coking reactions in turn allows for increased asphaltene conversion, stability of the cracked products at elevated operating temperatures, and incorporation of higher hydrogen content feeds to the reaction system products. However, as will be appreciated by the person skilled in the art, the feedstock is not limited to feedstocks with any specific resin to asphaltene ratio. Increased asphaltene cracking can provide capping sites on the cracked hydrocarbons where the low molecular-weight, higher hydrogen content hydrocarbons can be directly incorporated into the cracked hydrocarbon-products, for example through alkylation reactions. This direct incorporation of the low molecular-weight, higher hydrogen content hydrocarbons onto these asphaltene structures can provide a significant volumetric boost to the cracked hydrocarbon-products by increasing the mass of both the carbon and hydrogen incorporated into the cracked hydrocarbon-products.

BRIEF DESCRIPTION OF FIGURES

Some features, such as conduit, flow path or processing units, of the implementations of the present disclosure are optional and some of these optional features are shown in the figures with hashed lines.

FIG. 1 is a schematic of two coker and fractionator systems, wherein

FIG. 5 is schematic of two visbreaker systems, wherein

FIG. 6 is a schematic of two hydro-visbreaker systems, wherein

FIG. 7 is a schematic of examples of upgrading processes for one or more difficult to process heavy-oil feedstocks, wherein

FIG. 8 is an example of data that relates to product yields from a coker processing Athabasca bitumen vacuum tower bottoms (VTB), wherein

FIG. 10 shows examples of yield data related to a delayed coker unit, wherein

FIG. 11 shows examples of pilot-plant data related to thermal cracking using synthesis gas, wherein

FIG. 12 shows further examples of pilot-plant data related to thermal cracking using synthesis gas, wherein

FIG. 14 shows an example of yield distribution data related to a fluidized catalytic cracking pilot plant study, as dictated by a fixed hydrogen mass balance using octadecane as a model compound, wherein

14B shows paraffin distribution data.

FIG. 15 shows an example of yield data related to thermal processing experiments, wherein FIG. 15A shows C1 through C4 yield data generated at three benchmark hydrogen partial pressures; and, FIG. 15B shows yield data that reflects the impact of anti-coking additive on the yield of C1 through C4 at the intermediate benchmark hydrogen partial pressure;

FIG. 19 is a table that provides an example of constituent content of a variety of different heavy oil feedstocks;

FIG. 21 is an example of data related to a reduction in net light hydrocarbon yields, wherein

FIG. 23 is an example of data related to the increase in C5+ liquids associated with the reduction in C1-C4 yield, wherein

FIG. 25 is an example of data showing toluene insoluble organic residues (TIOR) yield responses to control variables in a pilot plant, wherein

FIG. 26 is an example of data related to TIOR control performance within a reactor of a commercial, heavy-oil upgrading unit, wherein

FIG. 28 is an example of data related to gas quality that is introduced into a contactor of a commercial, heavy-oil upgrading unit, wherein

FIG. 29 is an example of data related to upgrading Athabasca bitumen vacuum tower bottoms heavy oil, wherein FIG. 29A shows yields from a first cut with boiling points less than 1256° F., a second cut with boiling points greater than 1256° F. and a blend thereof;

FIG. 29B shows the product qualities from the first cut and the second cut; and

FIG. 30 is an example of data related to properties of heavy oils derived from Athabasca bitumen.

DETAILED DESCRIPTION

Figure 1A:
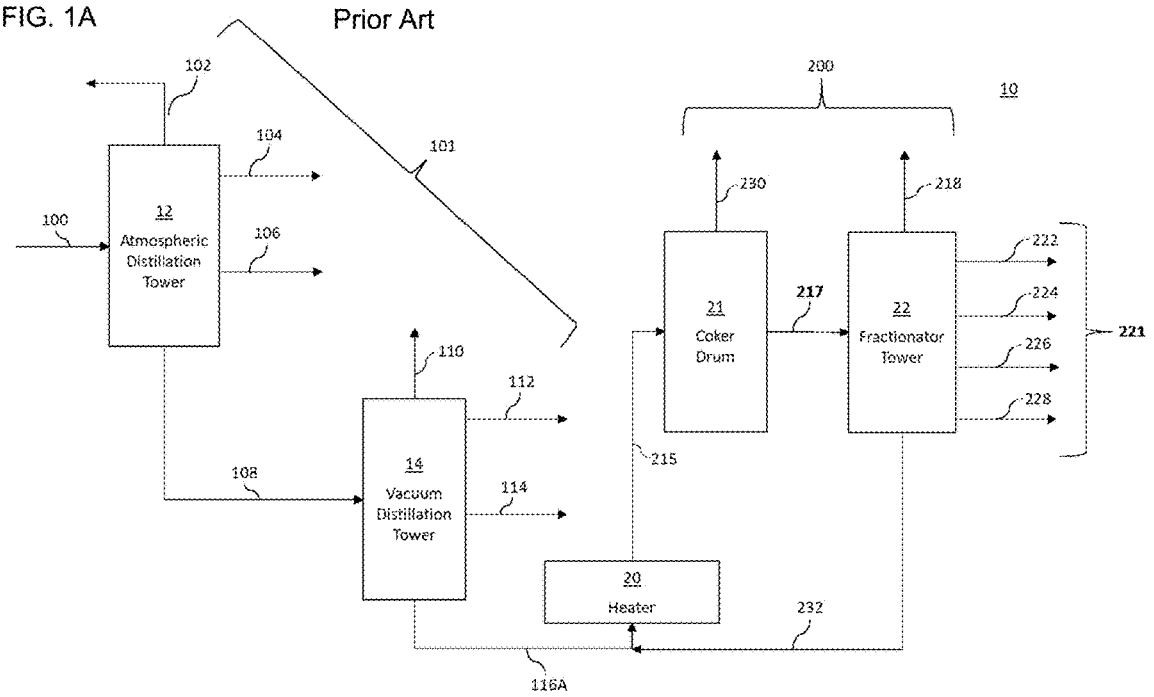
FIG. 1A shows a conventional delayed coker and fractionator system; and, FIG. 1B shows a delayed coker and fractionator system according to implementations of the present disclosure.

Implementations of the present disclosure relate to systems and processes that produce valuable liquid hydrocarbon products from difficult to process heavy-oil feedstocks, as defined herein below. The difficult to process heavy oil feedstock can contain a sufficiently high resin to asphaltene ratio so that the resin content of the feedstock protects the asphaltene content from precipitating out of solution. The resins and/or high-boiling polar aromatics can help maintain the asphaltenes that are participating in reactions within the bulk solution during a thermal upgrading process according to implementations of the present disclosure. Minimizing asphaltene partitioning can facilitate the formation of alkylation bonding sites for the direct incorporation of lighter hydrocarbons with a medium and/or high hydrogen-content, such as lighter hydrocarbons that can be produced from the elsewhere in the upgrading facility. An example of such light hydrocarbons are the rich fuel gases produced by a coker-fractionator tower of the upgrading facility. This direct incorporation of the lighter hydrocarbons can provide an increased volume of the valuable liquid hydrocarbon products, as compared to when there is no direct incorporation. The increased volume arises from carbon and hydrogen atoms from the lighter hydrocarbons being added to the carbon chains that ultimately form part of the valuable liquid hydrocarbon product. In some implementations of the present disclosure, the lighter hydrocarbons have a higher hydrogen-content and this contributes towards generating a greater volumetric gain of the liquid products while substantially reducing or eliminating the need for hydrogen that is generated by carbon dioxide ($CO_2$) producing processes. In some implementations of the present disclosure a recycling loop within the upgrading facility, for example a recycling loop that delivers coker-fractionator tower bottoms back upstream of the coker unit, can be decoupled (at least partially) so that the difficult to process heavy oil feedstocks are processed by the implementations of the present disclosure. The decoupling of one or more recycling loops may increase the operational capacity and operational life of various components of the upgrading facility. In some further implementations of the present disclosure, the light hydrocarbons can be supplemented with another source of hydrogen.

Some implementations of the present disclosure combine the use of anti-coking additives and other TIOR management features to facilitate a multitude of systems and processes for upgrading difficult to process heavy-oil feedstocks. This technology extends beyond the capabilities of known heavy oil upgrading technologies by one or more integrated systems and/or one or more integrated processes. For example, some implementations of the present disclosure relate to use of a coker-fractionator unit that results in increased yields, while exploiting the coker's ability to function as a carbon-rejection system. As the hydrogen content of the coke yielded from the coker is reduced to around 4 wt %, the liberated hydrogen is yielded in the liquid products and light gases. Using some implementations of the present disclosure, these light hydrocarbon gases produced from the coker-fractionator unit have a higher hydrogen-content that and can be processed with various aromatic liquids to yield intermediate hydrogen content products.

Using this approach, intermediate hydrogen content products can be made while substantially reducing or eliminating the requirement to generate a hydrogen intermediate that generates associated $CO_2$. In other implementations of the present disclosure, the process can be used with one or more products from a visbreaker-type process, where all the carbon is yielded as either a gas or liquid product. Implementations of the present disclosure can substantially reduce the production of greenhouse gases that are associated with the hydrogen addition during processing of difficult to process heavy-oil feedstocks.

Implementations of the present disclosure relate to direct incorporation of high hydrogen-content light hydrocarbons into difficult to process heavy-oil feedstocks while operating in a low hydrogen partial-pressure environment. The low hydrogen partial-pressures can provide a use for low hydrogen content streams, such as hydrotreater purges, which can reduce the need to purge gas and, thereby, reduce the energy and hydrogen that are wasted in association with typical hydrogen-processing equipment. As further described below, increasing the partial pressure of the non-pure hydrogen components of the gas can result in increasing the efficiency of the incorporation of the hydrocarbon gas into the liquid.

Implementations of the present disclosure relate to an integrated process that is capable of directly combining difficult to process heavy-oils and light gases to produce synthetic crudes and other refined liquid products. The implementations of the present disclosure can enable improved economics and facilitate transportation of the upgraded products at greatly reduced generation of greenhouse gases and at a reduced energy intensity.

Many of the difficult to process heavy-oil feedstocks include metals that can impair downstream refining processes. In some implementations of the present disclosure, these metals can be utilized as a quasi-catalyst during processing. The metals can be incorporated into an ash product that can act as a catalyst within linked steps (or satellite processes) of the process. Ultimately the metals can be isolated as a metal concentrate product. In some implementations of the present disclosure, a heavy gasoil can be generated and used as a carrier medium for moving the ash between different process steps or processes so that the ash containing stream can act as both a catalyst and a hydrogen-donor source.

Definitions

As used herein, the term "about" refers to an approximately +/−10% variation from a given value. It is to be understood that such a variation is always included in any given value provided herein, whether or not it is specifically referred to.

As used herein, the term "conduit" refers to a pipe, fluid transmission line or other mechanism for providing fluid communication between two features of the present disclosure. In some implementations of the present disclosure, use of the singular "conduit" can include multiple "conduits". The term "conducting" may be used interchangeably with the terms "feeding" or "flowing" and these terms refer to the movement of a fluid, with or without entrained solids, through a conduit.

As used herein, the term "downstream" refers to a position or component within a system, apparatus, unit or a step within a process that is after a prior position, component or step.

As used herein, the term "difficult to process heavy-oil feedstock" can be used interchangeably with "difficult to process heavy oil" and both terms refer to hydrocarbons with multiple aromatic structures and low hydrogen content, including but not limited to: petroleum crude oil; heavy cycle oils; shale oils; heavy oil; bitumen; high-boiling point fractions and solid fractions that are separated from heavy oil or thermally-generated components from heavy oil upgrading; vacuum-tower bottoms (VTB); coker-fractionator bottoms; coker heavy-gasoil; mid to high nC7 asphaltenes; low hydrogen-content hydrocarbons; aromatic hydrocarbons; mid to high polar hydrocarbons; coker gas oil such as HVGO; visbreaker bottoms; hydro-visbreaker bottoms, a mixture of components like a diluent and a heavy oil, where the diluent can be a C5C6 type diluent that is mixed with Athabasca Bitumen (Western Canadian Select), the diluent can also be other light hydrocarbons that are used in crude or bitumen solvent extraction processes and that are mixed with a difficult to process heavy oil; other products of thermal processing of heavy oil; or, combinations thereof.

As used herein, the term "high hydrogen-content" refers to hydrocarbons that have a wt % of hydrogen that is higher than an intermediate hydrogen-content range. Some non-limiting examples of high hydrogen-content hydrocarbons include, but are not limited to: coker naptha; visbreaker naptha; and, combinations thereof. One skilled in the art will also appreciate that these terms regarding the hydrogen content can also be used as a more general reference between the different streams and sources of hydrocarbons described herein.

As used herein, the term "intermediate hydrogen-content" refers to hydrocarbons with a weight percent (wt %) of hydrogen between about 11.5 wt % and about 13 wt %. One skilled in the art will also appreciate that these terms regarding the hydrogen content can also be used as a more general reference between the different streams and sources of hydrocarbons described herein.

As used herein, the term "low hydrogen-content" refers to hydrocarbons that have a wt % of hydrogen that is lower than the intermediate hydrogen-content range. One skilled in the art will also appreciate that these terms regarding the hydrogen content can also be used as a more general reference between the different streams and sources of hydrocarbons described herein.

As used herein, the term "rich fuel gas" refers to low molecular-weight hydrocarbons, which can also be referred to as light hydrocarbon gases, that contain hydrogen and they include, but are not limited to: C1 gas; C2 gas; C3 gas; C4 gas; C5 gas; C6 gas; refinery fuel gas; light hydrocarbons from a second stage of a system 702 (as described further herein below); fuel reformer hydrogen gas; FCCU fuel gas; FCCU C3, C4, C5; gas field products C1, C2, C3, C4, C5, C6; coker product light ends C1, C2, C3, C4, C5, C6; visbreaker product light ends C1, C2, C3, C4, C5, C6; hydrotreater purge gas; hydrocracker purge gas; hydrogen product unit raw gas; or, combinations thereof. In comparison to the difficult to process heavy-oil feedstocks discussed herein, the rich fuel gases can have a high hydrogen content.

As used herein, the term "upstream" refers to a position or component within a system, apparatus, unit or a step within a process that is before a subsequent position, component or step.

FIG. 1A shows one example of portions of a thermal processor that is an upgrading system 10 that includes a distillation system 101 and a coker-fractionator unit 200. The upgrading system 10 can also be referred to as a thermal processor of heavy oil. The distillation system 101, which is also referred to as a low temperature that distillation system, includes an atmospheric distillation unit 12 and a vacuum distillation unit 14. The coker-fractionator unit 200 includes at least one coker drum 21, a fractionator tower 22 and a cracked hydrocarbon vapors line (CVL) 217 that provides fluid communication between the two. The coker-fractionator unit 200 can be any of the following types: a delayed coker system, a fluid coker system, a fluidized cracking unit similar to fluidized catalytic cracking system, or any other type of thermal cracking system that is used in a hydrocarbon refinery. For fluid catalytic cracking units, the person skilled in the art would understand that a reactor is typically used in place of a coker drum 21. While FIG. 1A shows only one coker drum 21, the person skilled in the art would understand that there can be multiple coker drums present and each drum is in fluid communication with the fractionator tower 22 through one or more CVLs 217.

Coker-Fractionator System

As shown in the non-limited example of FIG. 1A, a source of difficult to process heavy-oil, or any other type of hydrocarbon that requires upgrading to produce petroleum-based products, can be used as an initial feedstock for the upgrading system 10. The initial feedstock can be conducted through a conduit 100 to the low temperature distillation system 101 that includes an atmospheric distillation tower 12 for separating the heavy oil into atmospheric light-products, atmospheric gas oils and atmospheric bottoms. The atmospheric light products can be conducted from the atmospheric distillation tower 12 to further downstream processes, such as hydrotreatment, amine treatment and reforming via multiple conduits, all of which are depicted as conduit 104. The atmospheric gas oils can be conducted away from the atmospheric distillation tower 12 by a conduit 106 for combining with a light vacuum gas oil product of the vacuum distillation process, as discussed further below. The atmospheric bottoms can be conducted away from the atmospheric distillation tower 12 by a conduit 108 to a vacuum distillation tower 14. While FIG. 1A shows only one atmospheric distillation tower 12 and one vacuum distillation tower 14, the person skilled in the art would understand that there can be more than one of each type of tower.

The vacuum distillation tower 14 applies a vacuum pressure to the atmospheric bottoms for extracting the light vacuum gas oils, heavy vacuum gas oils from the vacuum tower bottoms. The light vacuum gas oils can be conducted by a conduit 110 to combine, or not, with the atmospheric light gas oils for further processing. The heavier vacuum gas oils can be conducted by a conduit 112 or 114 from the vacuum distillation tower 14, also for further processing. The vacuum tower bottoms are conducted away from the bottom of the vacuum distillation tower 14 by a conduit 116A.

In the example upgrading system 10 shown in FIG. 1A, the vacuum tower bottoms are, or form part of, a coker feedstock, that is conducted by the conduit 116A to a heater 20 and the heated coker feedstock is conducted by a conduit 215 to the coker-fractionator unit 200 where the coker drum 21 receives the heated coker feedstock. In other implementations of the present disclosure, the conduit 215 can provide feedstock, to other heavy oil cracking systems such as a fluid coker, or a fluid catalytic-cracking system.

Within the coker drum 21, the coker feedstock can be heated and pressurized to produce a coker product through a thermal-cracking process. The coker product is made up of cracked hydrocarbon vapor and entrained solid coke-particles, the cracked hydrocarbon vapor can also be referred to as a cracked hydrocarbon vapors product or a coker drum effluent. The cracked hydrocarbon vapor can include a wide range of constituents including non-hydrocarbons and hydrocarbons. The non-hydrocarbons constituents can include, but are not limited to: hydrogen ($H_2$) and hydrogen sulfide ($H_2S$). The hydrocarbons constituent within the cracked hydrocarbon vapor can include, but are not limited to: methane ($CH_4$), C2 to C4 hydrocarbons, a naphtha fraction, a kero fraction, and a gas oil fraction. The boiling point of the hydrocarbon constituents of the cracked hydrocarbon vapor can be in excess of 1000° F.

The solid coke-particles can also be referred to as coke or petroleum coke. The solid coke-particles include micro-carbon content that reflects the amount of heavy hydrocarbons with a high coking tendency. There are two types of micro-carbon. One type is referred to as distillable micro-carbon, which is generated by the hydrocarbons that are vaporized at the coker-fractionator unit's normal operating temperatures. The other type of micro-carbon is referred to as non-distillable micro-carbon, which is generated either by the hydrocarbons that cannot be distilled due to a high boiling-temperature, the presence of a multi-ringed structure, or the non-distillable micro-carbon can also be the coke fine itself. The non-distillable micro-carbon can end up in the fractionator tower 22 hydrocarbon products, as described further below, due to carry-over or entrainment within vapor streams within the coker-fractionator unit 200.

The coker product exits the coker drum 21 by the CVL 217, which conducts the coker product into the fractionator tower 22. In some implementations of the present disclosure, the CVL 217 can be between 500 and 2000 feet long (one foot is equal to about 0.305 meters). In some implementations of the present disclosure, substantially most of the solid coke-particles remain within the coker drum 21 but at least a portion of the solid coke-particles can become entrained within the stream of cracked hydrocarbon vapor and the entrained particles can be conducted by the CVL 217. In some examples of a coker-fractionator unit 200, the contents of the CVL 217 have a temperature of about 900° F. and a pressure of about 40 pounds per square inch gauge (psig, which is substantially equal to about 377 kilo-Pascals).

Solid coke can be removed from the coke drum 21 by known methods, which are collectively represented by line 230.

Within the fractionator tower 22 the coker product is separated into a top vapor product that is conducted by a conduit 218 that contains coke gas and rich fuel gases. The coker product is also boiling-point separated into further vapor products that are conducted away from the fractionator tower 22 by conduits 221. For example, the further vapor products include light coker naphtha (within a conduit 222), heavy naphtha (within a conduit 224), coker kerosene (within a conduit 226) and coker gas oil (within a conduit 228).

The fractionator tower bottoms have a high sulfur, nitrogen and oxygen content and, therefore, the fractionator tower bottoms are very polar. Additionally, the fractionator tower bottoms are very low in hydrogen content and they include many multi-ring aromatic structures. Due to these chemical properties, the fractionator tower bottoms can be difficult to process further. Typically, the fractionator tower bottoms are recycled back upstream of the coker drum 21 to combine with the coker feedstock within the conduit 116A via a recycle conduit 232. The recycle conduit 232 can continuously introduce a desired volume, over a specified time, of the fractionator tower bottoms into the coker drum 21 so that the recycled fractionator tower bottoms are continuously recycled until they are coked within the coker drum 21. This desired volume of recycled fractionator tower bottoms occupies a given volume of the coker drum 21, which necessarily reduces the volume of new coker feedstock that can be introduced into the coker drum 21 over a specific time.

As will be appreciated by one skilled in the art, the flow rate within the recycle conduit 232 can set the temperature cut-point for the further vapor products within the conduits 221, which can influence the quality of the further vapor products that are sent to downstream hydrotreaters, or other processing units, for further processing.

Figure 1B:
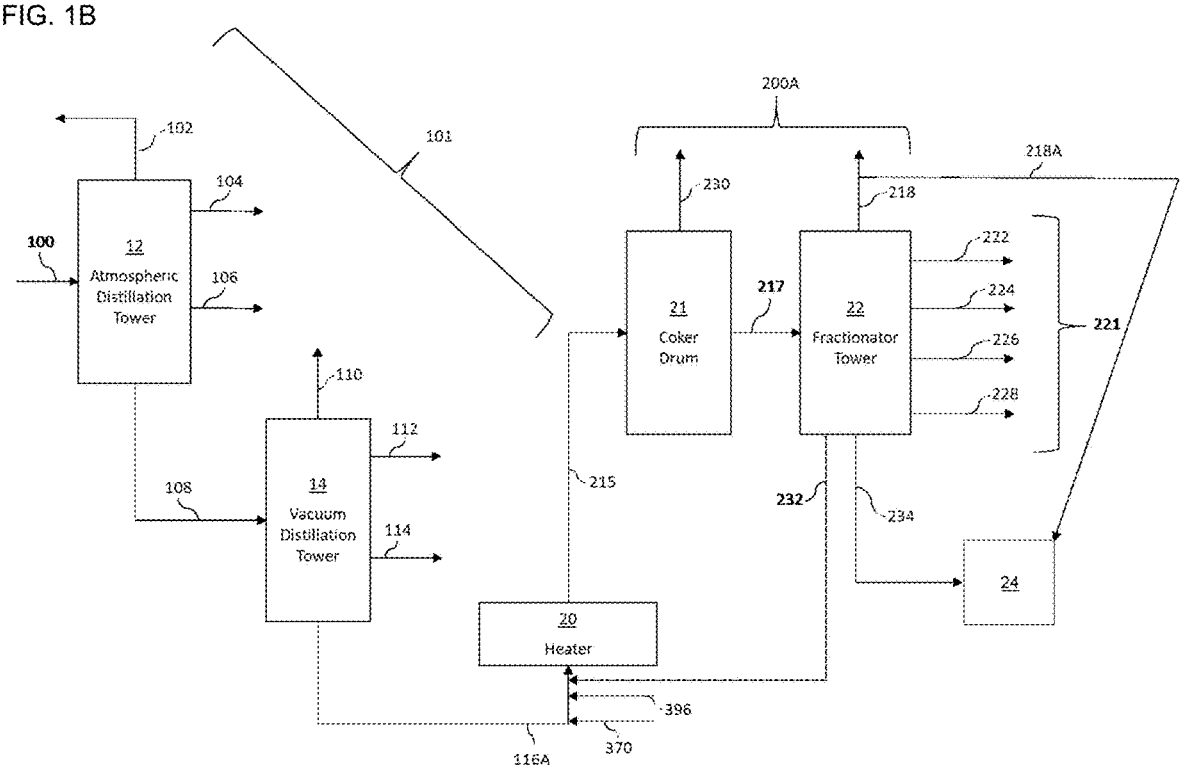

FIG. 1B shows another thermal processor that is a coker-fractionator unit 200A according to implementations of the present disclosure. The coker-fractionator unit 200A is similar to or the same as the coker-fractionator unit 200 described above, with at least the following differences. In some implementations of the present disclosure, the unit 200A can communicate some or all of the fractionator tower bottoms to a reaction unit 24 via a conduit 234. For example, in some implementations of the present disclosure, the unit 200A can decouple (or not require) the conduit 232, which recycles at least a portion of the fractionator tower bottoms back to the conduit 116A and the fractionator tower bottoms can be conducted by a conduit 234 to communicate with the contents of the conduit 300 for use as a primary feedstock in the reaction unit 24. In some implementations of the present disclosure the unit 200A also communicates some or all of the rich fuel gas content of the conduit 218 within a conduit 218A to the reaction unit 24.

In some implementations of the present disclosure, the reaction unit 24 can perform a thermal upgrading process, which may also be referred to as a thermal cracking process. For example, the unit 24 can be a slurry-phase hydrocracking reaction vessel (also referred to as a SHC unit) within which a slurry-phase hydrocracking upgrading process (a SHC process) can occur. In other implementations of the present disclosure the unit 24 can be an upgrading system 700 or an upgrading system 702, each of which include at least one integrated thermal processing will be described further herein below. In other implementations of the present disclosure the unit 24 can include a SHC unit and one or both of the system 700 and the system 702.

Implementations of the present disclosure can provide an economic way to upgrade low-value feedstocks, such as difficult to process heavy oil feedstocks. Without being bound by any particular theory, the coker-fractionator unit 200A can have at least the following advantages over the coker-fractionator unit 200: protection and longer operational life for the coker unit and downstream fixed-bed catalysts; coker-yield increases through a reduced pressure within the coker drum 21 and directing the fractionator-tower bottoms for further processing within the unit 24. In some implementations of the present disclosure, the unit 24 permits further processing of the fractionator tower bottoms, as an example of a difficult to process heavy-oil feedstock, rather than just recycling via the conduit 232 until the fractionator tower bottoms are converted to coke and gas. By diverting some or all of the content of the conduit 232 to the unit 24, the coker drum 21 can have increased volumetric capacity, which can also increase the coker yields. Furthermore, the rich fuel gases can serve as a less expensive source of hydrogen than pure hydrogen. On a BTU basis, the rich fuel gases are typically sold at a steep discount to other oil products. Through implementations of the present disclosure, the rich fuel gases can be directly incorporated into the difficult to process heavy-oil feedstocks to generate products that can be sold as a synthetic crude oil or a refined liquid product.

SHC Process

In some implementations of the present disclosure, the SHC process that occurs within the reaction unit 24 is a thermal upgrading process that includes the use of anti-coking additives, a hydrogen-gas stream and a pressurized, high temperature vessel used to upgrade heavy-oil feedstocks within a slurry phase. The SHC process uses polar aromatic compounds for slowing the self-association of toluene insoluble organic residues (TIOR) during the thermal upgrading thereby causing an increased upgrading potential of a given feedstock, while yielding less or no coke. During the thermal upgrading of the feedstocks in the SHC process, the asphaltene exists in association with resins, which are smaller, polar-aromatic structures and other higher hydrogen-content hydrocarbon structures. The asphaltenes crack at slower rates relative to surrounding hydrocarbon structures, which maintain the asphaltenes in a suspension. The asphaltenes contain the highest concentration of the oxygen, nitrogen and sulphur polar species relative to the other hydrocarbon species. As the heavy oil is upgraded, the polar species in the asphaltenes can become concentrated due to the thermal cracking of the asphaltenes. The combined effect of the more rapid conversion of the supporting resin hydrocarbons relative to the asphaltenes and the concentration of the more polar asphaltene species result in their tendency to self-associate and form mesophase coke and TIOR. Factors that favour relative increased rates of hydrogenation of the resins, such as active catalyst systems, result in increased mesophase coke generation. The addition of the polar aromatic resin type structures into the feedstock limits the asphaltenes self-association and generation of mesophase coke, while these compounds undergo thermal conversion, by performing a function similar to the original resins within the feed.

It is also known that the use of polar aromatic resins can reduce the TIOR and the conversion of TIOR to ash. Ash is a combination of an iron sulfide (FeS) anti-coking additive; metals laid down from conversion of feedstocks; and any solids from the feedstock such as silt. The higher polarity TIOR compounds are associated with the FeS anti-coking additives. As the TIOR concentration increases, the individual ash and TIOR particulates in the slurry suspension associate together creating larger, denser particles that settle out causing coke laydown in the reaction and fractionation systems.

During the SHC process, the anti-coking additives and the feedstock input for the SHC process are premixed, heated and added into the SHC unit to form a slurry-phase. Within the slurry-phase, the anti-coking additives inhibit the formation of coke. The mixture of heavy oil input and anti-coking additives are introduced by input feed nozzles located at the bottom of an SHC vessel within the SHC unit. In some SHC units, the hydrogen-gas stream is heated to between about 842° F. and about 1112° F. and introduced by gas feed nozzles with a velocity of at least 390 ft/sec located above the input feed nozzles within the SHC vessel. The liquid feed and some gas is introduced at the bottom of the SHC vessel at between about 572° F. and about 806° F. and above a velocity of about 82 ft/sec. The thermal and kinetic energy of these two streams provide the energy for the cracking and hydrogenation reactions, mixing, and vaporization of the light hydrocarbons generated.

Some SHC configurations have also demonstrated the ability to upgrade solid carbonaceous materials into liquid products. This ability to upgrade coal and petroleum coke differentiates the SHC configurations from the other thermal upgrading processes.

Integrated Thermal Process (ITP)

Figure 2:
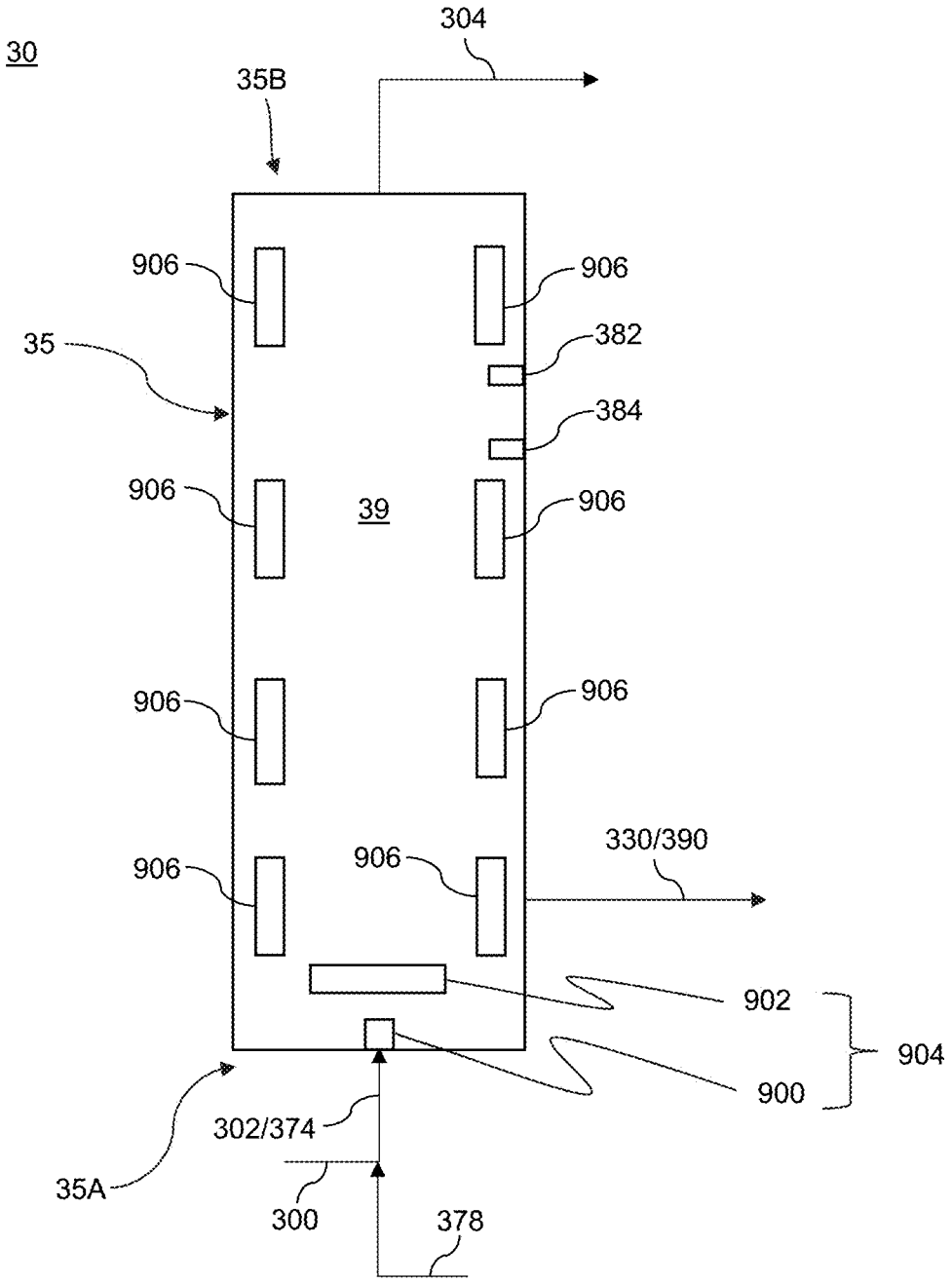
FIG. 2 is a schematic of a reactor unit according to implementations of the present disclosure.

FIG. 2 shows one implementation of an integrated thermal process (ITP) reactor unit 30, which may also be referred to as an ITP reaction vessel, according to implementations of the present disclosure. As will be described further below, the ITP reactor unit 30 can be used within the system 700 and the system 702. The reactor unit 30 has a first end 35A, a second end 35B and a side wall 35 that extends therebetween to define an internal plenum 39. Within the reactor unit 30 includes a TIOR management system that includes an inlet 900 and a gas inlet 902. The inlet 900 is configured to receive the contents of one or more of conduit 302, conduit 322, conduit 334 or conduit 374 and to introduce these contents into the plenum 39. The gas inlet 902 is configured to receive a hydrogen-containing gas from one or more of conduit 320, conduit 325 or conduit 326 and to introduce the hydrogen-containing gas into the plenum 39. Together these two inlets 900, 902 can be referred to as the gas-contactor system 904. The gas-contactor system 904 can provide a high efficiency zone within the plenum 39 of the reactor unit 30 for converting TIOR materials and for introduction of very high temperature, hydrogen-containing gas.

Briefly, the gas-contacting system 904 system includes components that are useful for processing harder-to-vapourize, high viscosity, high-boiling feedstocks. The gas-contacting system 904 physically prepares the hydrocarbons exiting the gas inlet 902, the contents entering through the inlet 902, and the most concentrated TIOR-Ash segment of the contents within the reactor unit 30. The gas-contacting system 904 provides the source of the high temperature gas with temperatures typically in excess of about 800° F., about 900° F., about 1000° F. or higher. In some implementations of the present disclosure, the gas temperature at the inlet 900 can be more than 200° F. hotter than the bulk reactor temperature in the reactor unit 30. As the molecular weight of the high hydrogen content gas is introduced through gas inlet 902 increases, the amount of energy both in terms of enthalpy and kinetic energy at the discharge of the gas inlet 902 is increased. At any given velocity through the gas inlet 902, the gas jet penetration also increases energy transferred to the reactor contents in the proximity of the gas-contacting system 904. Improving the efficiency in this energy-transfer process can reduce the partitioning which reduces the TIOR yield, increases conversion, and decreases the gas yield. Within the reactor unit 30, the hydrocarbon vapour contact time is typically in the range of about 1 to 2 minutes. However, the contact time for the reactor contents to quench the high temperature gas jets exiting 902 is in the order of milliseconds. As the temperature is increased within the reactor unit 30, the contact time is reduced for a given feedstock conversion. The maximization of this contact temperature and the minimization of this contact time with the rapidly quenched gas jets can result in the maximization of the olefinic reactions, which can impact subsequent availability for further reaction pathways. The configuration of reactor 30 and the operating conditions are set-up to segregate and position the TIOR-Ash complex in contact with the fluids entering the reactor unit 30 by the gas inlet 902, thereby maximizing the energy intensity at the point of the maximum concentration of TIOR and Ash in the reactor unit 30. Exposure to this maximized energy intensity can be followed by an immediate quenching to the bulk reactor temperature.

In some implementations of the present disclosure, the gas-contacting system 904 can provide one or more of the following aspects to facilitate the production of ITP products from a difficult to process heavy-oil feedstock:

a. the high intensity energy associated with introducing the hydrocarbon by a gas jet;

b. the physical-contact parameters (such as mass, velocity, geometry, temperature and others) that create a situation analogous to the generation of small feed droplets within a fluid catalytic coker (FCC) riser;

c. a physical proximity of the TIOR and Ash to interact with: the gas inlet 902; the TIOR-Ash suspension at the bottom of the reactor unit 30 due to a combination of "fluidization" and particle size control; and a polar-aromatic control system. The polar-aromatic control system allows the inlet 904 to position the ash for contacting with the hydrocarbon vapor and subsequent withdrawal. In some respects this is analogous to reducing an FCCU feed viscosity to promote the generation of smaller droplets within the FCCU contacting system; and d. a rapid quenching of the high temperature jets by the bulk solution in the reactor unit 30. The gas-contacting system 904 can become more effective as lower hydrogen content gas is introduced at the inlets 904.

Without being bound by any particular theory, the heat supplied by the high density gas jets at the inlets 902 will be at temperatures far above previous commercial thermal-upgrading operations. The reactor unit 30 can include a quench that acts to maximize the jet contacting temperature and allow the bulk solution within the reactor unit 30 to operate at a lower temperature, which can be beneficial in some configurations, such as a satellite processing unit.

The inlet 900 can also provide control over the introduction of polar aromatic oils (donor-solvents) and FeS anti-coking additives, which in turn can influence the particle size of the Ash and facilitate the direct incorporation of light hydrocarbons by alkylation reactions. In some implementations of the present disclosure, the reactor unit 30 can also include one or more densitometers 906 that are configure to monitor the density of the mixed, three phase contents of the reactor unit 30 to allow determinations of Ash and TIOR content. In some implementations of the present disclosure at least two densitometers 906 are positioned within the reactor unit 30 between the first end 35A and the second end 35B. In some implementations of the present disclosure at least one densitometer 906 is positioned within the reactor unit 30 at or proximal to the gas-inlet. In some implementations of the present disclosure at least one densitometer 906 is positioned within the reactor unit 30 between the gas-inlet and the second end. In some implementations of the present disclosure at least one densitometer 906 is positioned within the reactor unit 30 proximal to the first end 35A within one third (⅓) to two thirds (⅔) of the distance between the first end 35A and the second end 35B. By monitoring differences in the concentration of the high density TIOR and Ash within the reactor, the TIOR inventory can be directly monitored. This methodology takes advantage of the Ash gradient set-up over the length of the plenum 39 that results from the difference in settling velocities at different TIOR/Ash ratios. The concentration of Ash and TIOR at the point of the gas contactor can be optimized via the asphaltene accumulation balancing operating parameters or by solvency adjustments facilitated by adding more or less high solvency feeds into the bottom of the reactor below the gas inlet 902, or adjusting the quantity of higher hydrogen content, low solvency feedstock into the top half of the reactor unit 30. The temperature and energy input through the gas-contacting system 904 can be maximized by using a gas or liquid quench into the top of the reactor. While elevated ash content in the reactor unit 30 acts to minimize foaming in the reactor unit 30, an anti-foam agent can be injected into the top of reactor as a supplemental method for controlling foaming in the reactor unit 30. As will be appreciated by one skilled in the art, the anti-foam agent can be injected into the reactor unit 30 by one or more inlets, as can other feeds that can be desirable to include within the plenum 39 of the reactor unit 30.

In some implementations of the present disclosure, the environment within the reactor unit 30 can cause very high conversion, which in turn can cause a new issue of preventing the additive and other ash from building up within the reactor unit 30 process. The ash inventory within the reactor unit 30 can be maintained at elevated levels because that can be favourable for the desired chemical reactions and for minimizing foaming in the system. In some implementations of the present disclosure, the average concentration of ash within the reactor unit 30 is at least 15 wt % of the total contents of the reactor unit 30. In other implementations of the present disclosure, the average ash concentrations within the reactor unit 30 is greater than 17 wt %, greater than 19 wt % or greater than 21 wt % of the total contents of the reactor unit 30. At these higher ash concentrations, the reactor unit 30B can display a fluid-bed circulation profile that can enhance TIOR management with ash circulating down an annular area near the reactor unit's 30 side walls.

In some implementations of the present disclosure, the reactor unit 30 may include a recycle gas loop of one or more conduits that can conduct gaseous products within the plenum back to the gas-contactor system 904 in a recycle gas loop. In some implementations of the present disclosure, the recycle gas loop can include a slip stream for removing impurities from the recycled gas. Some non-limiting examples of impurities within the recycle gas include, but are not limited to $H_2S$, $H_2O$ and $NH_3$.

Single Stage ITP System

Figure 3:
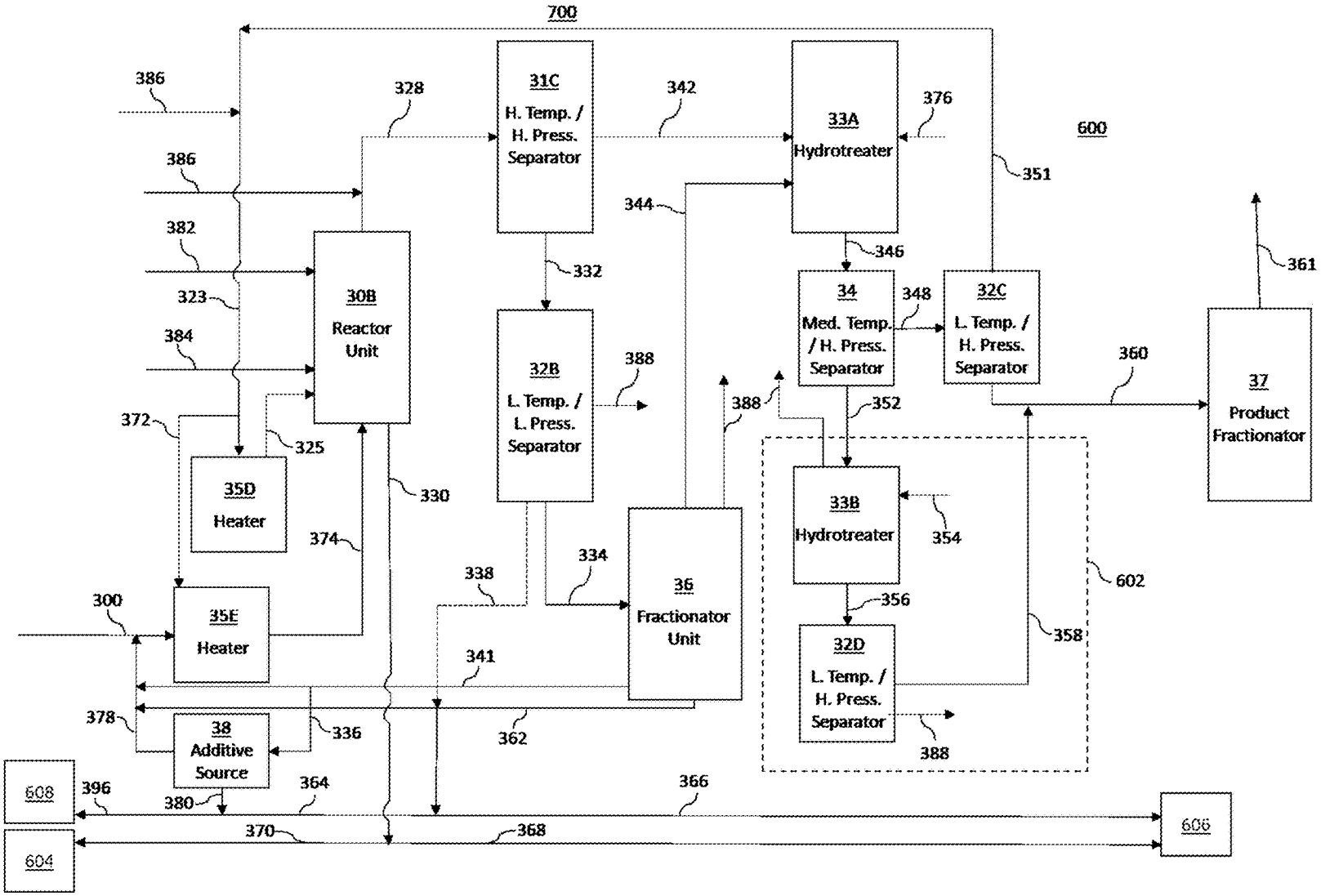
FIG. 3 is a schematic of a single-stage ITP system, according to implementations of the present disclosure.
Figure 4:
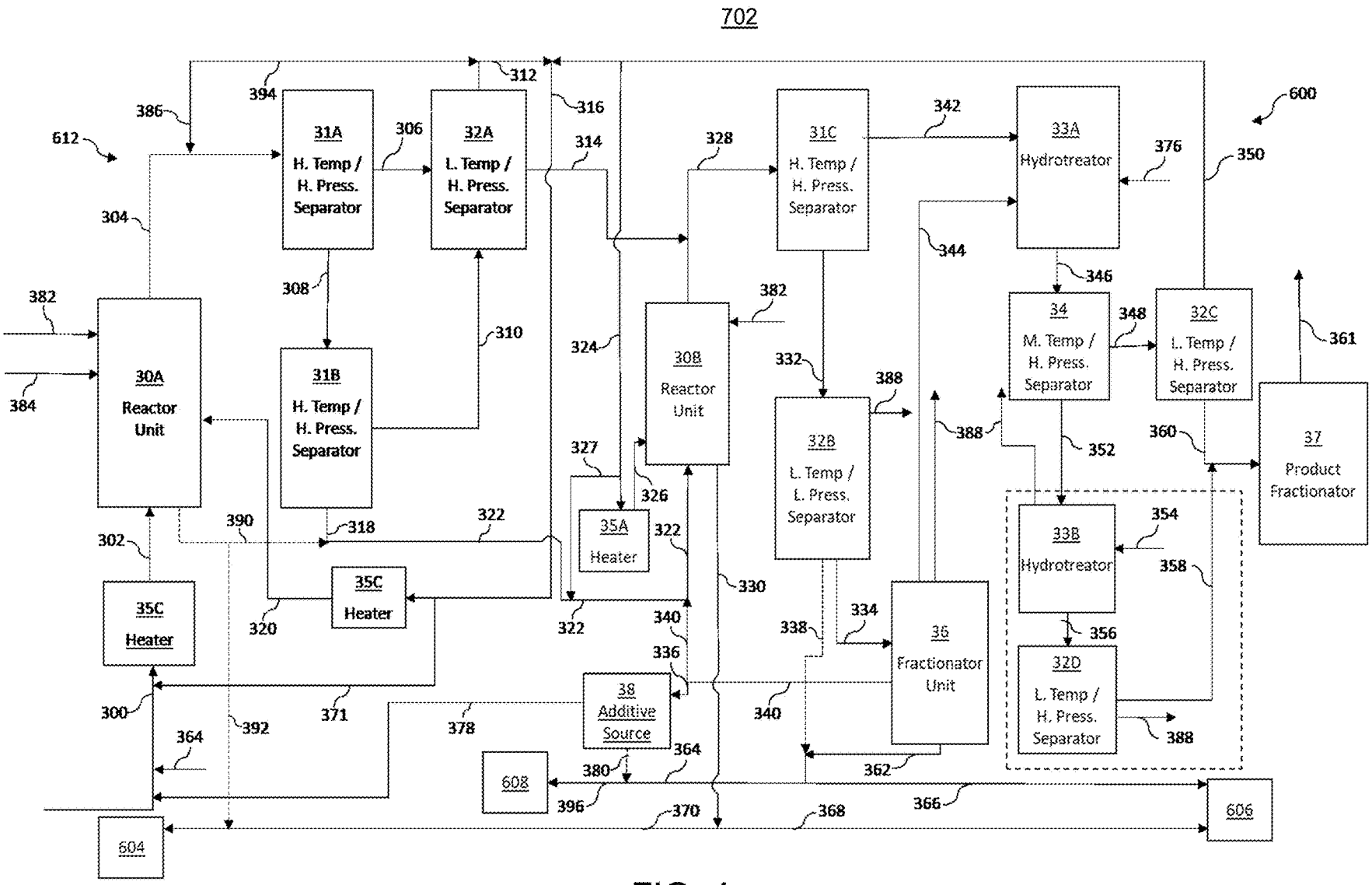
FIG. 4 is a schematic of a two-stage ITP system, according to implementations of the present disclosure.

FIG. 3 shows an example of a single-stage ITP system 700. FIG. 4 shows an example of a two-stage ITP system 702. The stages refer to the number of ITP reactor units 30A, 30B (as the case can be) that are contained within the process. The reactor units 30A and 30B are substantially the same as the reactor unit 30 described above. Both of the single-stage system 700 and the two-stage system 702 can utilize similar chemical, thermal and mechanical methods to process the feedstock into the final ITP products. Substantially complete or complete conversion of the feedstock to 975– F product is possible when operating the system 700 or the system 702. Greater conversion of the feedstock is an easier feat for the two-stage system 702 due to the added flexibility the system 702 offers.

FIG. 3 and FIG. 4 have common flow and vessel numbers. FIG. 3 will be described first with the expectation that there will be ash, due to incomplete conversion, within an emulsion that exits the reactor unit 30B. For the two-stage ITP process detailed in FIG. 4 there will be no liquid phase with ash leaving the top of the second reactor unit 30B.

The ITP process can be implemented with a number of different system configurations and with one or more reactor units 30 similar to that shown in FIG. 2. FIG. 3 shows an example of a configuration of the system 700 based on a single reactor unit 30B within a process loop 600 of the system 700 according to implementations of the present disclosure. The process loop 600 is designed to cascade from a highest hydrogen partial pressure at the downstream end of the loop through to the lowest hydrogen partial-pressure at the upstream end of the loop 600, while the overall operational pressure within the process loop can be substantially the same. This process generates an ash from the reactor unit 30B that can be transported upstream to increase the efficiency of upstream upgrading facilities, referred to herein as one or more of satellite processing units 604.

The lowest hydrogen content gas should contact the most receptive alkylation bonding sites within the reactor unit 30B at the gas contactor 904. Both of the gas and liquid feedstocks are introduced at locations with that objective. The operating conditions are set-up to isolate the most receptive heavy aromatics and transport them to the gas contactor 904 to interact. Operating conditions are set-up to maximize direct incorporation of the light high hydrogen content hydrocarbons into the low hydrogen content hydrocarbon components at the gas contactor 904 and to provide sufficient energy to reduce and/or negate partitioning of the polar species.

Some implementations of the present disclosure relate to the reactor unit 30B receiving a slurry-feed mixture of the difficult to process heavy-oil feedstock and from about 0.01-4.0% by weight (based on fresh feedstock) of coke-inhibiting additive particles move upwardly from a high intensity mixing zone through a confined vertical hydrocracking zone within the reactor unit 30B. The reactor unit 30B can be maintained at a temperature of between about 660° F. (about 350° C.) and about 1150° F. (about 600° C.) at a pressure of about 3.5 mega Pascals (MPa) to about 24 MPa. In some implementations of the present disclosure, the reactor unit 30B can have a space velocity of up to 4 volumes of hydrocarbon oil per hour per volume of hydrocracking zone capacity (LHSV). Within the reactor unit 30B, the gas-contacting system 904 can include an arrangement of the gas input nozzles 902 that introduce the hydrogen containing gas with sufficient thermal energy and kinetic energy to create an environment that will break apart TIOR and facilitate the direct incorporation of the hydrogen containing gas onto the low hydrogen hydrocarbon feedstock. These gas input nozzles 902 are part of the gas contactor 904. The difficult to process heavy-oil feedstock, anti-coking additive, polar aromatics are supplemented with sufficient high hydrogen content gas to enter through inlet 900 within the reactor unit 30B to optimally distribute the TIOR-Ash complex for interaction within the gas-contacting system 304 and prevent deposition in the bottom of the reactor unit 30B.

Under these parameters, the contents of a three-phase reaction system, including the products of the conversion of the various feedstocks, recycle gas and ash exit the reactor unit 30B as a mixed effluent from the top of the reactor unit 30B by a conduit 328. In the case of very high feedstock conversion, conduits 304, 328, can contain vapour products only with an ash stream exiting the bottom of the reactor through conduit 330 (and/or conduits 390 and 392 from reactor unit 30A, as shown in FIG. 4).

The reactor unit 30B can crack difficult to process heavy-oil feedstocks. The difficult to process heavy oil feedstocks contain various amounts of asphaltenes. As will be understood by one skilled in the art, asphaltenes are high molecular-weight compounds that contain heteroatoms, which impart polarity. Asphaltenes also contain aromatic structures and they can be highly unsaturated. Asphaltenes are also known to be surrounded by a layer of resins made up of polar aromatic structures. The resins are a mixture of lower molecular-weight class of compounds that have many of the same chemical features as the asphaltenes. The resin can stabilize the asphaltenes in colloidal suspensions. In the absence of the resin, the asphaltenes can self-associate, or flocculate to form larger molecules which can precipitate out of solution. This is the first step in coking. The difficult to process heavy oil feedstocks also have a lower ratio of resin to asphaltenes. One non-limiting example of a difficult to process heavy oil feedstock is Visbreaker bottoms derived from a Mene Mota VTB visbreaker feed, which has a resin to asphaltene ratio of about 0.56:1.

The reactor unit 30B can operate at a higher temperature and lower hydrogen partial-pressure than typical hydrocracking processes and systems. Without being bound by any particular theory, a very short contact, higher temperature reaction environment can provide an improved balance between the thermal asphaltene cracking and the cracking of the resin. A lower hydrogen partial-pressure can also result in benefits in hydrogen management. Although the ITP process can be carried out in a variety of known reactors with either up or down flow, the process is particularly well suited to a tubular vessel through which the mixture of difficult to process heavy-oil feedstock, the additive particles and a hydrogen-containing gas move upwardly due to the high mixing environment at the base of the reactor unit 30B caused by the gas contactor 904 and the auto-cooling effect of the vapourization of the lower molecular weight cracked products.

A variety of additive particles can be used in the reactor unit 30B, provided that the additive particles survive the operating temperatures and pressures of the ITP process and remain effective as part of any recycle loops. Particularly useful additive particles include FeS particles with a particle size of less than about 45 microns (μm) and with a major portion, i.e. at least 50% by weight, preferably having particle sizes of less than 10 μm. The FeS particles can be mixed with the difficult to process heavy-oil feedstock and enter into the reactor unit 30B. A portion of the heavy hydrocarbon oil product is used to form the recycle stream of the present disclosure. The particle size of the FeS introduced into the process becomes smaller and more active with time in the process. The increased activity is due to the inclusion of materials contained in the feed such as vanadium (V) and nickel (Ni) that become an integral part of the ash. Even materials such as fine sand contained in feedstocks such as some mined bitumen become active components in the ITP ash mix.

Upstream of the reactor unit 30B, the difficult to process heavy-oil feedstock is conducted from its source to a gas heater 35E via a conduit 300 for heating to temperatures between about 600° F. and 800° F. The heated feedstock is conducted to the reactor unit 30B via a conduit 374 so that the heated feedstock enters at or near the bottom of the reactor unit 30B and is proximal to the gas contactor 904. A conduit 328 conducts a mixed effluent from the top of the reactor unit 30B to a high temperature, high pressure separator 31C operating at typically between 600° F. and 800° F. The separator 31C separates the mixed effluent into a liquid and ash stream 332 and a vapor stream 342. The conduit 332 conducts the liquid and ash stream to a low temperature, low pressure separator 32B. The separator 32B can operate over a variety of temperatures and pressures to separate the liquid and ash stream into a further liquid and ash stream and a further vapor stream. The further liquid and ash stream is conducted by a conduit 334 to an optional high boiling point, sour fractionator 36. If the fractionator 36 is not present, then the liquid and ash stream can be conducted by a conduit 338 and be recycled back into the reactor unit 30B by conduit 300, or conduit 338 which can communicate with a conduit 396 to allow the stream to be communicated upstream or conduit 338 can communicate with a conduit 366 where unconverted material can be recovered and the Ash can be recovered, as discussed further below. The further vapor stream is conducted by a conduit 388 to communicate with a conduit 386 and/or a conduit 394, as discussed further below.

The vapor stream from the separator 31C is conducted by a conduit 342 to an optional first hydrotreater vessel 33A. The first hydrotreater vessel 33A can also receive a vapor stream from the high boiling point, sour fractionator 36 (if present) by a conduit 344. The optional first hydrotreater vessel 33A can also receive an optional stream of high-purity hydrogen via a conduit 376. In some implementations of the present disclosure, the optional stream of hydrogen can come from a steam-methane reformer.

FIG. 3 shows an optional first hydrotreater vessel 33A that produces a first hydrotreater effluent that is conducted by a conduit 346 to a medium temperature, high pressure separator 34. The separator 34 produces a vapor stream 348, and a liquid stream 352.

The vapor stream from the separator 34 can include light gas and naphtha up to a full range of materials, depending on the temperature of the separator 34. The vapor stream can be conducted to a low temperature, high pressure separator 32C by a conduit 348. The separator 32C can produce a liquid product stream and a vapor stream and the product stream can be conducted by the conduit 360 to a product fractionator 37 that separates the product stream into further valuable product streams, for example by boiling point separation or other applicable methods. The vapor stream from the separator 32C can be conducted by a conduit 351 to a gas heater 35D and the heater 35E. The gas heater 35D can heat the vapor stream from the separator 32C to a temperature between about 800° F. and 1400° F. and this heated vapor stream can be conducted by a conduit 325 to enter the reactor unit 30B. In some implementations of the present disclosure, the product fractionator 37 can also produce a stream of high hydrogen content light hydrocarbon feed that is conducted back into the reactor unit 30B via a conduit 361, which can pass through one or more heaters before entering into the plenum 39 of the reactor unit 30B.

In some implementations of the present disclosure, the liquid stream is conducted by a conduit 352 to a product finishing hydrotreater system 602 that includes a second hydrotreater vessel 33B and a low temperature, high pressure separator 32D. The second hydrotreater 33B in turn produces a liquid stream and a vapor stream. The second hydrotreater vessel 33B can also receive an optional stream of high-purity hydrogen via a conduit 354. In some implementations of the present disclosure, the optional stream of hydrogen can come from a steam-methane reformer. The liquid stream from the second hydrotreater vessel 33B is conducted by a conduit 356 to the separator 32D. The vapor stream from the second hydrotreater vessel 33B can be communicated with the contents of the conduit 388. The separator 32D can produce a product stream and a vapor stream and the product stream is conducted by a conduit 358 to communicate with a conduit 360. The vapor stream from the separator 32D can be communicated with the contents of the conduit 388. In other implementations of the present disclosure, the vapor stream from the separator 34 is not conducted to the product finishing hydrotreater system 602, rather the vapor stream is communicated with the contents of the conduit 348.

This vapor stream can bypass loop 602, if present, and head directly to the separator 32C.

In some implementations of the present disclosure, a stream of high hydrogen-content materials can be conducted by a conduit 386 to communicate with the contents of either or both of the conduit 351 and the conduit 328. The conduits 388 contain the recycled gases from various separators in the process which communicate with conduit 386. The conduit 351 contains the recycle gas from separator 32C. The conduit 328 contains the mixed effluent from the ITP reactor unit 30B. The conduit 351 enters either the heater 35D or the heater 35E via conduit 372. What enters the heater 35D are the recycle gas from the ITP process and the high hydrogen content material. Some examples of high hydrogen-content materials includes: gas field products such as C1, C2, C3, C4, C5, C6 and the like; FCCU derived fuel-gas, such as $H_2$, C1, C2, C2 olefins (C2o), C3, C3 olefins (C3o), C4s, C4 olefins (C4o); coker derived fuel gas, such as $H_2$, C1, C2, C2o, C3, C3o, C4s, C4o; visbreaker derived fuel-gas, such as $H_2$, C1, C2, C2o, C3, C3o, C4s, C4o; purge gases from hydrotreaters, such as $H_2$, C1, C2, C3; light hydrocarbons from downstream unit separators, the contents of conduit 388 and combinations thereof. The high hydrogen content material will exit the heater 35D via conduit 325 and enter the reactor unit 30B. Conduit 325 directly supplies inlet 902 detailed in FIG. 2. The conduit 372 enters heater 35E and then communicates with the feedstock within conduit 300.

In some implementations of the present disclosure, a stream of intermediate hydrogen-content materials can be conducted from a source to enter the reactor unit 30B by a conduit 384. The conduit 384 can inject intermediate hydrogen-content materials that provide quenching, facilitate greater TIOR management, and supplies additional carbon and hydrogen to the reactions within the reactor unit 30B. For example, the intermediate hydrogen-content material could be a paraffinic crude VTB with a hydrogen content of about 12 wt % and could contain light hydrocarbons. FIG. 30 shows examples of low hydrogen content feedstocks and shows a range of feedstocks derived from Athabasca bitumen ranging from 7.8 to 10.3 wt % hydrogen content.

In some implementations of the present disclosure, a stream of high hydrogen-content materials can be conducted from a source to enter the reactor unit 30B by a conduit 382. The high hydrogen-content materials can be one or more of coker naphtha, visbreaker naphtha, flashed low boiling diluent from diluted bitumen or combinations thereof. The high hydrogen-content materials can enter at or above the gas-contacting system 904 of the reactor unit 30B. In some implementations of the present disclosure, the high hydrogen content materials can act as a quench within the reactor unit 30B. The ITP reactor unit 30B utilizes the quench to reduce the temperature within the reactor unit 30B. This reduction in reactor temperature allows the gas-contacting system 904 to inject more gas or gas at a higher temperature facilitating heavy aromatic conversion and direct incorporation of the high hydrogen hydrocarbon content into the feedstock.

The reactor unit 30B also produces a liquid stream, which can also be referred to as a reactor drag-stream, that can be conducted by a conduit 330 to one or more of satellite processing units 604 by a conduit 370 and/or to a metal reclamation unit 606 by a conduit 368. The conduit 330 can have an outlet within the reactor unit 30B that is positioned above the gas contactor 904, for example between about 1 and 5 feet above the gas contactor 904, or more about 3 feet above the gas contactor 904. In some implementations of the present disclosure, the outlet for conduit 330 can be positioned within the bottom half (½) or bottom (⅓) or bottom quarter (¼) of the height of the reactor unit 30B.

The satellite processing units 604 can further process the liquid stream from conduit 330. For example, the one or more satellite processing units 604 can be a coker-fractionator unit, a visbreaker unit or a hydro-visbreaker unit. The metal reclamation unit 606 can isolate metals, such as Nickel (Ni) and/or Vanadium (V) in the liquid stream from the reactor unit 30B. Additionally, the conduit 330 from the reactor unit 30B can contain TIOR materials and Ash, so the conduit 370 can provide these materials to the one or more satellite processing units 604. For example, excessive amounts of TIOR materials can be sent to a satellite coker-fractionator unit for further high temperature carbon rejection processing. In other examples, high conversion/low TIOR polar aromatic materials and ash can be sent to one or more satellite processing units 604 as a hydrogen donor for increasing conversion within those satellite processes. Metals such as V, Ni, Iron (Fe), Titanium (Ti), Chromium (Cr), Manganese (Mn), Magnesium (Mg), Molybdenum (Mo), Strontium (Sr), Cobalt (Co), Zinc (Zn), or combinations thereof can be isolated via a clarifier or other known approaches. These metals are transported out with gas oil. This gas oil/ash mixture is transported to a low pressure clarifier. In the low pressure clarifier, the highly viscous gas oil is readily separated from the ash. The ash falls to the bottom where the remaining hydrocarbon can be burned. What remains is an oxide isolate of these various metals that is hydrocarbon-free.

In the implementations that have a high boiling point, sour fractionator unit 36, a liquid stream is generated therein that is conducted by either or both of a conduit 341 and a conduit 362. The conduit 341 conducts at least a portion of the liquid stream from fractionator unit 36 to communicate with a conduit 336 and/or a conduit 378. The conduit 336 conducts its contents to a source 38 of anti-coking additive, for example the FeS-based additive as described herein above. In other implementations of the present disclosure, the source 38 of additive can include raw anti-coking additive and/or a polar-aromatic carrier material. The liquid stream within the conduit 336 can be a carrier for conducting the anti-coking additive into a conduit 378 and/or a conduit 380. The conduit 378 conducts its contents to join the primary feedstock within the conduit 300. The conduit 380 communicates its contents to join a conduit 364. The conduit 364 conducts its contents, which can include polar aromatic compounds and Ash to one or more satellite processing units 604. The conduit 362 conducts at least a portion of the liquid stream from the fractionator unit 36 to communicate with the conduit 364 and/or a conduit 366. The conduit 366 conducts its contents to the metal reclamation unit 606. The conduit 364 conducts its contents to conduit 396 which continue on to one or more of the satellite processing units 608.

Two Stage ITP System

FIG. 4 shows the reactor unit 30B within a process loop 600 of the system 702 and another reactor unit 30A with a second process loop 612, according to implementations of the present disclosure. The flow of feedstocks, intermediates and products within the process loop 600 are similar or the same as to how they are described above regarding system 700. At least one difference between system 700 and system 702 is that the primary feedstock is conducted by the conduit 300 into a gas heater 35C and the heated primary feedstock is conducted by a conduit 302 into the bottom of the reactor unit 30A. In the context of the system 702, the reactor unit 30A can be referred to as the first unit 30A and the reactor unit 30B can be referred to as the second unit 30B. The purpose of the design of the two systems 700, 702 is to setup the process such that the highest hydrogen partial-pressure is maintained at the downstream end of the system and the lowest hydrogen partial-pressure is established at the upstream end of the system, while the overall operating pressure of the system can remain substantially the same. The operating conditions are set-up to isolate the most receptive heavy aromatics and transport them to the gas contactor 904. Conditions are set-up to maximize direct incorporation of high hydrogen-content into the heavy aromatics at the gas distributor and provide sufficient energy as to negate the partitioning of the polar species.

The first unit 30A can generate a mixed effluent that is conducted by a conduit 304 to a first high temperature, high pressure separator 31A. The first separator 31A produces a liquid stream and a vapor stream. The liquid stream can be conducted by a conduit 308 to a second high-temperature, high pressure separator 31B. The second separator 31B produces a further liquid stream and a further vapor stream. The further liquid stream can be conducted by a conduit 318 to communicate with the contents of a conduit 322, which will be discussed further below. The further vapor stream can be conducted by a conduit 310 to a first low temperature, high pressure separator 32A. The separator 32A also receives the vapor stream from the first separator 31A by a conduit 306. The separator 32A produces a liquid stream and a vapor stream. The vapor stream can be conducted by a conduit 312 into a conduit 316, as will be discussed further below. In some implementations of the present disclosure, the vapor content of conduit 316 can include one or more gases with medium hydrogen-content and/or high hydrogen-content. The liquid stream from the separator 32A can be conducted by a conduit 314 to communicate with the contents of the conduit 328 of the loop 600.

In some implementations of the present disclosure, the second unit 30B is configured to receive ash from the separator 31B via conduit 318 and optionally from the first reactor drag stream within the conduit 390. The ash within conduit 318 and within conduit 390 can be produced within the systems of the present disclosure with a smaller average particle size and so they are generally more active in hydrogen transfer reactions than the anti-coking additive systems (such as the FeS additive system). In addition to the smaller average particle size of the ash within the conduits 318 and 390, this ash can have a lower TIOR:ash ratio because this ash has already been at least partially processed by the separator. In this context, the contents of the conduit 392 could be rich in an easier to separate material, such as sand or silt, and this material that could be suitable for disposal in a coker as coke.

The first unit 30A can also produce a first-reactor drag stream that can be conducted by a conduit 390 to communicate with the contents of the conduit 392 and/or with a conduit 322. The conduit 322 conducts its contents into the second unit 30B. The first-reactor drag stream can provide inventory balancing of the TIOR materials and the Ash. The first-reactor drag stream can also provide a mechanism by which the TIOR materials are transported within a medium of polar aromatic oil. The drag stream can be sent via conduit 390 through conduit 392 and into conduit 370 to reach the external processing units, 604, where the stream can be utilized to enhance the conversion of the previously mentioned external processing units.

The conduit 312 can communicate with the contents of a conduit 316 that can conduct its contents to a feed heater 35B, which are heated and conducted by a conduit 320 to enter the first unit 30A. The conduit 316 can also communicate with a conduit 371 that conducts its contents to communicate with the primary feedstock in the conduit 300.

Other differences between the system 700 and the system 702 include that in the system 702: the contents of the conduit 350 can be communicated with the contents of the conduit 316; the contents of conduit 394 can be communicated with the contents of the conduit 312; and, the contents of the conduit 364 can be communicated with the primary feedstock within the conduit 300.

In some implementations of the present disclosure, the system 702 does not include the heater 35D but at least some of the contents of the conduit 350 can be conducted to a gas heater 35A by a conduit 324 and then the heated contents can be conducted into the second unit 30B.

In some implementations of the present disclosure, the system 702 does not include the heater 35E but at least some of the contents of the conduit 350 can be conducted to a conduit 322 by conduits 324 and 327 and then conducted into the second unit 30B.

In some implementations of the present disclosure, the conduit 384 can communicate intermediate hydrogen-content materials into the first unit 30A.

In some implementations of the present disclosure, the conduit 382 can communicate the higher hydrogen-content materials into the first unit 30A. The conduit 382 can provide higher hydrogen-content hydrocarbons into the system 702 as either liquids or vapours.

The conduit 394 can provide higher hydrogen-content hydrocarbons into the system 702. The higher hydrogen-content hydrocarbons will be injected into the first unit 30A through the 902. The contents of the conduit 394 can be one or more of the same constituents of the higher hydrogen-content materials within the conduit 382.

In some implementations of the present disclosure, a conduit 386 can communicate higher hydrogen-content materials with the contents of the conduit 304.

In some implementations of the present disclosure, a conduit 386 can communicate distillates and lower boiling liquids materials with the contents of the conduit 304 for the purpose quenching the 30A outlet temperature.

Without being bound by any particular theory, some of the advantages of the system 702 include: the operating parameters in the first unit 30A can be modulated to employ higher amounts of TIOR materials and lower hydrogen purity heavy aromatics in order to enhance the liquid yield resulting from elevated direct incorporation of higher hydrogen-content feeds into the reactor feedstock; the second unit 30B can be operated with a vapor gap at the top, which can eliminate the need for a vacuum unit, facilitating the separation of ash from the reactor liquid as well as generating a high quality donor solvent containing an optimized Ash that can be integrated with one or more of the satellite processing units 604, 608.

As will be appreciated by those skilled in the art, the upgrading and processing that occurs in reaction unit 24 can use one or more difficult to process heavy-oils as a feedstock.

In some implementations of the present disclosure, the reaction unit 24 can receive a difficult to process heavy-oil feedstock from more than one source. For example, some implementations of the present disclosure can process a difficult to process heavy-oil feedstock from a primary upgrading facility, such as a coker-fractionator unit and one or more satellite upgrading facilities, such as a further a coker-fractionator unit, a visbreaker unit and/or a hydro-visbreaker unit. These implementations can improve the economics and decrease the greenhouse gas production of the primary upgrading facility and the satellite upgrading facilities.

Furthermore, one or more products of system 700 or system 702—such as the contents of either or both of conduit 370 and conduit 396, as discussed herein below—can be can be communicated with conduit 116A, which provides the product of the distillation system 101 to the heater 20. For example, the contents of conduit 370 can provide a high TIOR and/or Ash material to be coked, or gasoil boiling range polar aromatic donor stream containing excess Ash to be removed by coking within the coke drum 21. The Ash gets coked and the aromatic oil donor-solvent can reduce the coker unit 200 coke yield by hydrogen donation. The thermally processed donor solvent can also flash back into the coker-fractionator unit 200A to be recycled to either or both of the units 30A, 30B with low hydrogen-content coker fractionator bottom products or yielded as the 221 products and hydrotreated in a downstream coker hydrotreater.

In some implementations of the present disclosure, either or both of conduit 222 and conduit 224 can be routed to communicate with one or both of conduits 382, 386.

The contents of conduit 226 and conduit 228 can be excellent sources of polar aromatics and in some implementations of the present disclosure these conduits 226, 228 can be routed to communicate with the contents of conduit 300 or the contents thereof can be used as a carrier for additive make-up in the vessel 38.

In some implementations of the present disclosure, the additive can be directly added to liquid in the bottom of fractionator 22, thereby eliminating the need for vessel 38.

In some implementations of the present disclosure, part or all of the contents of conduits 360, 370 and 396 can be charged to fractionator 22 such that some or all products from the system 700 or the system 702 can be recovered at the coker fractionator with the coker products.

The fractionator unit 200A can also provide a source of a low-asphaltene solvent for co-processing difficult to process heavy-oil feedstock in either or both of system 700 or system 702. If additive is added to the coker fractionator, the additive will act to reduce coking in the fractionator bottoms.

Other Thermal Processors

Figure 5A:
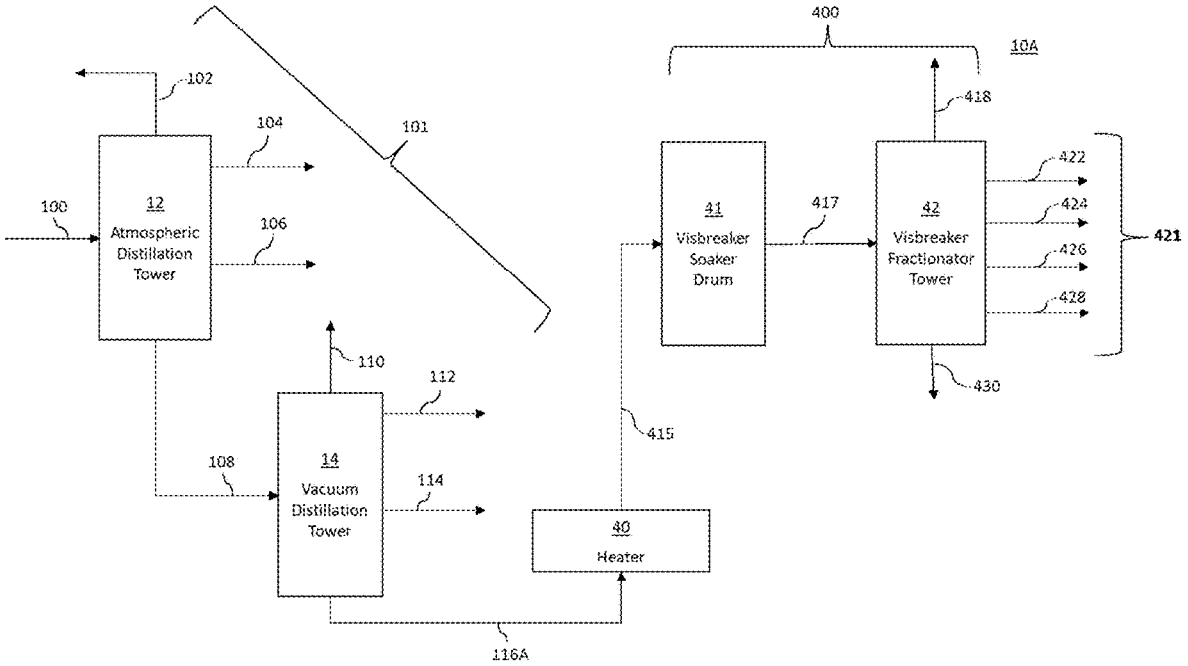
FIG. 5A Prior Art
FIG. 5A shows a conventional visbreaker flow scheme; and, FIG. 5B shows a visbreaker system according to implementations of the present disclosure.

FIG. 5A shows one example of portions of another thermal processor that is a heavy oil upgrading system 10A that includes the low temperature distillation system 100 and a visbreaker unit 400. The contents of the conduit 116A can be conducted to a visbreaker heater 40 and the heated visbreaker feedstock can be conducted by a conduit 415 to a visbreaker soaker drum 41. A conduit 417 conducts the soaker drum product to a visbreaker fractionator tower 42 for boiling-point separation into further vapor products that are conducted away from the visbreaker fractionator tower 42 by conduits 421. For example, the further vapor products includes light visbreaker naphtha (within a conduit 422), heavy visbreaker naphtha (within a conduit 424), visbreaker kerosene (within a conduit 426) and visbreaker gas oil (within a conduit 428). A conduit 430 conducts a visbreaker fractionator tower bottoms for further processing into a low value product.

Figure 5B:
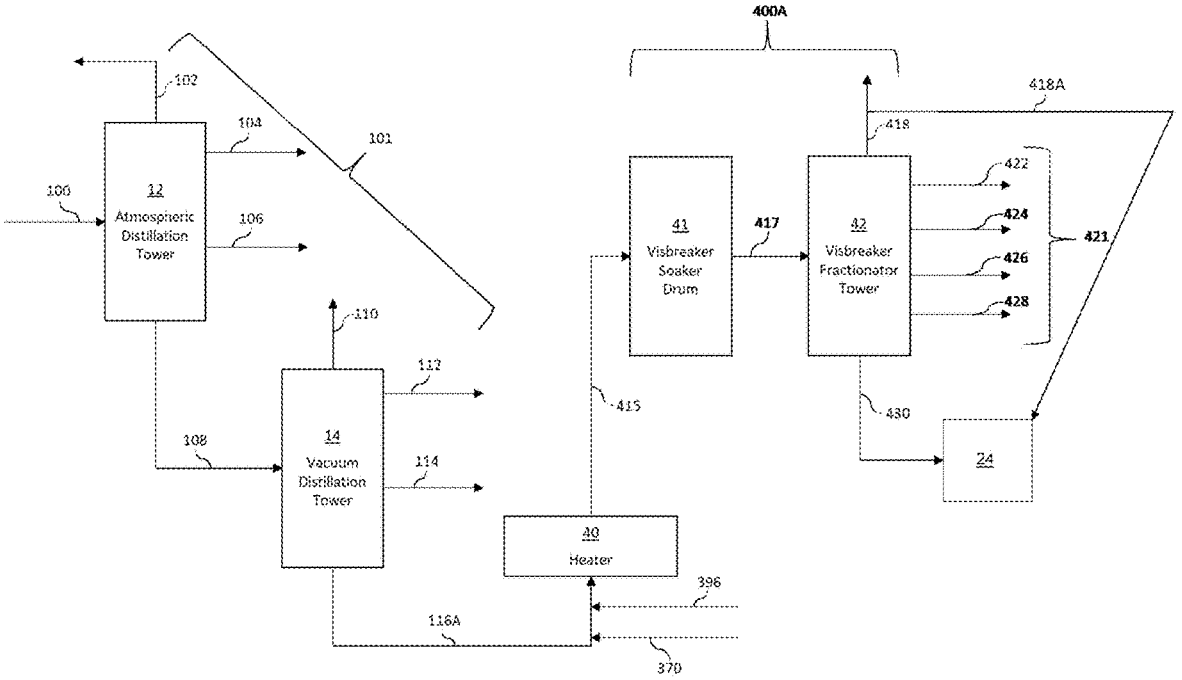

FIG. 5B shows another thermal processor that is a visbreaker unit 400A according to implementations of the present disclosure. The visbreaker unit 400A is similar or the same as the visbreaker unit 400 described above, with at least the following differences. The conduit 116A of the visbreaker unit 400A can receive the contents of the conduit 370 and/or the conduit 396. The visbreaker fractionator tower bottoms can be conducted by the conduit 430 to communicate with the reaction unit 24, as described herein above. In some implementations of the present disclosure, a conduit 418A can conduct a light hydrocarbon feedstock from the visbreaker fractionator tower 42 to also communicate with the reaction unit 24 for direct incorporation of the light hydrocarbon feedstock into the visbreaker fractionator tower bottoms for making ITP products.

Stream 422 and 424 can be routed to one or all of conduits 382, 386.

Stream 426 and 428 are excellent sources of polar aromatics and can be routed to 300 and/or used as a carrier for additive make-up in vessel 38.

In some implementations of the present disclosure, additive may be directly added to liquid in the bottom of fractionator 42, thereby eliminating the need for vessel 38.

In some implementations of the present disclosure, part or all of the contents of conduits 370 and 396 can be charged to fractionator 42 such that the ITP products can be recovered at the visbreaker fractionator with the visbreaker products.

Without being bound by any particular theory, the visbreaker unit 400A may provide the benefits of: directing the visbreaker fractionator tower bottoms for processing by one or both of the systems 700, 702 instead of processing into a low value product; protecting downstream fixed-bed catalysts; increasing visbreaker yields by providing substantially higher conversion, potentially in excess of 70% 975+ F conversion due to the supply of hydrogen—and anticoking ash from loops 600 or 612.

Figure 6A:
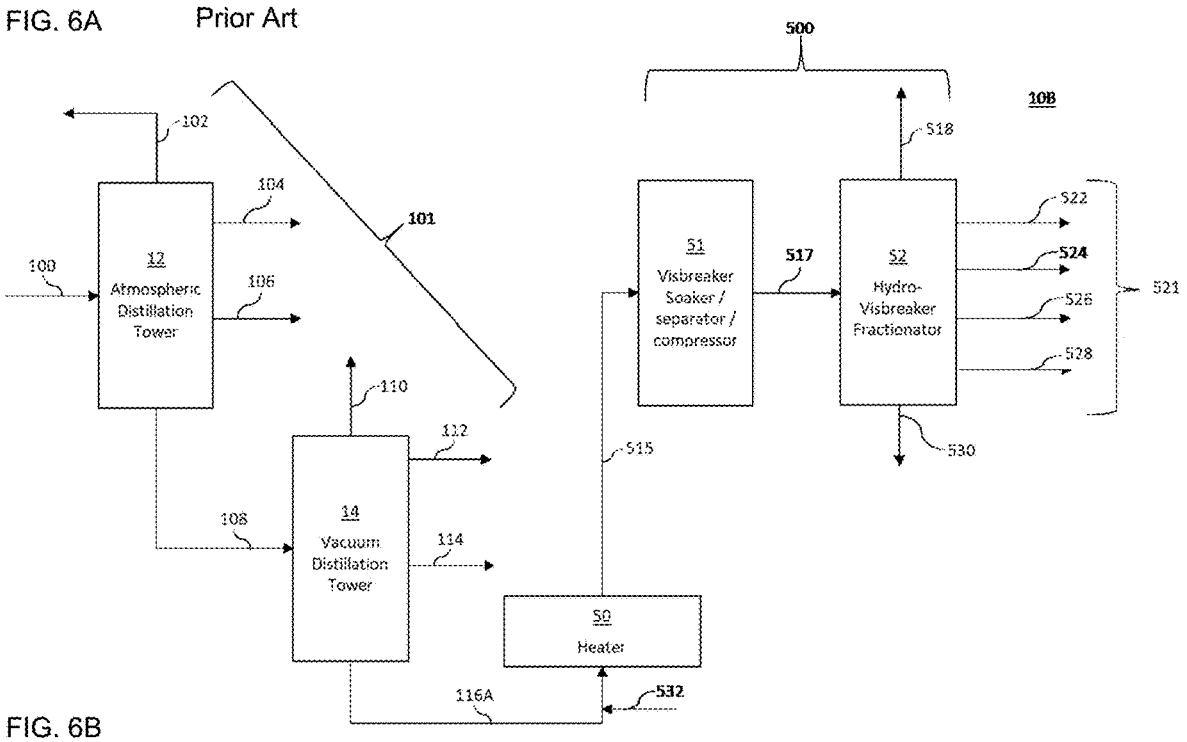
FIG. 6A Prior Art
FIG. 6A shows a conventional hydro-visbreaker system; and, FIG. 6B shows a hydro-visbreaker system according to implementations of the present disclosure.

FIG. 6A shows one example of portions of another thermal processor that is a heavy oil upgrading system 10B that includes the low temperature distillation system 100 and a hydro-visbreaker unit 500. The contents of the conduit 116A, including hydrogen addition via conduit 532, can be conducted to a hydro-visbreaker heater 50 and the heated hydro-visbreaker feedstock can be conducted by a conduit 515 to a hydro-visbreaker soaker drum, a gas-liquid separator and recycle gas compressor 51. A conduit 517 conducts the soaker drum product to a hydro-visbreaker fractionator tower 52 for boiling-point separation into further liquid products that are conducted away from the hydro-visbreaker fractionator tower 52 by conduits 521. For example, the further liquid products includes light hydro-visbreaker naphtha (within a conduit 522), heavy hydro-visbreaker naphtha (within a conduit 524), hydro-visbreaker kerosene (within a conduit 526) and hydro-visbreaker gas oil (within a conduit 528).

Figure 6B:
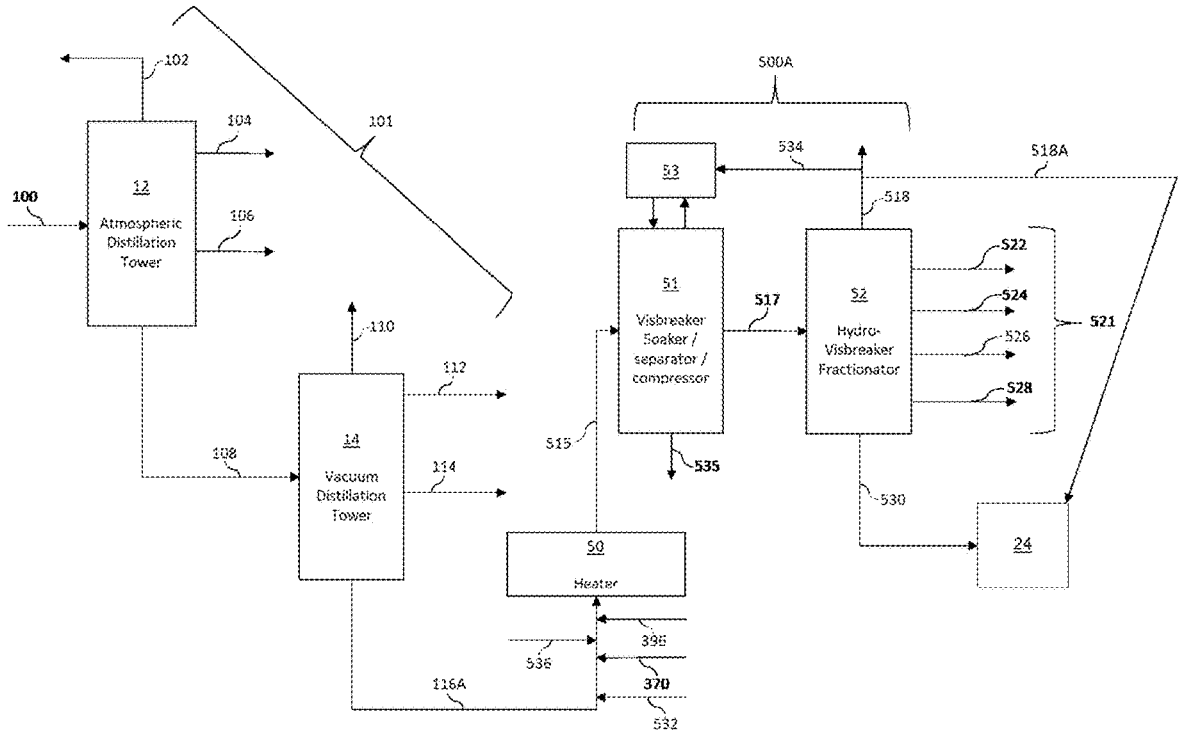

FIG. 6B shows another thermal processor that is a hydro-visbreaker unit 500A according to implementations of the present disclosure. The hydro-visbreaker unit 500A is similar or the same as the hydro-visbreaker unit 500 described above, with at least the following differences. The conduit 116A of the hydro-visbreaker unit 500A can receive the contents of the conduit 370 and/or the conduit 396 and/or a conduit 536 that contains water. The hydro-visbreaker fractionator tower bottoms can be conducted by the conduit 530 to communicate with the reaction unit 24, as described herein above. In some implementations of the present disclosure, a conduit 518A can conduct a light hydrocarbon feedstock from the hydro-visbreaker fractionator tower 52 to also communicate with the reaction unit 24 for direct incorporation of the light hydrocarbon feedstock into the hydro-visbreaker fractionator tower bottoms for making ITP products.

In some implementations of the present disclosure, the hydro-visbreaker unit 500A can include heater 53 for heating gas provided by conduit 534, for conducting at least a portion of the contents of the conduit 518, and the recycle gas within hydrovisbreaker soaker drum and separator system 51.

Conduit 522 and conduit 524 can be routed to communicate with the contents of one or both of conduits 382, 386.

The contents of conduit 526 and conduit 528 can be excellent sources of polar aromatics and can be routed to communicate with the contents of conduit 300 and/or used as a carrier for additive make-up in vessel 38.

In some implementations of the present disclosure, additive may be directly added to liquid in the bottom of fractionator 52, thereby eliminating the need for vessel 38.

In some implementations of the present disclosure, part or all of the contents of conduits 360, 370 and 396 can be charged to fractionator 52 such that the ITP products can be recovered at the visbreaker fractionator with the visbreaker products.

In some implementations of the present disclosure, the hydro-visbreaker unit 500A can also include a conduit 535 for conducting a purge of TIOR materials and/or Ash from the hydro-visbreaker soaking drum 51. This stream may be routed to conduit 300 and/or to be coked in a coker.

Without being bound by any particular theory, the hydro-visbreaker unit 500A may provide the benefits of: directing the hydro-visbreaker fractionator tower bottoms for processing by one or both of the systems 700, 702 instead of processing into a low value product; protection of downstream fixed-bed catalysts; an increased hydro Visbreaker yield improvement due to a substantially higher conversion potentially in range of 80% 975+ F conversion that is caused by the loops 600, 602 and the use of the anti-coking additives in either of the systems 700, 702; recycling the roughly 5-6 wt % gas yield generated by thermal conversion within conduit 518 through gas contacting loop with the heater 53 that can increase the temperatures of the gas to greater than 1000° F.; and, return of TIOR materials and/or Ash to one or both of systems 700, 702 for TIOR conversion, additive recycle and regeneration and aromatic oil donor-solvent recycle and regeneration. In some implementations of the present disclosure, the hydro-visbreaker unit 500A can provide a source of high-density, highly complex aromatic rings compound that efficiently convert from gas to liquid in either of the systems 700, 702. With the capabilities of systems 700, 702 to convert the contents of conduits 530 and 535, the hydrovisbreaker reaction system 51 can be designed with features of the reactor unit 30 and operated at pressures of less than 1000 psig.

In some implementations of the present disclosure, each of the upgrading systems 10, 10A and 10B can produce various gases and naphtha streams that can be conducted to either or both of the systems 700, 702 where the naphtha can be used as a diluent that can then be flash separated from one or more valuable products.

Upgrading Process

Figure 7A:
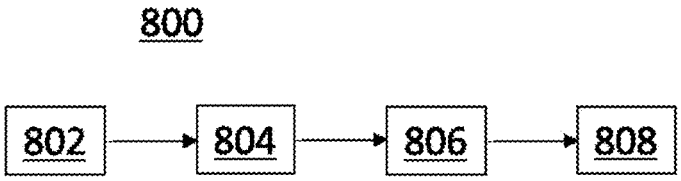
FIG. 7A shows one implementation of a process according to the present disclosure; and, FIG. 7B shows another implementation of a process according to the present disclosure.

Some implementations of the present disclosure relate to a process 800 for upgrading difficult to process heavy-oil feedstocks that is performed by either of the systems 700, 702 described above. FIG. 7 shows a logic schematic that includes steps of the process 800. The process 800 includes, but is not limited to: a step 802 of conducting a difficult to process heavy-oil feedstock to a reactor unit, for example one or more of an SHC unit, reactor units 30, 30A or 30B. The process 800 includes a step 804 of conducting a light hydrocarbon feedstock that has a high hydrogen-content, such as a rich fuel gas, into the reactor unit either through a recycle gas heater or not. The process 800 also includes a step 806 of directly incorporating the light hydrocarbon feedstock with high hydrogen content into the difficult to process heavy-oil feedstock for producing one or more ITP products that have an increase in volume thereof, as compared to if there was no direct incorporation of the light hydrocarbon feedstock with a high hydrogen-content. The increased volume of the ITP products can be caused by various reactions—as but one example alkylation reactions—that result in the direct incorporation of the light hydrocarbon feedstock with high hydrogen content into the difficult to process heavy-oil feedstock and a mass transfer of carbon atoms and hydrogen atoms from the light hydrocarbon feedstock with high hydrogen content into the ITP products. The process 800 also includes a step 808 of collecting and separating the ITP products into the valuable constituent products. For example, step 808 can separate the ITP products by the respective boiling points by methods such as distillation, fractionation or other separation processes.

Some implementations of the present disclosure relate to a process 800A that includes subjecting the difficult to process heavy-oil feedstock to a first step 812 of an ITP cracking process within an ITP reactor unit and then to a second step 814 of the ITP cracking process within a second ITP reactor unit. Each of the first step 812 and the second step 814 of the ITP cracking process will utilize a partial pressure of hydrogen that can be the same or that can be different between the steps. For example, the first step 812 of the ITP cracking can have a lower partial pressure of hydrogen than the second step 814.

Figure 7B:
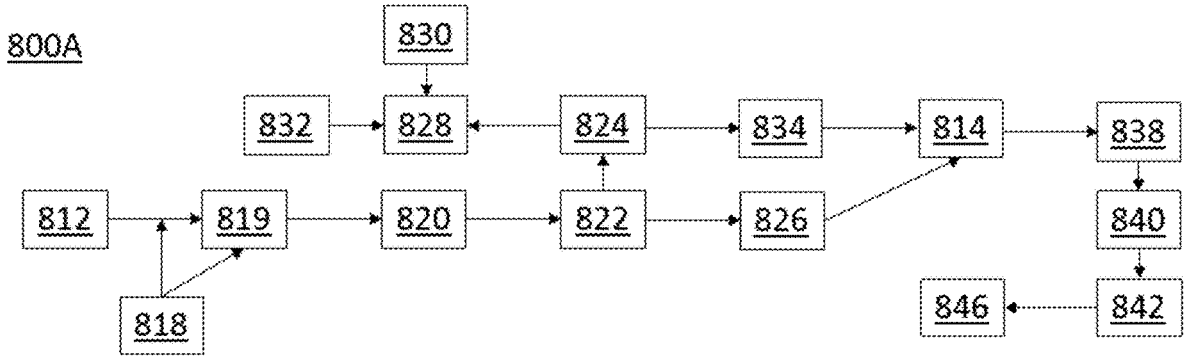

As shown in FIG. 7B, the first step 812 of ITP cracking can include a step of conducting a heavy oil feedstock to a first ITP reactor unit. The process 800A includes a step 818 of conducting a light hydrocarbon feedstock with high hydrogen content either upstream of a first ITP reactor unit, directly into the first ITP reactor unit or both. The process 800A also includes a step 819 of generating ITP cracking products within the first ITP reactor unit and a step 820 of directly incorporating at least a portion of the light hydrocarbon feedstock into the ITP cracking products within the first ITP reactor unit so that there is an increase in volume thereof, as compared to if there was no direct incorporation. The increased volume of the ITP cracking products can be caused by one or more different types of reactions that result in a mass transfer of carbon atoms and hydrogen atoms from the light hydrocarbon feedstock with high hydrogen content into the ITP cracking products. The process 800A also includes a step 822 of collecting and separating a mixed effluent product from the first ITP reactor unit into a vapor stream and a liquid stream. The vapor stream is subjected to a step of separating into a hydrogen-rich vapor stream and a hydrocarbon-rich liquid stream. The hydrogen-rich vapor stream is subjected to a step 824 of being conducted to a step 828 of recycling back to the first ITP reactor unit. The step 828 can include a step of heating 830 and/or a step 832 of directly incorporating at least a portion of the light hydrocarbon feedstock. The hydrocarbon-rich vapor stream also can be subjected to a step 834 of conducting downstream of a second ITP reactor unit within the second step 814. The liquid stream is subjected to a step 826 of conducting into the second step 814 of ITP cracking.

The second step 814 includes a step of conducting the liquid stream from the first step 812 into the second ITP reactor unit for a step 838 of generating further ITP cracking products within the second ITP reactor unit. As will be appreciated by one skilled in the art, many of the steps described for the first step 812 can also occur during the second step 814, including but not limited to the direct incorporation of light hydrocarbon feedstocks with high hydrogen content into the liquid stream that enters into the second ITP reactor for producing the further ITP products that have a volumetric gain, as compared to if there was no direct incorporation step. The further ITP products are then subjected to a step 840 of conducting towards a separation step 842 for separating a mixed effluent product from the second ITP reactor unit into a vapor stream and a liquid stream. The liquid stream can be subjected to a step 846 of conducting to a vacuum process and/or to the first reactor unit and/or the second reactor unit. Optionally, the hydrocarbon-rich vapor stream can be communicated with the mixed effluent product from the second reactor unit and/or the vapor stream from the separation step 842. The vapor stream from the separation step 822 is subjected to a step of removing impurities such as nitrogen and/or sulfur and the purified vapor stream can be subjected to a step of further separating into a hydrogen-rich vapor stream (which can be conducted upstream of the first reactor unit or not) and a hydrocarbon-rich vapor stream that includes the ITP products. This hydrocarbon-rich vapor stream can be subjected to a step for separating the ITP products into the various valuable constituent products.

The second step 814 can also include a step of introducing a gas stream with a higher partial pressure of hydrogen into the vapor stream from the separation step 822 prior to the step of removing impurities.

In some implementations of the present disclosure, an example of the volumetric gain achieved by using the fractionator tower bottoms as the heavy oil feedstock and using rich fuel gases as the low molecular-weight hydrogen feedstock with a medium and/or high hydrogen-content within an ITP reactor unit can be characterized as follows: when about 24 thousand barrels per day (kbpd) of heavy oil feedstock and about 21 kbpd of bitumen are conducted into the ITP reactor unit, through direct incorporation of the rich fuel gases (or other moderate and/or high hydrogen-content materials), there can be a total volumetric output of ITP cracking products of about 60 kbpd. This is about a 33% volumetric increase due to the direct incorporation of the rich fuel gases (or other C1 to C5 alkanes).

EXAMPLES

Figure 8A:
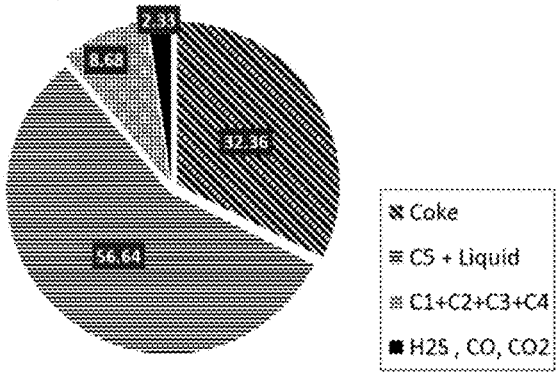
FIG. 8A shows coker product yields by mass distribution.
Figure 8B:
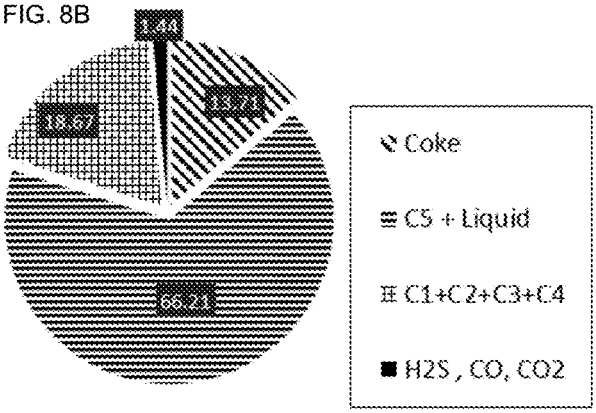
FIG. 8B shows the distribution of the feed hydrogen to the various coker products.
Figure 8C:
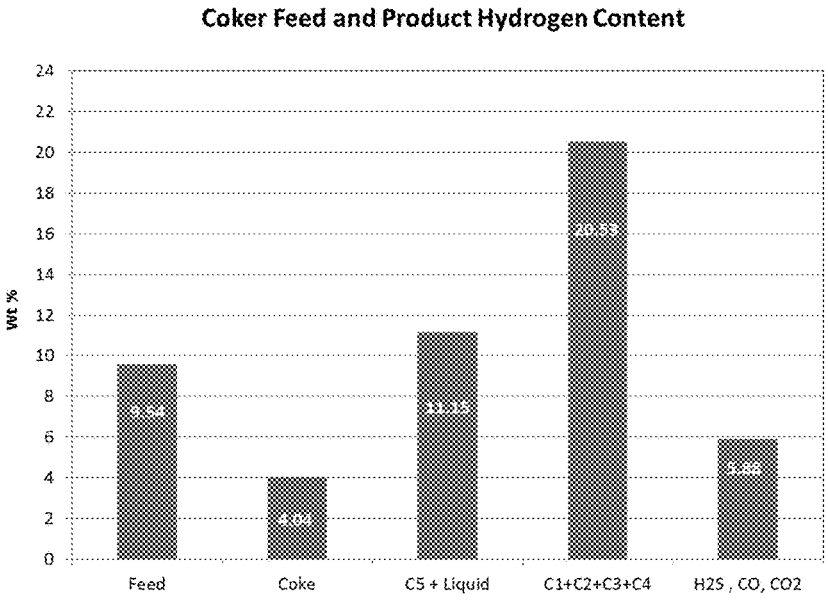
FIG. 8C shows the hydrogen content of the coker products.

FIG. 8A shows the relative contribution (on a weight percent) of the constituents coker 200*s* products derived from the vacuum tower bottoms when the source of heavy oil is Athabasca bitumen VTB. These constituents include coke, C5 alkanes and liquids, C1 to C4 and $H_2S$, CO and $CO_2$. FIG. 8B shows the relative distribution of coker feedstock hydrogen within the same constituents of the bitumen-derived vacuum tower bottoms. FIG. 8C shows the wt % of hydrogen contained in each of the coker product groupings identified in FIG. 8A. The coker feed in this example contains 9.54% hydrogen content. Thermal cracking of the feedstock is very efficient in removing hydrogen from the coke with the coke containing only 4.04 wt % hydrogen. The C1-C4 light hydrocarbon products contain the highest amount of hydrogen at 20.53 wt %. Conduit 218 contains a very high hydrogen-content stream that is often fueled or flared.

Data sets obtained during the upgrading of four different heavy oil feedstocks were analyzed and modelled for generating the data presented in the figures and for supporting the implementations of the present disclosure. For example, the data supports direct incorporation of low molecular-weight hydrocarbons into thermally processed, difficult to process heavy oils by a mass transfer of carbon and hydrogen atoms into valuable liquid products. One feedstock data set was obtained from a virgin, high sulfur asphaltic vacuum tower bottoms feedstock that was subjected to a pilot plant, slurry-phase hydrocracking unit that used a coal based anti-coking additive (pilot plant). A second feedstock data set was obtained from a virgin, high sulfur asphaltic vacuum tower bottoms feedstock (Asphalt VTB) that was subjected to a commercial slurry-phase hydrocracking unit that used an iron sulfide (FeS) additive system but did not include a gas-contacting system that provided the high mixing environment (the base commercial-operation or unit base). A third feedstock data set was obtained from (Asphalt VTB) but that was subjected to a commercial slurry-phase hydrocracking unit that used a FeS additive system and the gas-contacting system provided a high-mixing environment with a 73% partial pressure of hydrogen gas in the recycle including C1 through C6 low molecular weight components in the unit make-up gas (the modified commercial-operation or modified unit). A fourth feedstock data set was obtained from visbreaker bottoms of the Asphalt VTB (Visbreaker Bottoms Feed) that was subjected to the modified commercial-operation.

Figure 9:
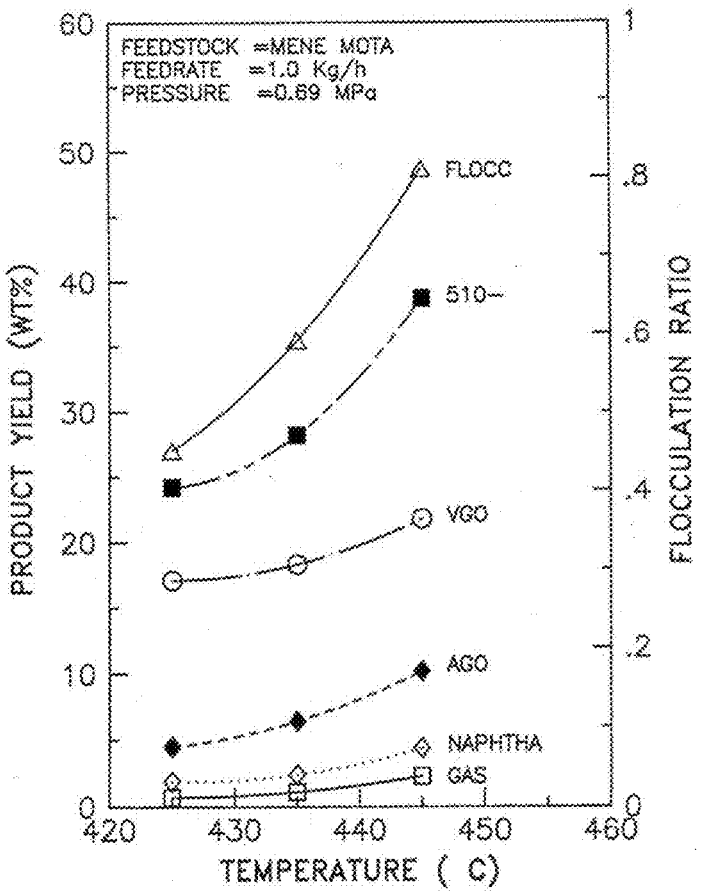
FIG. 9 shows an example of data that relates to visbreaker yields.

FIG. 9 shows the typical yield-profile for a visbreaker processing VTB produced from an asphaltic crude. FIG. 9 shows that as the temperature is increased from 797° F. to 833° F. (about 425° C.-445° C.), the yield of 950+ F (shown as filled squares) increased from about 25 wt % to about 40 wt % of the feed processed. However, the temperature that this unit can be operated at is limited by the thermal instability of the unconverted liquid. This instability or sediment level is generally measured by a flocculation ratio test with a maximum value of about 0.8 being a typical limit for the technology. Therefore, the conversion for this example of a visbreaking process would be limited at about 40 wt % of the feedstock. The products from this thermal-cracking process were highly olefinic and the unconverted liquid was very hydrogen-deficient because the hydrogen was redistributed to higher hydrogen-content lighter products, including gas and naphtha.

FIG. 10A through FIG. 10G show the yields for a delayed coking-process. These yields were based on Athabasca bitumen VTB. These figures show the change in yields from the coker as a function of the coke-drum pressure and coker furnace-outlet temperature. The normal (base) furnace outlet temperature for this process was about 925° F., which is about 100° F. higher than the temperature applied in the visbreaker operation described above. At these elevated temperatures, a portion of the unconverted heavy feed was converted into solid coke and the unstable heavy liquid was eliminated. Without being bound by any particular theory, this process can be the basis of a cyclic and sustainable commercial operation.

Figure 10A:
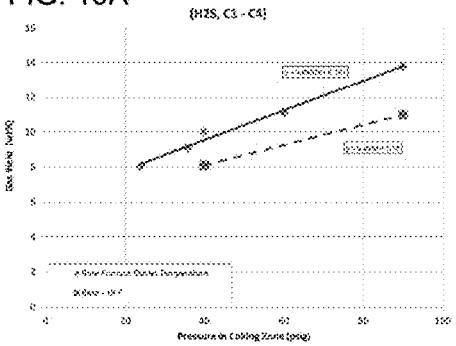
FIG. 10A shows gas ($H_2S$ and C1 through C4) yield data.
Figure 10B:
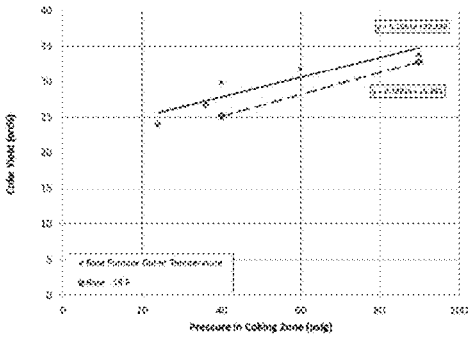
FIG. 10B shows coke yield.
Figure 10C:
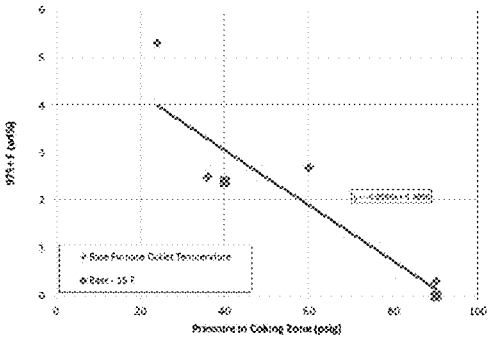
FIG. 10C shows 975+ F liquid yield data.

FIG. 10A through FIG. 10G show the yields associated with the delayed-coking process, which can be considered a carbon-rejection methodology for upgrading heavy oil. These yields are expressed based upon a once-through routing of the feed through the coke drum and without considering the impact of recycling unconverted material back through the process. FIG. 10A and FIG. 10B show the amount of gas and coke yielded respectively at two different furnace outlet temperatures. The quantity of coke and gas generated increased with the operating pressure of the unit (indicated as Pressure in Coking Zone in pounds per square inch gauge (psig) in FIG. 10) at the expense of the liquid yield. At the elevated thermal severity utilized in a delayed-coking process (about 925° F.), the amount of gas made for a coke drum operating at about 40 psig was about five times that of a visbreaker operating at about 830° F. In addition, as shown in FIG. 10C, the yield of 975+ F liquid leaving the coke drum increased as the coke-drum pressure was reduced. The endpoint of the yielded coker gasoil was limited by downstream gasoil-hydrotreater endpoint-specifications so that any higher boiling-range material that left the coke drum had to be recycled through the coker furnace and then to the coke drum so that this remaining material could then be coked. This recycling required several passes through the unit to coke the majority of the 975+ F recycled liquid to achieve the gasoil hydrotreater feed endpoint-specifications. The amount of recycling required varied as a result of coker drum pressure.

Figure 10D:
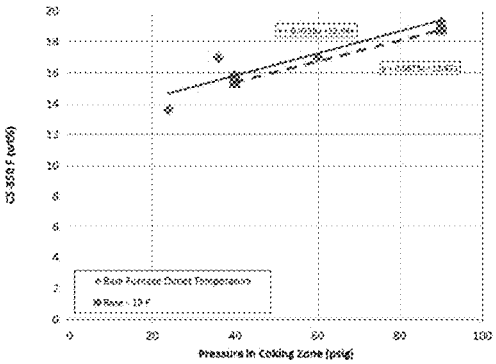
FIG. 10D shows naphtha yield data.
Figure 10E:
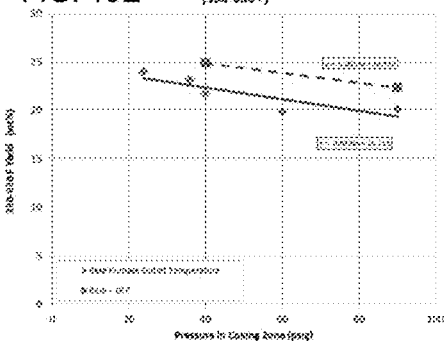
FIG. 10E shows distillate yield data.
Figure 10F:
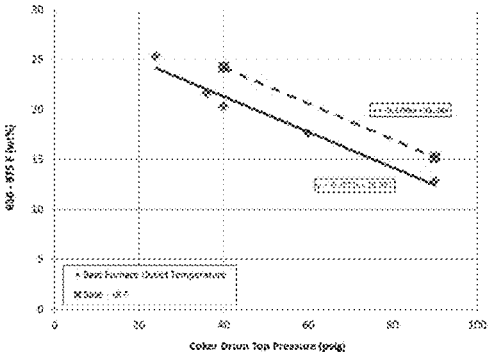
FIG. 10F shows gasoil yield data; and, FIG. 10G shows total liquid yield data.

FIG. 10D shows the yield of naphtha (C5-350° F.), FIG. 10E shows the yield of distillate (350° F.-650° F.) and FIG. 10F shows the yield of coker gasoil (650° F.-975° F.).

Figure 10G:
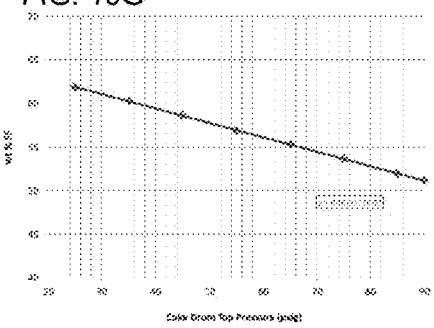

FIG. 10G shows that the first pass liquid yields decreased from about 61.9 wt % to about 51.2 wt %, based on fresh feed, as the coker drum pressure increased from about 25 psig to about 90 psig. Each incremental increase of coke drum pressure by 1 psig reduced the liquid yield by about 0.17 wt %, based on the feed charge. Approximately 35% of this liquid loss was due to a reduced amount of 975+ F liquid leaving the coke drum, which reduced the coker fractionator recycle rate required to achieve the target gasoil hydrotreater feed endpoint-specifications. In order to achieve the gasoil-hydrotreater feed endpoint-specifications, the desire to operate the process at lower pressures in order to maximize liquid yield is at odds with the requirement to increase the recycle stream through the unit. Without being bound by any particular theory, if the coker fractionator bottom cut point could be decoupled from the gasoil endpoint, then the coker unit liquid yields and the unit energy efficiency could be improved.

One alternative to the carbon rejection processes described above and the associated loss of liquid yield is hydrogen addition. FIG. 11A through FIG. 12D show data obtained by thermal cracking of Athabasca bitumen in a closed pilot-plant system. The pilot work was done to show the potential use of a simulated syn-gas in place of hydrogen for the upgrading of heavy oil. This data showed the impact of hydrogen partial-pressure, the use of a coal—iron sulphide (FeS) based anti-coking hydrogen-transfer additive (anti-coking additive A), and the addition of water to this closed pilot-plant system. The reaction in this closed pilot-plant system resulted in about 18 wt % deposition of solids in the pilot-plant system's equipment and, therefore, the process was not sustainable as a commercial process.

Figure 11A:
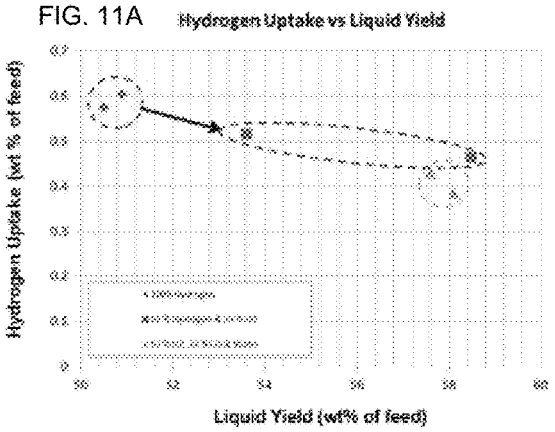
FIG. 11A shows hydrogen uptake versus liquid yield data.
Figure 11B:
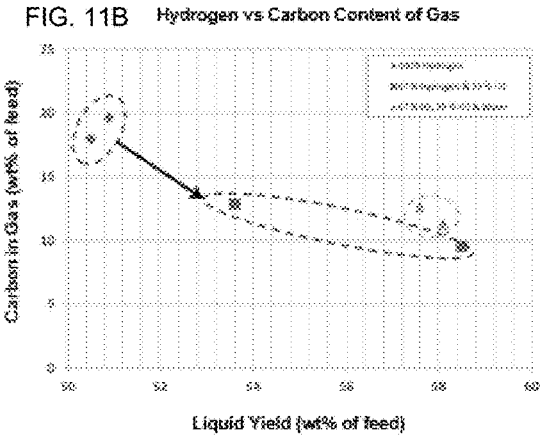
FIG. 11B shows wt % of feed carbon yielded as gas versus liquid yield data.
Figure 11C:
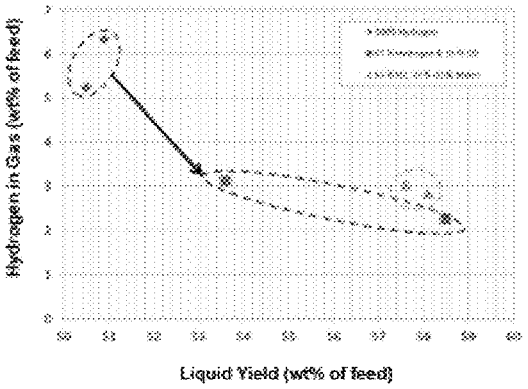
FIG. 11C shows wt % of feed hydrogen yielded in gas versus liquid yield data.
Figure 11D:
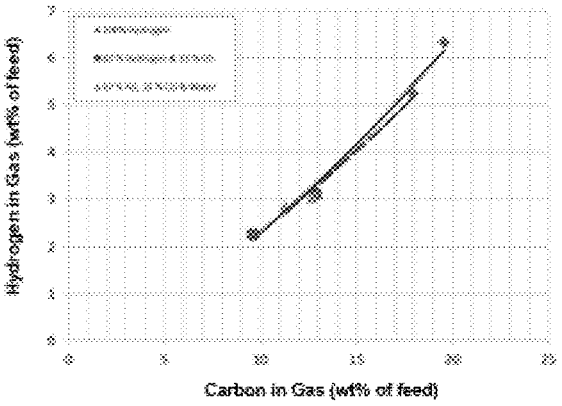
FIG. 11D shows the relationship between the wt % of feed hydrogen and carbon yielded in the gas; and, FIG. 11E shows pentane insoluble asphaltene yield in the reactor deposits versus feedstock conversion data.

FIG. 11A through FIG. 11C show that increasing the hydrogen partial-pressure in the closed pilot-plant system by about 33% reduced the liquid yield by about 7.5 wt % of the charge. While the hydrogen addition to the Athabasca bitumen is increased at a higher hydrogen purity and partial pressure, FIGS. 11B and 11C show that the elevated hydrogen transfer to the bitumen resulted in substantially increased amounts of carbon and hydrogen being yielded as gas. FIG. 11D shows that the hydrogen content relative to the carbon content in the gas is similar with or without the use of the low hydrogen transfer, anti-coking additive A.

Figure 11E:
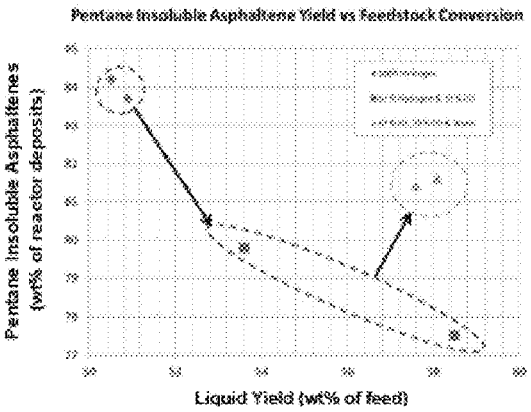
Figure 12A:
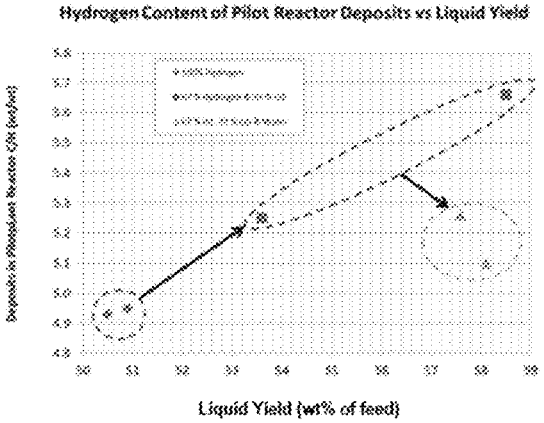
FIG. 12A shows hydrogen content of reactor deposits versus liquid yield data.

FIG. 11E and FIG. 12A show that the quality of the deposits in the reaction vessel was more hydrogen deficient when the unit operated at elevated hydrogen partial pressures (see diamond shaped data-points in FIG. 12A). The pentane insoluble asphaltene content in the reactor deposits were reduced from about 84 wt % to about 77 wt % as the liquid yield was increased by about 7.5 wt % due to the lower hydrogen partial-pressure set-up. Consistent with the decrease in pentane insoluble asphaltenes, the hydrogen content of the reactor deposits increased from about 4.95 to about 5.65 wt %.

Figure 12B:
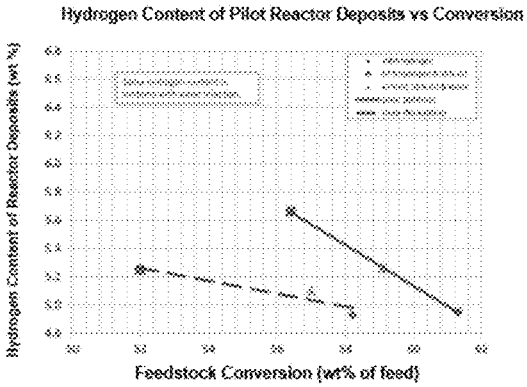
FIG. 12B shows hydrogen content of reactor deposits versus conversion data.
Figure 12C:
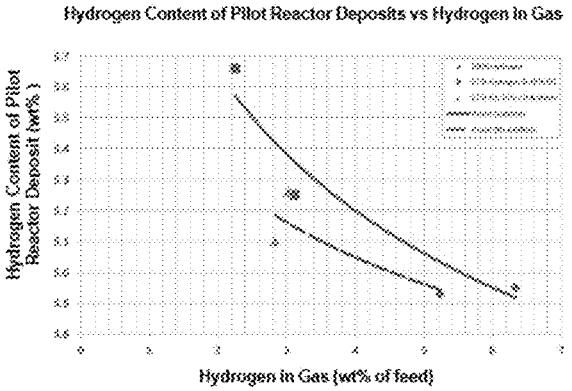
FIG. 12C shows hydrogen content of reactor deposits versus wt % of feed hydrogen yielded in the product gas data; and, FIG. 12D shows hydrogen content of liquids versus liquid yield data.

FIG. 12B shows that the hydrogen content of the reactor deposits was elevated with the use of the anti-coking additive A for all hydrogen partial-pressure conditions including the co-processing of water. FIG. 12C shows that the loss of hydrogen retention in the unconverted feed was associated with an increase in hydrogen yielded in the gas. At any given hydrogen content in the unconverted reactor contents, the use of the anti-coking additive A resulted in less hydrogen being transferred to the gas yield.

Figure 12D:
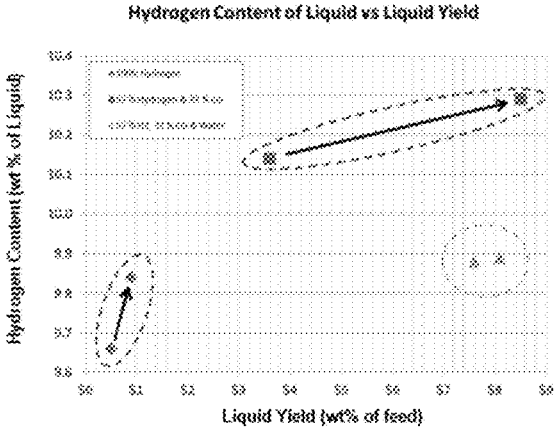

The hydrogen content of the reactor liquids shows the same increase in hydrogen content with decreased hydrogen partial-pressure and the use of the anti-coking additive A, as observed in the reactor deposits. FIG. 12D shows that the higher hydrogen partial-pressure operation decreased the hydrogen content of the reactor liquid products from about 10.14 wt % to about 9.66 wt %. The use of the anti-coking additive A increased the hydrogen content of the reactor liquid by about 0.18 and about 0.15 wt % for the 100% and 67% hydrogen partial-pressure tests respectively.

Without being bound by any particular theory, this pilot-plant data can indicate that higher hydrogen partial-pressure stabilized the cracked material within the light gases. At higher hydrogen partial-pressures, the hydrogen content of both the liquid products and reactor solids was lower than that achieved at lower hydrogen partial-pressures. The potential convertibility of the unconverted feed was decreased at higher hydrogen partial-pressures. The higher hydrogen partial-pressure environment resulted in a lower liquid yield of about 7.7 wt % of feed for the anti-coking additive A testing. The use of the anti-coking additive A improved the convertibility of the unconverted feedstock in all operations.

Superimposing the addition of hydrogen from water in the reaction mix resulted in intermediate levels of hydrogen in the liquid and reactor deposit products relative to the two hydrogen partial-pressure references discussed above. The hydrogen uptake from the gas charged to the closed pilot-plant system was reduced by about 0.1 wt %, based on the total gas charge, as shown on FIG. 11A, while both the hydrogen and carbon yielded in the C1-C5 light gases was increased at a constant ratio as shown on FIG. 11B, FIG. 11C and FIG. 11D. The lower hydrogen content of the reactor liquid and solids resulting from the addition of water indicated that the water behaved in a similar manner as increasing the hydrogen partial-pressure of the system. The C1-C5 carbon structures were stabilized at the expense of adding hydrogen to the liquid. However, the liquid yield remained relatively high and the carbon dioxide ($CO_2$) content of the gas did not increase to account for the oxygen from the water, which can indicate that the oxygen from the water largely went to the liquid products.

The syn-gas pilot-plant work showed that increasing hydrogen partial-pressure in a closed, long residence-time environment resulted in a substantial loss of liquid yield and more hydrogen consumption due to the stabilization of carbon and hydrogen within the light gases.

Figure 13:
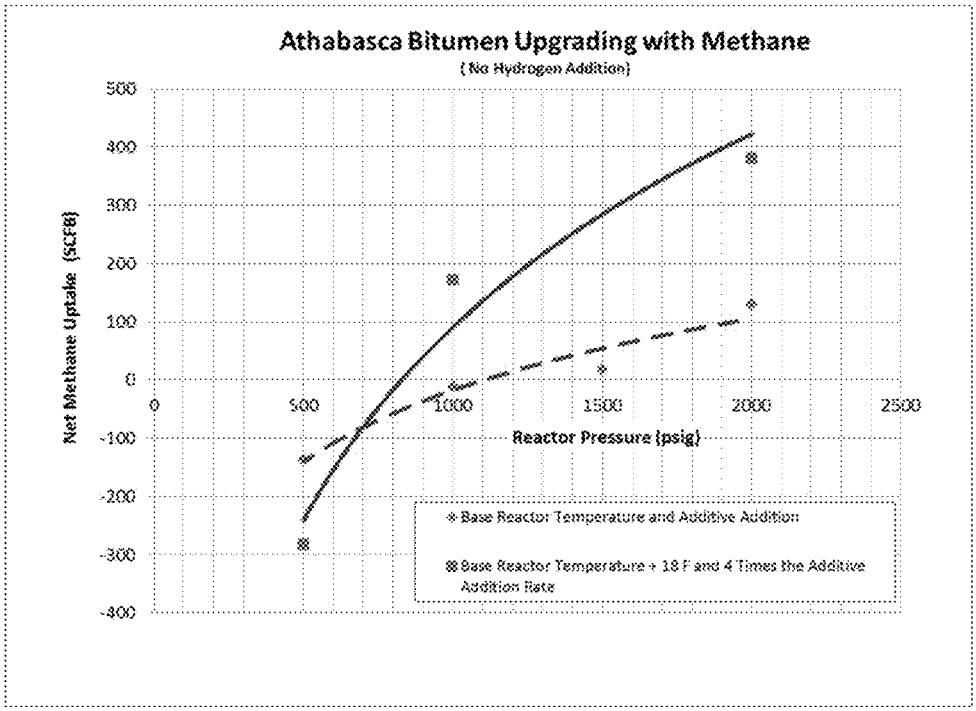
FIG. 13 shows an example of pilot-plant data related to the incorporation of methane in a non-hydrogen addition environment during bitumen upgrading.

FIG. 13 shows the results of cracking Athabasca bitumen with hydrogen replaced by methane. In this pilot work, the net incorporation of methane into the bitumen increased as a function of the unit pressure. At the base operating temperature and a small amount of anti-coking additive B, there was a net incorporation of methane into the reaction mix above about 1000 psi operating pressure. Anti-coking additive B was a moly-based additive. At the elevated system pressure of about 2000 psi, the net methane uptake was about 100 standard cubic feet per barrel (SCFB). As the pressure decreased below about 1000 psi, the net generation of methane increased.

When the reaction temperature was increased by about 18° F. and the amount of anti-coking additive B was increased by a factor of four, the net amount of methane incorporated at 2000 psig increased from about 100 SCFB to about 400 SCFB. The breakeven pressure, at which there was no net methane generated, decreased by about 200 psi and there was an elevated net methane-yield below about 800 psi at the elevated temperatures.

Similar to the syn-gas cracking pilot work, the pilot work done with methane gas was not a feasible commercial operation due to the large amount solids generated in the thermal process and deposited in the pilot plant. This pilot work does, however, demonstrate that methane can be directly incorporated in the reaction product mix at elevated operating pressures and the rate increases as a function of the system's pressure.

The complex nature of the products generated in cracking reactions performed at thermal conditions used in the upgrading of heavy oil can be shown by model-compound cracking studies. The cracking data shown in FIG. 14A through FIG. 14D represent a model compound, octadecane, that was processed at between about 842° F. (about 450° C.) and about 932° F. (about 500° C.) with a fluidized catalytic cracking unit (FCCU) catalyst over a constant reaction-time. The presence of the FCCU catalyst increased the rate at which equilibrium was achieved and substantially reduced the C1-C2 products associated with longer contact times that were required to achieve the conversion. Extensive rearrangement into various carbon and hydrogen structures took place under these processing conditions. FIG. 14 shows the carbon distribution achieved in a matter of seconds in a FCCU pilot plant. These yields were derived from octadecane, a pure component 18 carbon straight chain molecule, with a hydrogen content of about 15.1 wt % and about 84.9 wt % carbon.

Figure 14A:
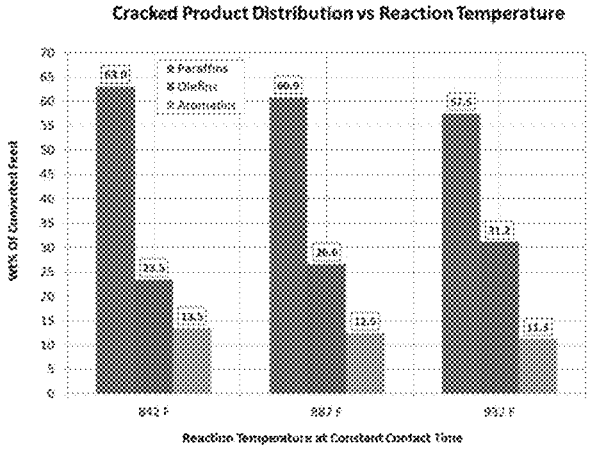
FIG. 14A shows cracked product versus reaction temperature distribution data; FIG.

FIG. 14A shows the distribution profile of hydrocarbon types generated. For example, the hydrogen content of about 15.1 wt % contained in the octadecane was redistributed into lower carbon-number paraffins, olefins, and aromatics. The low hydrogen-content aromatics were generated in order to balance the hydrogen content of the net product produced with the octadecane feedstock. As the reaction temperature was increased, the relative yield of paraffins and aromatics produced by the conversion of the feedstock was reduced. The yield of olefins was increased at increased reaction temperatures, with a relative increase of olefins produced by about 33% over the 90° F. temperature range shown.

Figure 14B:
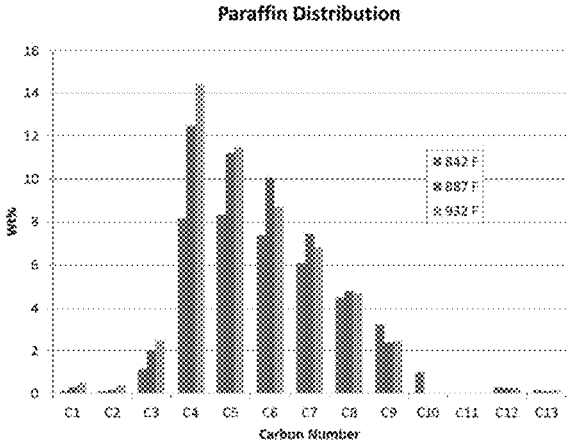
Figure 14C:
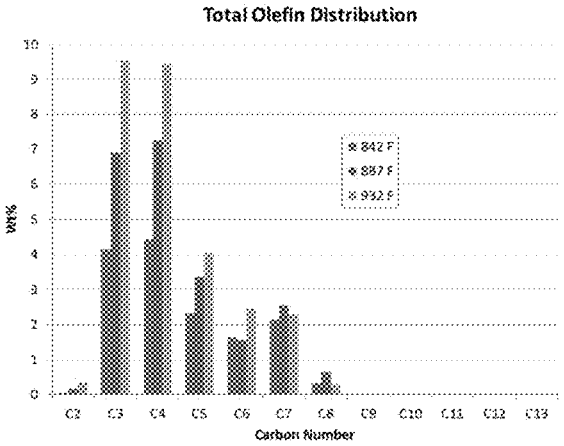
FIG. 14C shows total olefin distribution data; and, FIG. 14D shows aromatic distribution data.
Figure 14D:
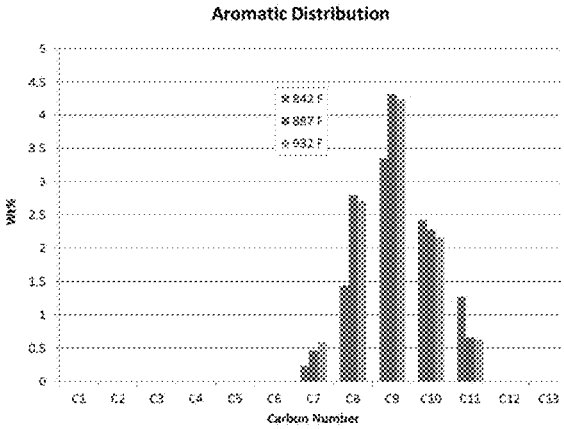

FIG. 14B shows that there is characteristic profile for the paraffins generated. As the temperature was increased, there was more conversion of the octadecane and the paraffin yield was increased around the C4 to C5 distribution peak. Similarly, the olefins were generated in a distribution around the C3 to C4 distribution peak, as shown in FIG. 14C.

To satisfy the hydrogen demand for the equilibrium on cracked materials generated in this closed system, aromatics were formed. The equilibrium carbon number distribution occurs around the C9 carbon, as show in FIG. 14D. This carbon distribution for mono-aromatics was characteristic of any FCCU processing of a typical complex crude sourced feedstock and this distribution shows the equilibrium that was achieved quickly and with a pure straight-chain paraffin feedstock. The carbon number distribution for the mono-aromatic structures generated shows the equilibrium distribution of carbon species alkylated to the mono-aromatic.

FCCUs can be operated with intermediate product cuts recycled into the thermal process with the result that the net yield of that material is substantially reduced and the product-cut can be eliminated. Similarly, high hydrogen content materials such as C5-C6 components of a conventional crude can be co-processed with a typical FCCU feedstock with the result that most of the C5-C6 components are incorporated into the typical FCCU product distribution. These results are consistent with the results shown in FIG. 14 where feed components went through thousands of reactions to achieve the equilibrium consistent with the net feedstock elemental composition and thermal processing conditions. The recycling of both low hydrogen aromatic streams and co-processing of high hydrogen paraffinic streams were incorporated into the FCCU equilibrium yield profile.

Unlike the catalyzed FCCU system, the processing of Athabasca bitumen required extending the contact time with an associated increase in the C1-C2 yields. FIG. 15 shows the C1-C4 yield distribution for a conventional delayed coker to those observed for the closed-system experiments shown in FIG. 11. The delayed-coker configuration generated almost equal quantities of C1-C3 carbon number structures with a total C1-C3 yield of about 6.7 wt % on coker feed. The closed-system experiments represented the longest contact time references with contact times of over an hour and that generated a similar flat profile of C1-C3 carbon structures as the delayed coker. However, the total C1-C3 yields were elevated by a factor of about 2.9 and about 1.8 for the higher pressure operation at 100% and 67% hydrogen purity cases, respectively.

As shown in FIG. 15B, the introduction of the FeS anti-coking additive reduced the amount of C1-C4s yielded with an increased relative-reduction as the carbon numbers increased.

Figure 16:
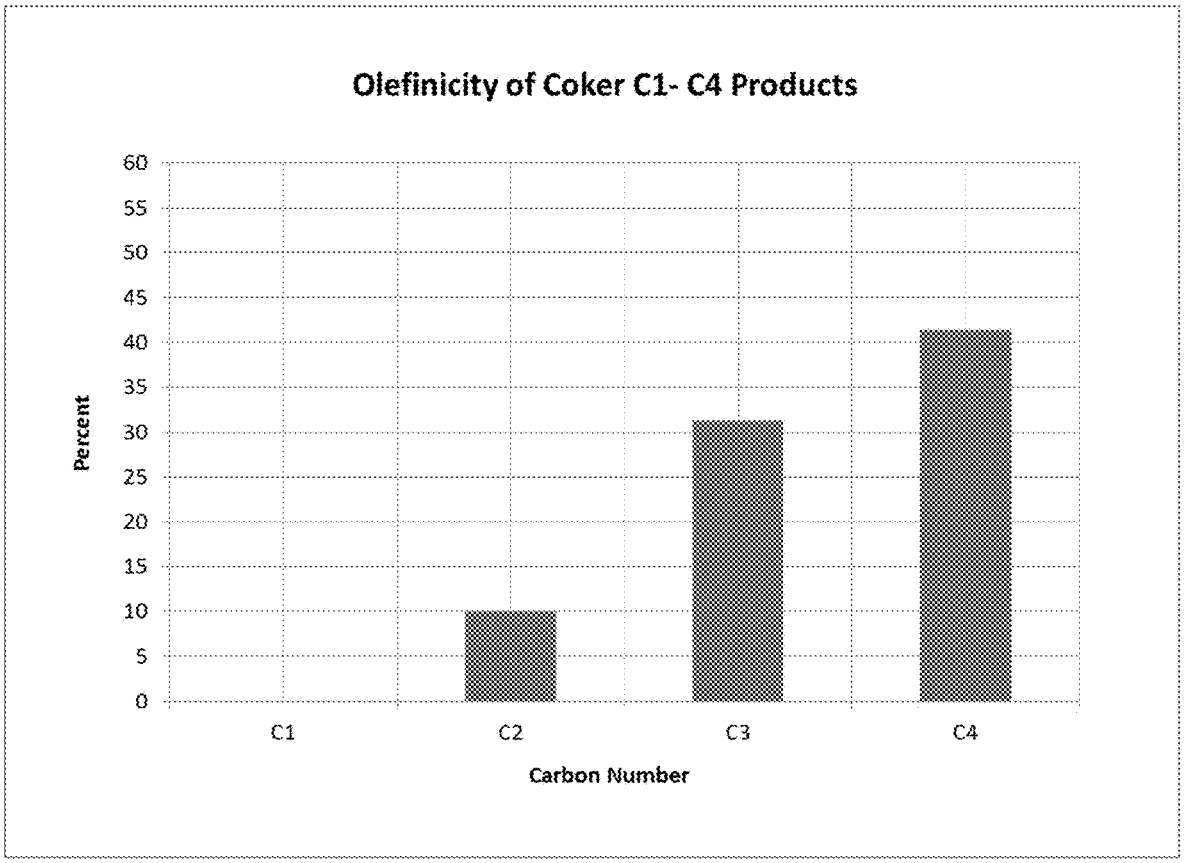
FIG. 16 shows an example of olefinicity data related to delayed coker products, C1 through C4.

The olefinicity profile for the delayed coker C1-C4 is shown in FIG. 16. There was an increase in olefinicity as the carbon number increased. The olefinicity of the C2 and C3s were substantially lower than the data observed from the shorter contact time in the FCCU experiments. FIG. 11 demonstrated that increased hydrogen partial-pressure resulted in stabilizing an increase in gas yield. FIG. 15 and FIG. 16 demonstrate that the stabilization and increased yield were greatest for C1 and the effect was reduced as the carbon number increased in the coker-type environment. Increased residence time and hydrogen gas availability further resulted in an increase in saturated C1-C3 yields.

It is known to co-process bitumen VTB type feedstocks with a 400-630° F. distillate boiling range hydrogen donor solvent prepared in a conventional fixed-bed catalyst system. The external hydrotreater generates the donor solvent by saturated naphthalene to tetralin. In the bitumen VTB thermal processing environment, the narrow boiling range distillate containing the tetralin converted back to naphthalene and donated hydrogen to the thermal reactor liquid. The donation of the hydrogen in the liquid phase reportedly extended the potential 975+ F liquid conversion up from the visbreaker range to about 70% without the generation of coke. A distillate boiling range hydrogen donor enables hydrogen addition to a heavy oil at substantially reduced upgrading operating pressures.

Figure 17:
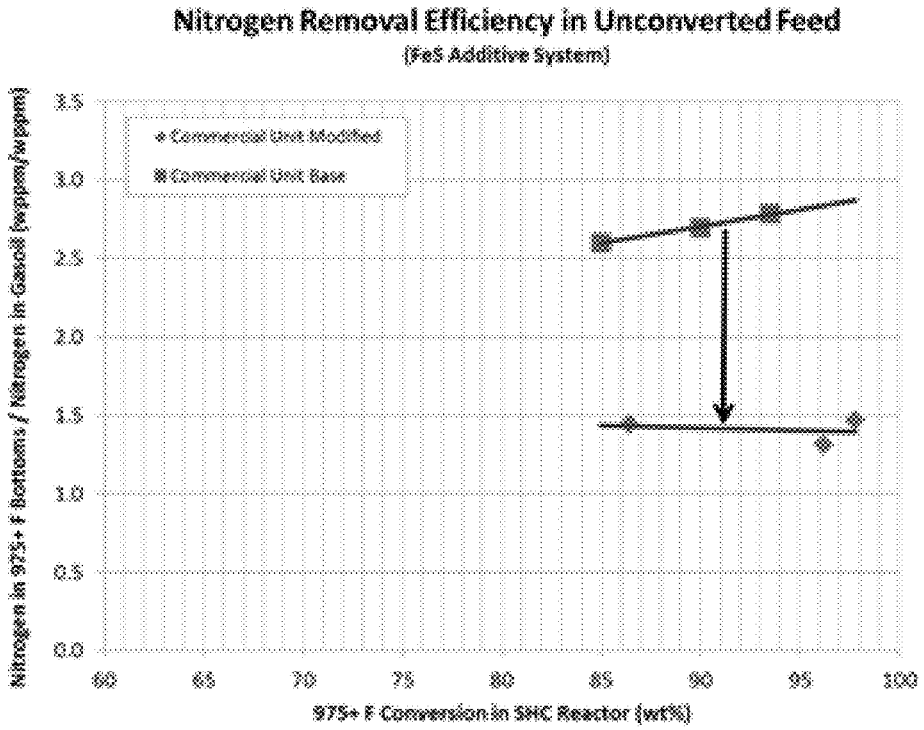
FIG. 17 shows an example of nitrogen removal efficiency using two different slurry-phase hydrocracking (SHC) units and an iron sulfide anti-coking additive.

In some implementations of the present disclosure the ITP is different from a SHC process. Such differences at least include increasing the localized heat input and reaction temperature at the point of the inlet gas. Contrary to conventional wisdom, these differences can result in a substantial reduction of polar aromatic partitioning during the thermal upgrading process. Further, by reducing the hydrogen purity in the hydrogen rich gas recycle stream, there was a substantial improvement in the reduction of polar components contained in the 975+ F liquid in the SHC products. FIG. 17 shows that the ratio of the nitrogen content of the unconverted 975+ F product relative to the nitrogen content of the associated gasoil cut was reduced to about 25% of that exhibited by the base commercial unit operation and what was observed in the pilot plant.

FIG. 17 shows that there was a consistent increase in the relative amount of nitrogen in the 975+ F product as the unit 975+ F conversion was increased for the base commercial unit operation. At about 90% 975+ F conversion, the relative nitrogen in the 975+ F product was about 2.7 times that of the associated gasoil. This increase in the relative concentrations of this polar component can be a marker for the partitioning of the asphaltenes that were upgraded from the bulk reactor liquids and the tendency for the partitioned asphaltenes to associate and form mesophase coke.

In contrast, the data for the modified commercial-operation showed a moderate increase in the nitrogen and, therefore, the degree of partitioning of the asphaltenes is greatly reduced.

Figure 18:
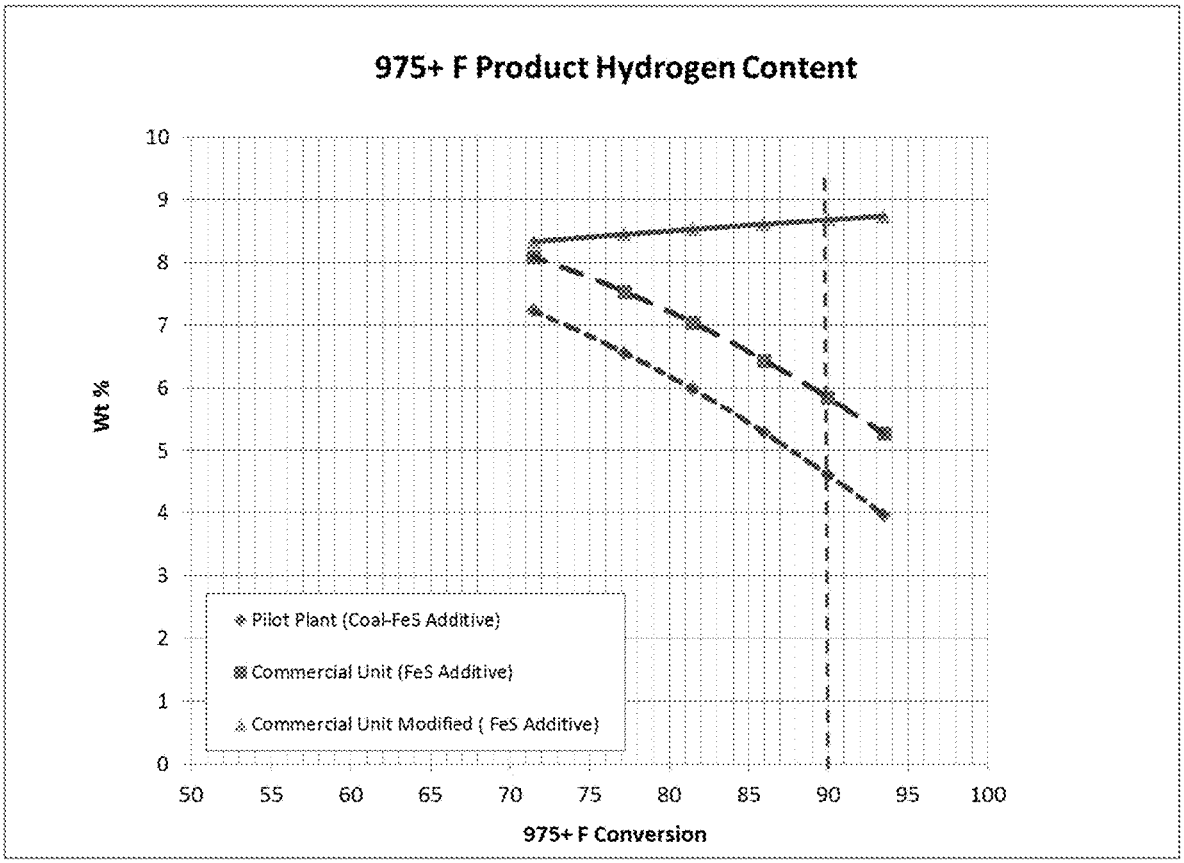
FIG. 18 shows an example of hydrogen content data related to 975+ F liquid products versus feedstock conversion from three hydrocarbon upgrading processes.

FIG. 18 shows an example of data that relates to the hydrogen content of the 975+ F product from a slurry-phase hydrocracking (SHC) based process. The hydrogen content of the 975+ F product for the coal—FeS anti-coking additive system (shown as diamond data-points in FIG. 18) was lower at any given feedstock conversion level than the FeS anti-coking additive system used in the base commercial-operation (shown as square data-points in FIG. 18). Both the pilot plant work and the base commercial-operation exhibited a decreasing hydrogen content in the 975+ F liquid product as the conversion was increased. This is consistent with the partitioning of the asphaltenes as the conversion increased and the incipient coking-conditions were achieved for a given feedstock. There was about an order of magnitude more of FeS in the FeS anti-coking additive system relative to the amount of FeS in the coal—FeS anti-coking additive system. This increase in the amount of FeS enabled an increased hydrogen transfer and provided an improvement of about 1.2 wt % hydrogen content in the 975+ F product at the reference conversion of 90%.

The FeS based anti-coking additive system was common to both the base commercial-operation and the modified commercial-operation (shown as the triangle data-points in FIG. 18). The hydrogen content of the unconverted feed for the modified commercial-operation showed a distinct difference relative to both the pilot plant benchmark for the coal—FeS additive and the base commercial-operation utilizing the FeS anti-coking additive.

The hydrogen content of the 975+ F product from the modified commercial-operation did not decrease with an increasing 975+ F conversion of the feed. At the 90% 975+F conversion reference, the hydrogen content of the 975+ F liquid was about 2.8 wt % higher than the base commercial-operation. The hydrogen content of the unconverted 975+ F liquid increased as the molecular weight of the 975+ F product decreased associated with an increased 975+ F conversion in the modified commercial-operation.

Without being bound by any particular theory, the reduced polar aromatic partitioning observed in FIG. 17 resulted in the ability to continue to upgrade the asphaltenes, which negated the rate limiting hydrogen mass-transfer processes that resulted in the inability to completely upgrade the 975+ F feedstock. In some implementations of the present disclosure, the improved mass transfer of hydrogen demonstrated with the use of polar aromatic solvency control is extended to the point that all the 975+ F feedstock can be yielded as 975− F product.

Figure 20:
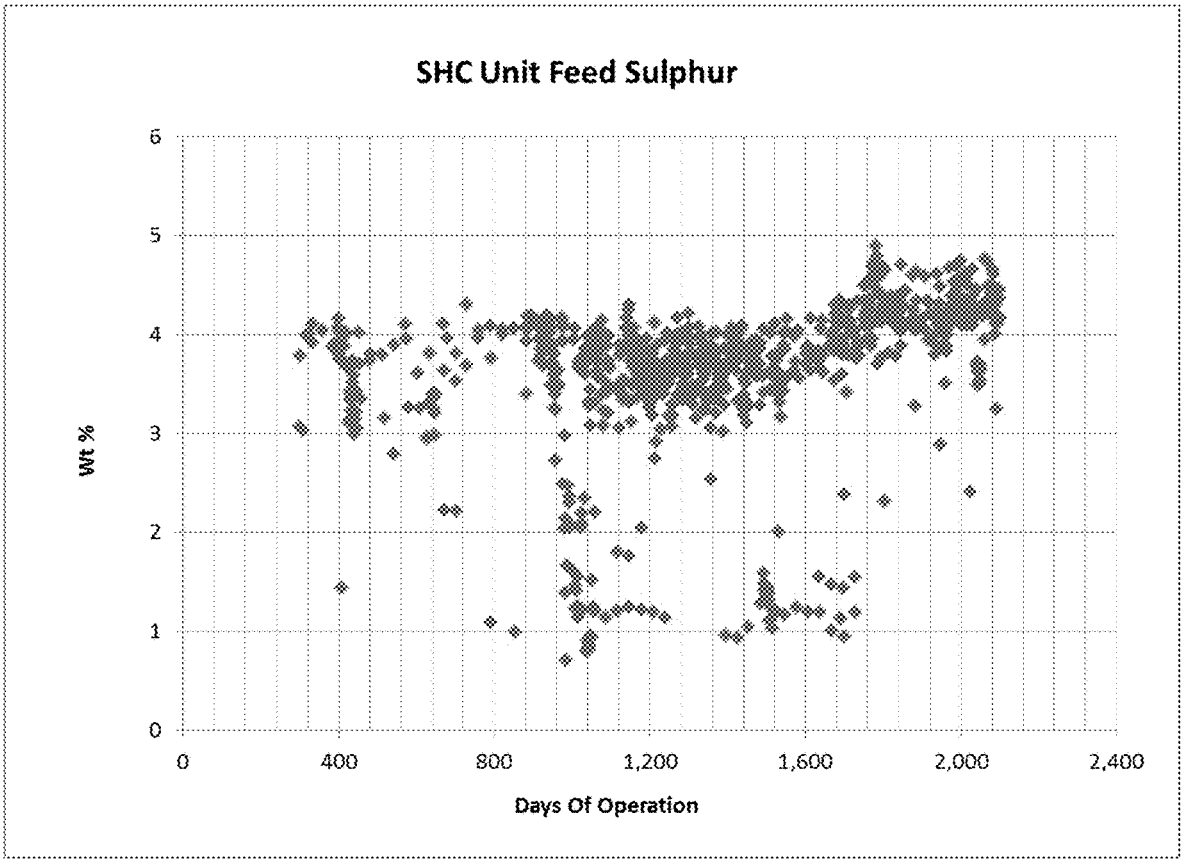
FIG. 20 is an example of a trend plot of a slurry-phase hydrocracking unit feed sulphur weight percentage over a number of years of operation.

FIG. 19 highlights some of the characteristics of the feedstock benchmarks discussed in reviewing the commercial unit operation above. The feedstock nC7 asphaltenes content, the polar aromatic/asphaltene ratio, the viscosity, and the sulphur content are the primary bulk average properties used in assessing the feedstock quality in an SHC operation. FIG. 20 shows the commercial unit feed sulphur history over about a 2000 day period. The feed sulphur covered a broad range of concentrations spanning between about 0.7 to about 4.9 wt %. Knowing the source of the crudes processed, the sulphur content can be used to infer the reactivity and the asphaltene content of the SHC feedstock based on the benchmarks given in FIG. 19. For the purposes of this illustration, the asphaltic VTB qualities can be assumed based on the interpolation between the Isthma Mayan and the Mene Mota reference crudes.

The pilot plant operation was used to process the Cold Lake vacuum tower bottoms (VTB) using a coal—FeS anti-coking additive. The pilot plant feedstock is represented by the 1.050 specific gravity Cold Lake Analysis (see FIG. 19). The asphaltene (nC7) content of this feedstock was about 20 wt %, but Cold Lake hydrocarbons typically have an elevated incipient coking temperature because those hydrocarbons have a high resin to asphaltene ratio.

The base commercial-unit was also used to process the Cold lake VTB using the FeS anti-coking additive. The base commercial-operation feedstock is represented by the 1.041 specific Cold Lake analysis (see FIG. 19). The asphaltene (nC7) content and the CCR of this feedstock are 15.5 and 20.6 wt % respectively. The Cold Lake VTB used as a feedstock for this testing was lighter than the feedstock used in the Pilot Plant due to some contamination with a less asphaltic crude. The processed VTB has a viscosity of about 1080 centistokes (cSt) at 275° F.

The modified commercial-unit was used to process VTB from an asphaltic crude. The asphaltic crude VTB that was processed over the period of the data set had a feed sulphur of about 4.0 wt %. Based on the source of the crude, the nC7 asphaltene content was in the range of about 28 wt % with a resin to asphaltene ratio of about 0.7. The hydrogen content of asphaltic VTB would be similar to the 10.5 wt % in the 1.041 specific gravity Cold Lake operation benchmark.

The modified commercial unit was also used to process visbreaker bottoms that were derived from asphaltic crude VTB and, therefore, the visbreaker bottoms were lower in hydrogen content than the asphaltic VTB charged to the visbreaker. The three samples of visbreaker bottoms shown in FIG. 19 represent the material remaining after the higher hydrogen content lighter thermal products had been removed. The asphaltene (nC7) content for the reference visbreaker bottoms streams range from about 31.7 to about 36.6 wt %. These visbreaker reference streams also have a very low resin/asphaltene ratio ranging between about 0.45 and about 0.7. For the reference, when comparing the Mene Mota asphaltic VTB with the 0.8 FLOCC value demonstrated a conversion of 950+ F (510+ C) in the thermal visbreaker of about 27.8 wt % and the associated asphaltene (nC7) content in the visbreaker bottoms increased from about 17.1 wt % to about 34.5 wt %. As shown in FIG. 19, the viscosity of the VTB boiling range material increased from about 454 to about 14,165 centipoise (cSt) at about 275° F. in association with the 17.4 wt % increase of the asphaltenes (nC7). The visbreaker operation represented the most hydrogen deficient feedstock and thermally unstable of the four benchmark feedstocks processed, which is consistent with the visbreaker VTB feed being converted close to the feedstock stability limit.

FIG. 21A through FIG. 21F show data that relates to a change in the SHC light hydrocarbon yields associated with implementations of the present disclosure. All the C1 through C4 yields dropped substantially with the changes associated with the modified commercial-operation. FIG. 21A through FIG. 21F show that independent of anti-coking additive type used or whether the data is from the pilot plant or the base commercial-operation, all the C1-C4 yield components increased with increasing 975+ F conversion. Conversely, the C1-C4 yields decreased with increasing 975+ F conversion for the modified commercial-operation. The overall yield reduction in the higher carbon number C3 and C4 and the rate of reduction of those net products is greatest for the higher asphaltene content thermally-generated visbreaker feedstock.

Figure 21A:
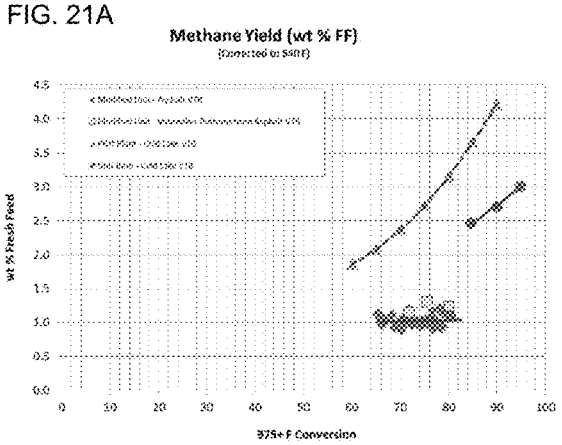
FIG. 21A is an example of methane yield data.

FIG. 21A shows that the methane yield was essentially flat versus the increased 975+ F conversion for the modified commercial-operation. The absolute value of the methane yield was about 1 wt % from the modified commercial-operation, which was substantially lower than the 2.21 to 6.50 wt % methane bookend reference yields as shown in FIG. 15. FIG. 15 provides a reference for methane yields from longer contact time for thermal conversion benchmarks with varying hydrogen partial pressures. In the FIG. 15 data, the methane yield increases with an increased hydrogen partial-pressure.

The impact of the hydrogen partial-pressure is shown in FIG. 15A by the 67% hydrogen partial-pressure reference data point with 4.26 wt % methane yield, which resulted in an intermediate methane yield between the 0% and 100% hydrogen partial-pressure bookends.

As shown in FIG. 15A, the addition of the coal—FeS anti-coking additive reduced the light-gas profile for the C1-C4 products with an increased relative impact as the carbon number was increased from C1 to C4. The amount of C1 for the 67% hydrogen partial-pressure reference was reduced from 4.26 wt % to 3.44 wt %. The presence of the coal—FeS anti-coking additive resulted in a 19% reduction in the methane yield or a relative yield of 81% compared to the testing without the anti-coking additive. FIG. 15B clearly shows that in this closed, long contact time system, a reduction in relative yields occurs with increasing carbon number. The relative amount of C4 yield with the additive in the system was reduced to 39%.

The methane yields shown in FIG. 21A show that the coal—FeS anti-coking additive system provided a methane yield of about 4.5 wt % at a reference 90% 975+ F conversion of the Cold Lake VTB feedstock (see triangle data-points in FIG. 21A). The rate of methane yield increased at an exponential rate with increasing feedstock conversion. In the base commercial-operation, the quantity of C1 yielded was more linear with an increased feedstock conversion (see circle data-points in FIG. 21A). The C1 yield was found to be 2.7 wt % at the reference 90% feedstock conversion. With increased FeS present in the anti-coking additive, there is a magnified impact of these effects, as shown in FIG. 15A and FIG. 15B.

The C2 and C3 yields shown in Cold Lake pilot-plant work followed the same relative shifts as observed in FIG. 15. The relative impact of the greater amount of FeS present was less pronounced for the C2s. In the case of the C3s and C4s, the elevated FeS concentration in the base commercial-unit was associated with an elevated C3 yield and similar C4s yield as shown in FIG. 21C, FIG. 21D and FIG. 21F. An elevated FeS anti-coking additive concentration reduced the yield of C1s, but resulted in increased yield of C3s.

Figure 21B:
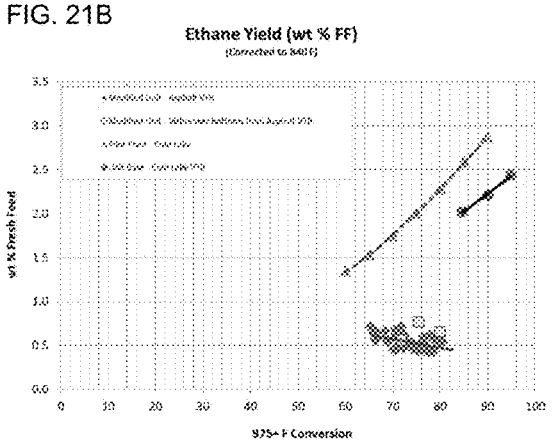
FIG. 21B is an example of ethane yield data.
Figure 21C:
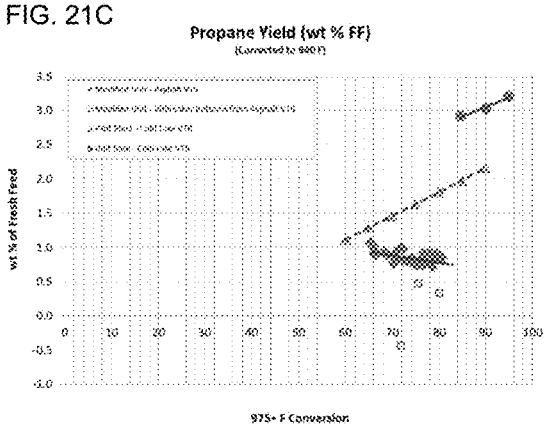
FIG. 21C is an example of propane yield data.
Figure 21D:
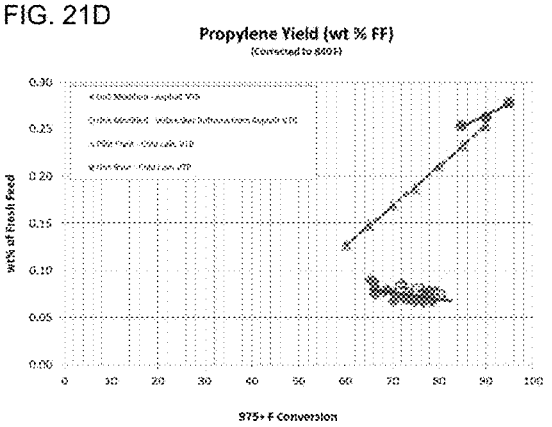
FIG. 21D is an example of propylene yield data.

FIG. 21A and FIG. 21B show that the yield of C1 and C2 from the asphalt VTB and the thermally processed visbreaker bottoms are similar at a given 975+ F conversion when processed with the modified commercial-unit (see diamond data-points and square data-points, respectively, in FIG. 21).

Figure 21E:
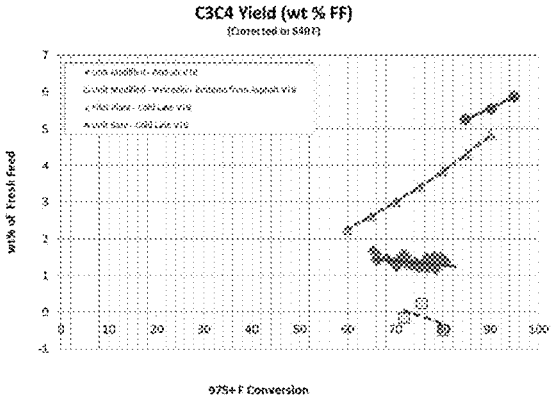
FIG. 21E is an example of C3 and C4 yield data; and, FIG. 21F is an example of total C4 yield data.
Figure 21F:
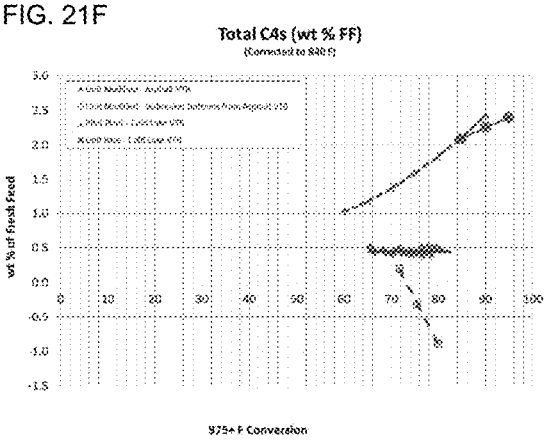

FIG. 21E shows the combined C3C4 products for the various benchmarks. The higher hydrogen transfer of the FeS base commercial-operation showed the highest yield of C3C4 products followed by the lower hydrogen transfer Coal—FeS additive pilot plant. In both the base commercial-operation and the pilot plant, the yield of C3C4 increased with 975+ F conversion. Conversely, the processing of the asphalt VTB in the modified commercial-operation shows a substantially lower yield of C3C4 yield that decreased with elevated 975+F conversion (see diamond data-points in FIG. 21E). The thermally processed, lower hydrogen content visbreaker bottoms exhibited essentially no net C3C4 yield (see square data-points in FIG. 21E).

FIG. 21F shows the C4 yields and the differentiation between the asphaltic feed processed in the modified commercial-operation and the thermally processed visbreaker bottoms. There was a net negative yield of C4s in the process that further decreased with the increase in feedstock conversion. The negative yield is enabled with C4 included in the make-up gas to the modified commercial-operation.

Figure 22:
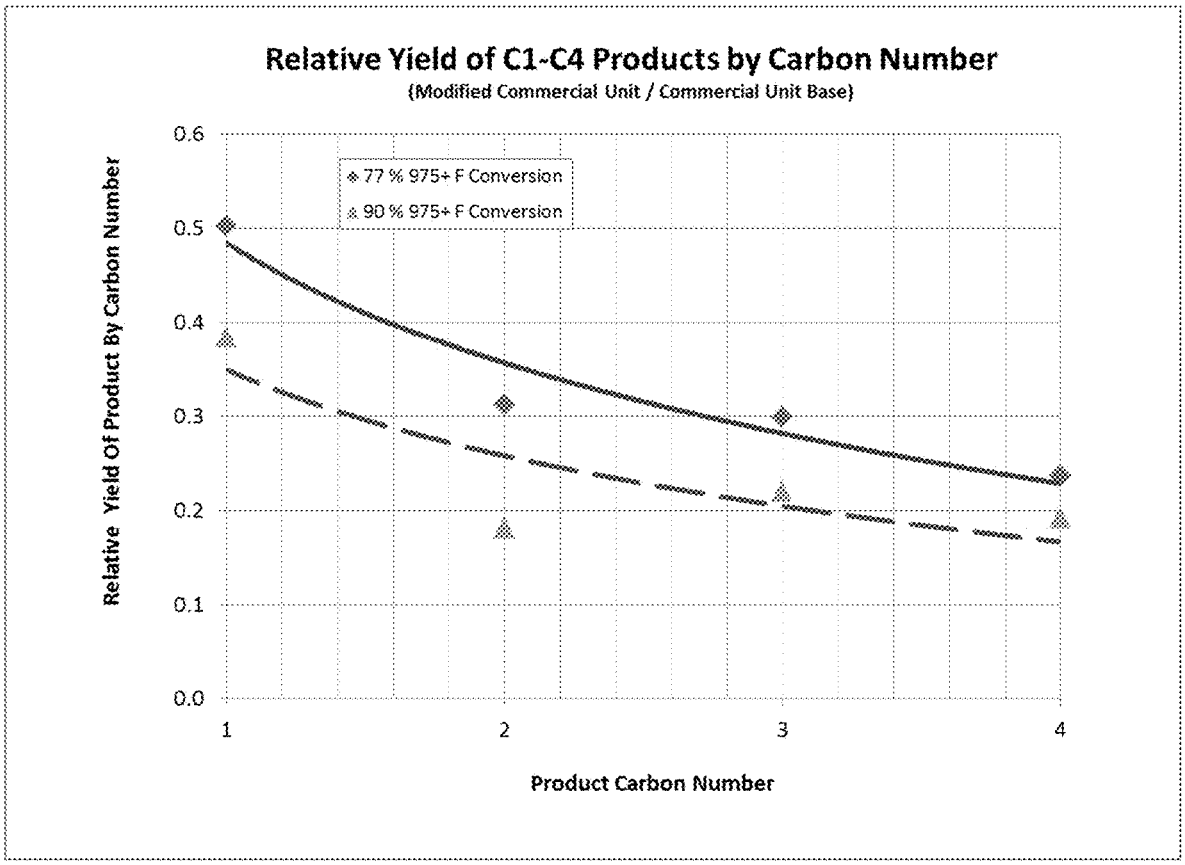
FIG. 22 is an example of data related to relative yields of C1 through C4 by carbon number compared at two feedstock conversion levels.

FIG. 22 compares the relative reduction of C1 through C4 carbon products between the base commercial-operation and the modified commercial-operation on VTB from asphaltic feedstock. Both of these operations used the FeS anti-coking additive and make-up gas that included C1-C6 components. The data was extracted from FIG. 21 at the 77% and 90% 975+ F reference conversion levels. The modified commercial-operation resulted in a greater relative-reduction in yield as the carbon number increased. The data further shows that as the 975+ F conversion increased, there was a further reduction in the C1-C4 yield.

The data of FIG. 22 can be compared to the closed system data of FIG. 15B. The elevated level of FeS anti-coking additive in the FIG. 22 data reduced the relative amount of all of the C1-C4 products. In addition, recycling the product gases in the commercial operation further reduced the net yield. This effect became increased at elevated feedstock conversion.

Figure 23A:
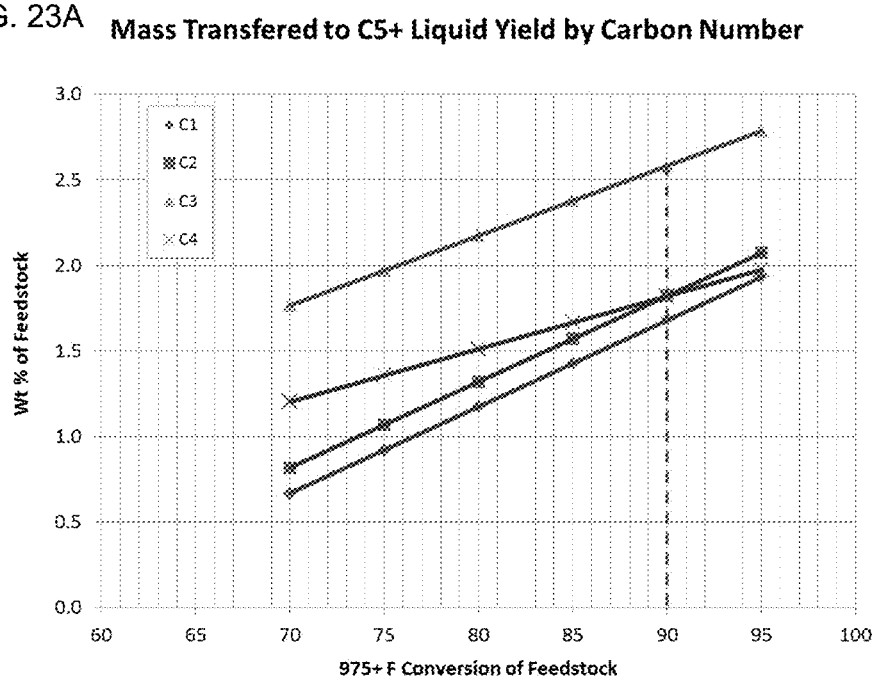
FIG. 23A shows the relative yield shift based upon carbon numbers; and, FIG. 23B shows the relative yield shift by carbon and hydrogen transferred.

The reduction in the yield of the C1-C4 hydrocarbons achieved in the modified commercial-operation resulted in mass being transferred into the C5+ liquid yield. FIG. 23A shows that quantity of mass transferred to the C5+ liquid increased with conversion for all four carbon number species. At a given feedstock conversion, the relative amount of mass transferred to the C5+ liquid increased as the carbon number increased from C1 to C3.

Figure 23B:
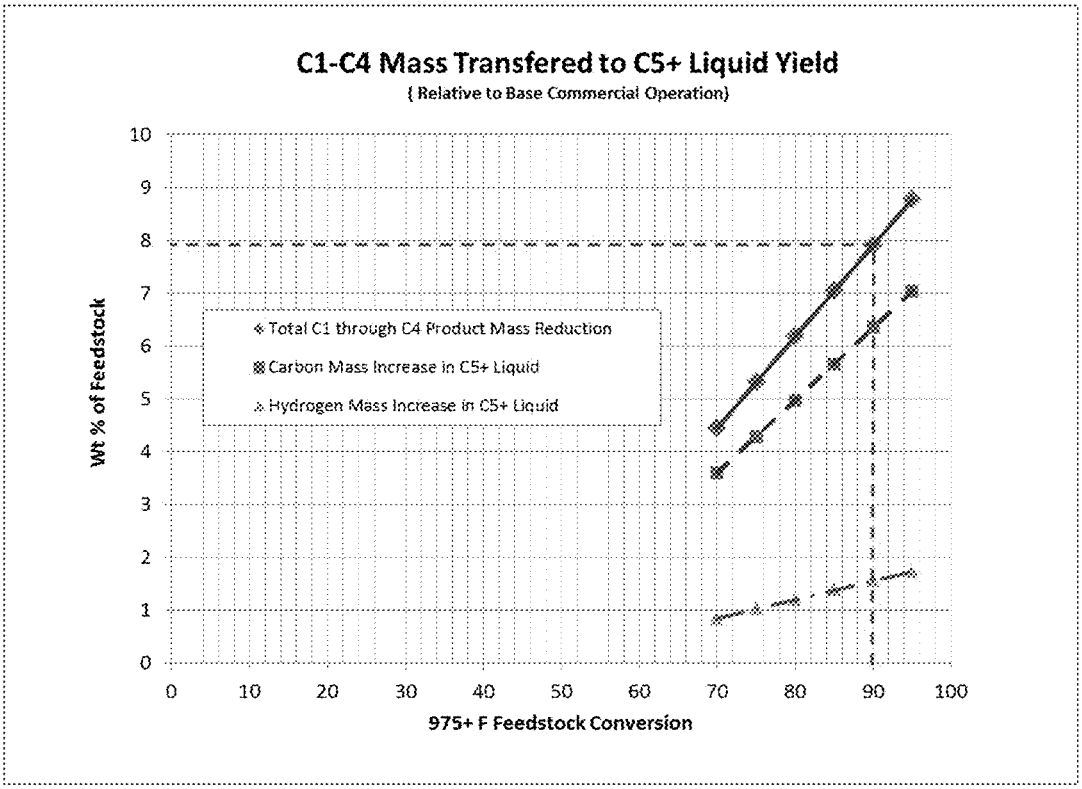

FIG. 23B shows the sum of the C1 to C4 products shown in FIG. 23A. At 90% 975+ F conversion of the feedstock, the total mass of C1-C4 transferred to the C5+ liquid is 7.9 wt % of the feedstock. As shown in FIG. 23B, that mass transferred represents about 6.35 wt % of the product carbon and about 1.56 wt % of product hydrogen. Based on a nominal feed specific gravity of about 1.05, the about 1.56 wt % hydrogen retained in the liquid due to the lower C1-C4 net yields is equivalent to about 1076 standard cubic feet per barrel (SCFB) as hydrogen. Based on a typical steam methane reformer (SMR) operation, about 65 pounds per barrel of $CO_2$ would be generated just to supply the 1079 SCFB of hydrogen required without the benefit of the increased of C5+ liquid yield. In some implementations of the present disclosure, the need for SMR generated hydrogen is decreased, substantially decreased, or SMR generated hydrogen is not needed.

Figure 24:
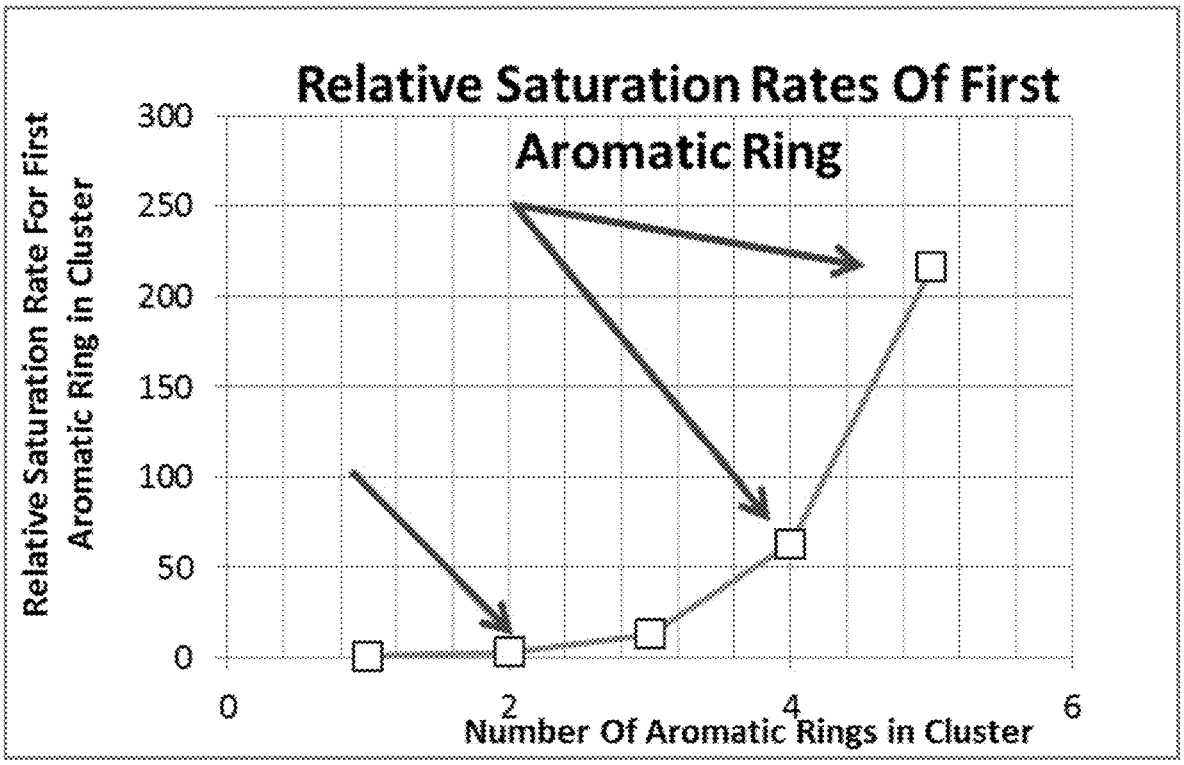
FIG. 24 is an example of data related to the relative rates of hydrogenation of aromatic compounds.

FIG. 24 shows that it is easier to add hydrogen to larger clusters of aromatic rings. The relative saturation rate for the first aromatic in a five ring-cluster of aromatics is about 220 times faster than the saturation rate of a mono-aromatic. The equilibrium gas-oil (VGO) cut from a SHC operating at about 2000 psig and utilizing a FeS based anti-coking additive, contained primarily 2 and 3 ring-aromatics and some 4 ring aromatics. A large part of these VGO boiling-range molecules included cyclo-paraffin rings, which are active in hydrogen transfer at the ITP thermal processing conditions.

The reduction in the C1-C4 yields and the increase in the hydrogen content of the 975+ F liquid is primarily due to the saturation and alkylation of the higher hydrogen content molecules into these highly condensed aromatic rings. The greater the number of fused aromatic rings, the greater the rate of saturation and alkylation similar to the relationship shown in FIG. 24. As demonstrated in FIG. 21E and FIG. 21F, the low hydrogen content visbreaker bottoms feed with about 34 wt % asphaltene content showed the greatest incorporation of high hydrogen-content molecules and the lowest net C3 and C4 yields.

As the asphaltenes undergo thermal decomposition, low hydrogen content Toluene Insoluble Organic Residues (TIOR) components are generated. If allowed to self-associate, TIOR will generate coke. FIG. 25A through FIG. 25D show the changes in TIOR yield for Athabasca bitumen VTB in the pilot plant environment.

Figure 25A:
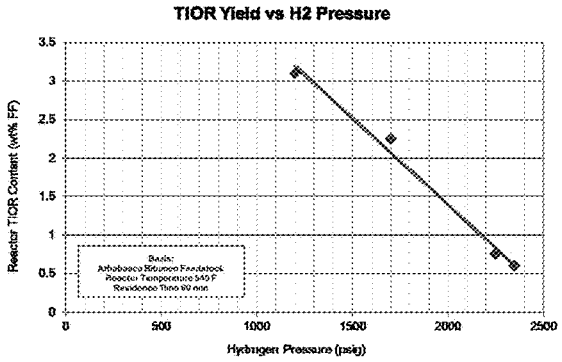
FIG. 25A shows TIOR yield versus hydrogen partial-pressure.

FIG. 25A shows that there is linear increase in TIOR yield from about 0.6 to about 3.1 wt % as the hydrogen partial-pressure is decreased from about 2400 to about 1200 psig. These results are relative to a constant reaction temperature of about 840° F. and about 1 hour residence time. A temperature of 840° F. is close to the incipient coking temperature for Athabasca bitumen VTB feedstock.

Figure 25B:
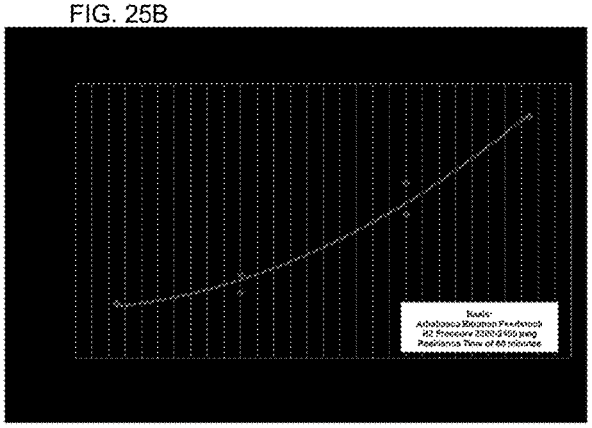
FIG. 25B shows TIOR yield versus reactor temperature.

FIG. 25B shows that as the reaction temperature increased, there was an exponential increase in TIOR from about 0.7 at about 840° F. to 2.2 wt % at about 875° F. For this pilot-plant testing, the hydrogen partial-pressure was constant at about 2350 psig and the residence time was about 1 hour. Operation at a lower hydrogen partial-pressure would be likely to substantially increase the TIOR yield.

Figure 25C:
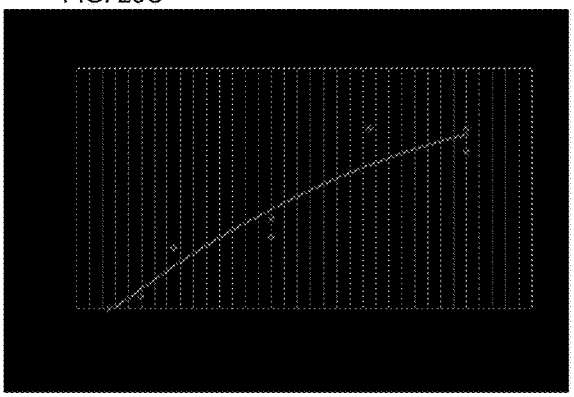
FIG. 25C shows TIOR yields versus reaction time; and, FIG. 25D shows reactor TIOR content versus mixing severity.

FIG. 25C shows that an increased residence time resulted in increased TIOR yield at a temperature of about 840° F. and at an operating pressure of about 2350 psig.

Figure 25D:
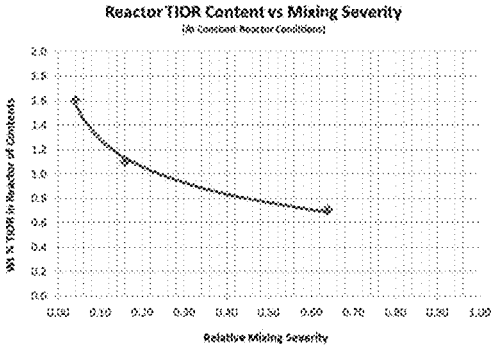

FIG. 25D shows that decreasing the mixing severity from the set-up of the base pilot plant at 0.7 of a relative mixing-bar tip speed resulted in an increased TIOR. There was little impact on the TIOR yield when the relative mixing severity was increased (by an increased mixing-bar tip speed) further in the pilot plant operation.

The pilot plant data shown in FIG. 25 shows that even for a high resin to asphaltene ratio feedstock such as Athabasca bitumen, which is about 1:2.5, and the associated relatively high incipient coking-temperature, a high hydrogen partial-pressure about 2000 psig is required to limit TIOR production as the asphaltene undergoes thermal decomposition during the upgrading process. Increasing reaction residence time and temperature to achieve increased 975+ F conversion further increased the TIOR yield. Increased mixing within the pilot plant had limited impact on reducing TIOR generation. As shown in at least in FIG. 18, partitioning of the asphaltenes occurs in the pilot plant and base commercial operation which results in the reduction of hydrogen content of the 975+ F products as the feedstock conversion is increased.

In contrast, FIG. 26A through FIG. 26D show the ability to control the TIOR in the commercial unit with implementations of the present disclosure. The commercial unit data for TIOR and ash is shown for a period of almost 2000 days. The ash is primarily made up of the FeS anti-coking additive, but also contains nickel (Ni), vanadium (V) and other metals that were removed from the VTB during the thermal upgrading process and that were integrated into the FeS anti-coking additive. The deposit of these metals resulted in increased hydrogen-transfer characteristics of the ash relative to FeS alone. In some cases, there was a small amount FCCU catalyst fines present in the FCCU slurry oil used that contributed a polar aromatic support material.

Figure 26A:
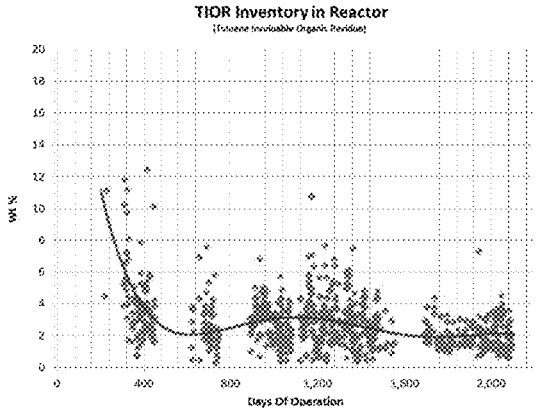
FIG. 26A shows TIOR inventory within the reactor.

FIG. 26A shows that the average reactor TIOR inventory ranged from 0.1 to 12.5 wt % of all reactor contents. The period shown between 1700 and 2100 days on FIG. 26A represents a period when about a 30 wt % nC7 asphaltene content feedstock was being processed. The typical average TIOR concentration in the reactor for this period is 2.0 wt % with a typical range between 1 and 4 wt %. For the first 1600 days of the operation, the average reactor TIOR was higher and the degree of variation was greater. The initial 500 days showed the greatest degree of variation and the ability of system to process effectively without coke generation within the unit. The stabilization to lower TIOR levels with greater consistency in the numbers was primarily due to adjusting the amount of polar aromatic support material.

Figure 26B:
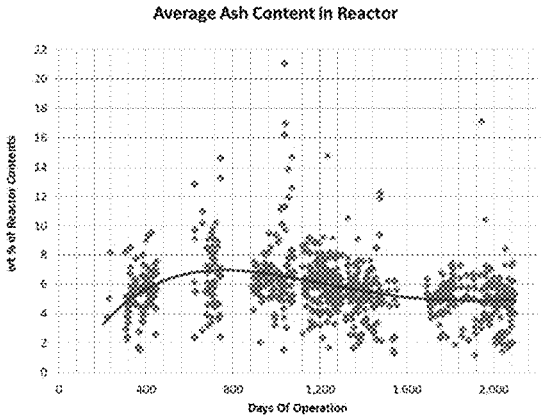
FIG. 26B shows the average ash content in the reactor.

FIG. 26B shows that the average Ash content (Ash, whether capitalized or not, can be used herein as a reference to the sum of the FeS anti-coking additive and any metals such as nickel (Ni), vanadium (V) and any other inert solids) of the reactor was typically operated between about 5 and about 7 wt %, with a peak of about 21 wt %. The amount of Ash in the reactor is a function of its accumulation rate and is not directly a function of the rate at which the additive was added.

Figure 26C:
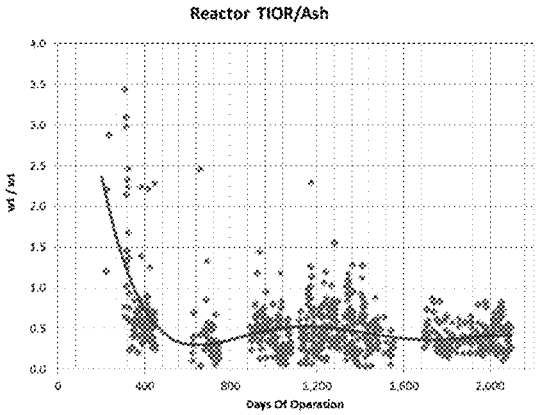
FIG. 26C shows the relationship between TIOR and ash; and, FIG. 26D shows the relationship of TIOR to Ash ratio and reactor temperature.

FIG. 26C shows the average TIOR/Ash ratio. During typical operations, the TIOR/Ash ratio is about 0.3 wt/wt. The polar TIOR material generated during the thermal dissociation of asphaltenes associated with the complexed FeS anti-coking additive and associated Ash components. The Ash is very dense given the specific gravity of the FeS is about 4.5. The particulate sizes can be controlled by the amount of polar aromatic support material added to the reactor. The quantity of TIOR in the reactor is dictated by the accumulation of unconverted asphaltene. The amount of unconverted asphaltene is controlled by matching the rate of asphaltene input into the reactor with appropriate operating conditions to upgrade the asphaltene and, thereby, to maintain the target unit TIOR inventory.

Figure 26D:
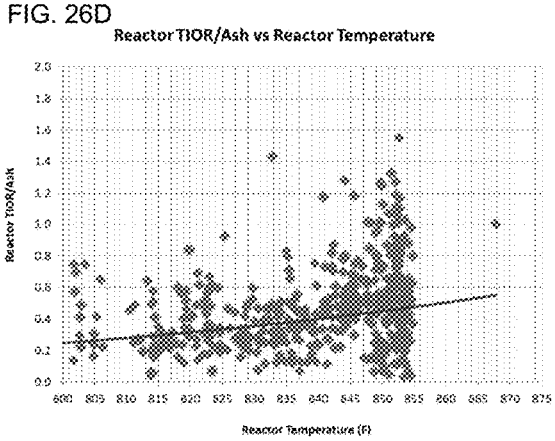

FIG. 26D shows that the reactor was typically operated well above the incipient coking temperature of the low resin to asphaltene content asphaltic crude VTB, which would be about 820 F. The typical average operating temperature for bulk reactor liquid was in the low 850° F. range. At a typical 853° F. average reactor temperature, the TIOR:Ash ratio was about 0.5 wt/wt. However, the data shows that depending upon a balance point in the operation, the TIOR could almost be completely converted.

There are a number of process variables that are available to manipulate the TIOR:Ash ratio. As the TIOR:Ash ratio increased, agglomeration causes the particle size to increase. The FeS-based ash is about 5 times the density of the liquid within the reactor and the agglomeration of the ash with the TIOR can result in large particles that are readily gravity separated by differential settling velocities. The resulting differential settling velocities provided a mechanism for the segregation of the TIOR from the bulk reactor solution and for transporting the TIOR to the gas contactor at the bottom of the reactor. This behaviour is analogous to a clarification process for segregating asphaltenes to the bottom of a clarifier. This can provide a mechanism to concentrate and position the highly complexed aromatic ring clusters in the proximity of the high temperature gas contactor jets. This transportation of the TIOR through complexing with the dense Ash can facilitate a rapid alkylation of the high hydrogen-content gases into the aromatic ring clusters.

One of the characteristics of a contacting device is that a gas-contacting zone is created around the gas contactor where the TIOR-Ash complex is concentrated. A reactor withdrawal point at the center of the reactor about 3 feet above the gas contactor has been found to be a highly effective method for withdrawing Ash and any associated TIOR from the reactor. Additionally, this concentration of the TIOR and Ash creates an effective environment for maximizing the direct incorporation of the high hydrogen-content hydrocarbons into the concentrated highly aromatic oil. The ability to control the Ash accumulation in the reactor and the solubility of the TIOR by manipulating the polar aromatic support environment provides a mechanism to control the TIOR-Ash complex settling velocity. Precipitation and hydrogen transfer efficiency is controlled through the injection of polar aromatic solvents below the gas-contacting system. However, the addition of higher hydrogen content high boiling feedstocks such as paraffinic VTB in the top half of the reactor can promote flocculation and concentration of the TIOR and Ash into the gas-contacting zone at the bottom of the reactor. This provides both more hydrogen content in the overall feed to the unit and more multi aromatic clusters that can incorporate light gases.

As outlined in the preceding sections, there could be necessary trade-offs in terms of the need to control TIOR generation and prevent coke generation during the thermal upgrading of asphaltenes being balanced against the loss of liquid yield associated with the stabilization of low carbon number saturates at elevated hydrogen partial-pressures. Increasing the hydrogen transfer rate with increased hydrogen partial-pressure results in the production of undesirable low carbon number saturate products at the expense of a substantial reduction of the more valuable C5+ liquid products. In the thermal processes, increasing the contact time or increasing the bulk solution temperature further reduces the production of the more valuable C5+ liquid yield.

Implementations of the present disclosure relate to a mass transfer of higher molecular-weight light gases to overcome the polar partitioning associated with the thermal upgrading of asphaltenes. The hydrogen content of the TIOR and the asphaltenes are increased by reactions that directly incorporate higher hydrogen-content gases into the thermally generated heavy oil intermediate product. This process can allow the feedstock to be upgraded without generating undesirable very low hydrogen content residual fuel-oil. The higher hydrogen-content gases, such as the rich fuel gases, are injected at elevated temperature, for example in excess of about 800° F., 900° F. or 1000° F. creating a very localized environment at the contactor—bulk solution interface. In some implementations of the present disclosure, the higher hydrogen content gases are injected at between about 850° F. and about 1100° F. or between about 890° F. and 1000° F. with a velocity of at least about 200 feet/section (ft/s) or between about 250 ft/s and about 550 ft/s or between about 300 ft/s and about 500 ft/s. In some implementations of the present disclosure, the molecular weight of any $H_2$ and the light hydrocarbon feedstock is at least about 2 pounds per mole, at least about 5 pounds per mole, at least about 10 pounds per mole, at least about 15 pounds per mole or greater. At these conditions of elevated temperatures, velocities and molecular weights of the injected gas, the cracking reaction can favour olefin formation. These olefins readily alkylate with the multi-aromatic structures within the TIOR and to a lesser extent with the polar aromatic co-processed solvents that stabilize the complex aromatic structures. Elevated jet temperatures exiting the gas contactor and the direct injection of olefins in the gas stream entering the reactor promote the alkylation of the light hydrocarbons onto the aromatics and the stabilization of the aromatics with elevated hydrogen to carbon ratio. Similar to the FCCU model compound example for octadecane, a very large number of reactions occur very quickly as new equilibriums are established, and the bulk reactor-temperature rapidly quenches the energy input from the gas contactor and the hydrocracking heat that is released.

In some implementations of the present disclosure, reducing the polar partitioning can reduce the need for high hydrogen partial-pressures to control the TIOR yield. As the asphaltenes and TIOR are being upgraded, the radicals are capped by alkylation with the high hydrogen-content gases rather than hydrogen because of the lower hydrogen concentration. The process can retain the thermally created olefins longer, which can enable these olefins to participate in the process and thereby generate less methane, ethane and propane yield as the vapours pass upward through the reactor.

During one specific test, the reactor temperature was increased to 873° F. with the average temperature over the day maintained at 868° F. The increase in operating temperature resulted in the conversion of all the 975+ F feed such that the liquid and ash stopped overflowing the reactor and a vapour space was generated and maintained at the top of the reactor. The gas make-up to the reactor consisted of about 20% C1+ hydrocarbons with the remainder being hydrogen typical of a fuels naphtha reforming process. The maximum temperature that the reactor could be run at was limited by the ability to maintain pressure on the reactor as the gas supply volume was limited and all the make-up gas was being incorporated in the liquid product. The elimination of the purge gas occurred even with elevated thermal conditions in the reactor. The average TIOR:Ash ratio for this operation is shown at 1.0 on FIG. 26B, which is within the normal operating range.

The modified commercial-process experienced a noticeable increase in exothermic reactions as the average reactor temperature was increased. Generally the hydrocarbon feed preheater outlet temperature was increased to increase the reactor temperature. However at about 840° F., reducing the hydrocarbon furnace outlet temperature was necessary to start. As the reactor temperature is increased, the energy input into the hydrocarbon furnace has to be set to at minimum value or eliminated. The controlled exothermic behaviour of the reaction is another advantage in reducing the overall $CO_2$ generation with the process.

Figure 27:
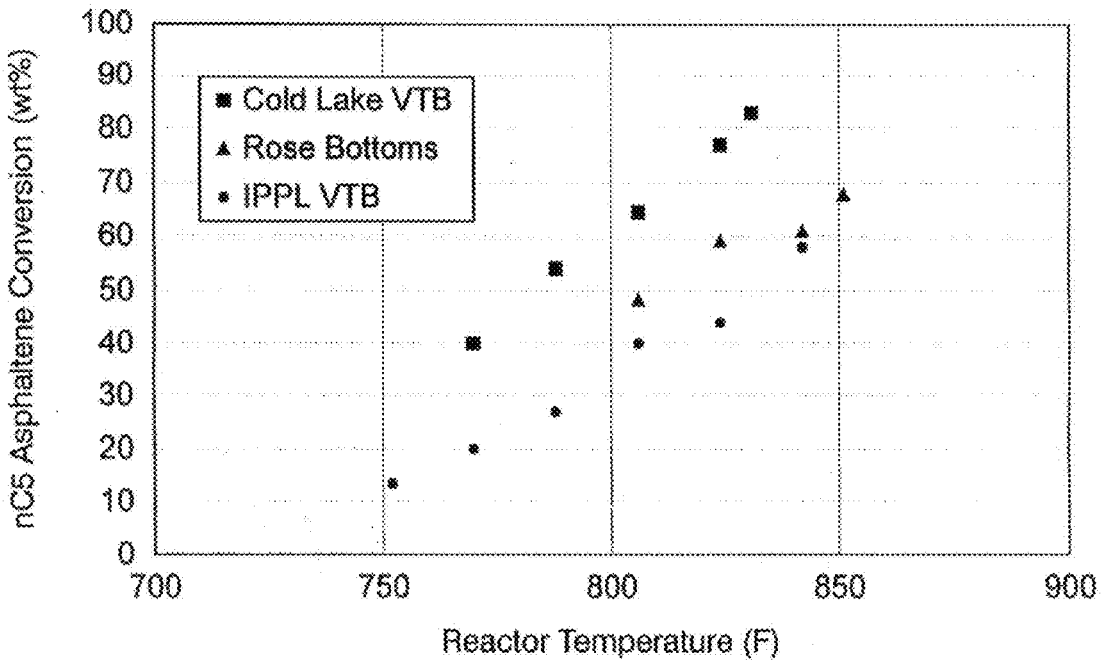
FIG. 27 is an example of data related to nC5 asphaltene conversion versus reactor temperatures obtained from three samples of heavy oil.

FIG. 27 shows the relationship for the conversion of the nC5 asphaltenes relative to reactor temperature for three benchmark feedstocks. The high sulphur content Cold Lake VTB (see square data-points in FIG. 27) was the most reactive. The low sulphur content IPPL VTB (see circle data-points in FIG. 27) and the nC4 Rose solvent deasphalter unit bottom feedstocks (see triangle data-points in FIG. 27) were the least reactive. While the rate of conversion of the nC5 asphaltenes versus the reactor temperature increase was slightly higher for the high sulphur Cold Lake VTB, all three benchmark feedstocks exhibited a consistent rate of conversion relative to the reactor temperature change. The escalating increase in the exothermic behaviour of the commercial unit above 845° F. is not due to conversion, but due to the increasing rate of alkylation at the elevated reaction temperature. Due to this behaviour, a liquid quench into the liquid at the top of the reactor could enable operating at temperatures above 870° F. Injection of liquid into the top of the reactor could facilitate maximizing the gas contactor temperature and further reduce the asphaltene partitioning effect. This would allow for increasing the relative conversion of the heavy oil feedstock within a very short contact time and within a high-temperature region of the gas contactors jets.

Figure 28A:
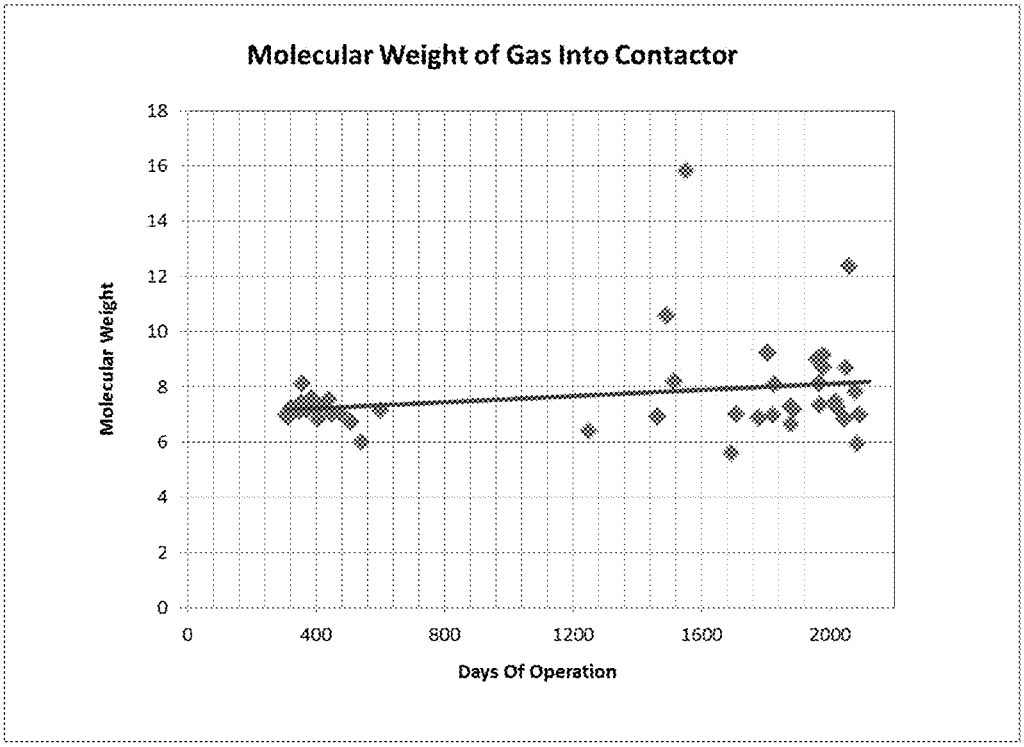
FIG. 28A shows the molecular weight of the introduced gas; and, FIG. 28B shows the hydrogen purity of the introduced gas.
Figure 28B:
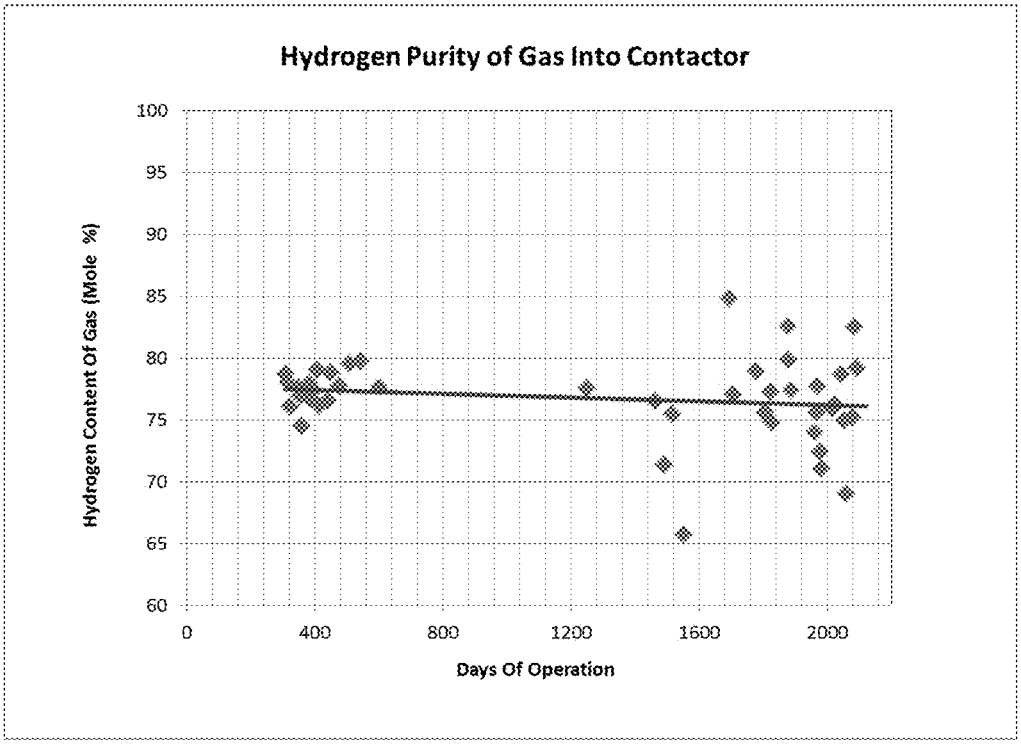

FIG. 28A and FIG. 28B show benchmarks for the average molecular-weight and the hydrogen purity used over a historical operating-period. The average molecular-weight for the gas injection was about 7.7 with a minimum and a maximum of about 6 and about 16 respectively. The corresponding average hydrogen purity was about 76.7 with a minimum and a maximum of about 65 and about 85, respectively. Operation with a benchmark reactor gas-inlet hydrogen purity of about 65% and the associated high gas-average molecular weight of 16 resulted in the TIOR inventory in the reactor being maintained at the low end of the unit operating data, at about 1 wt %. This is consistent with increasing the energy input at the gas contactor with the higher molecular weight recycle gas.

FIG. 29A and FIG. 29B show the yields and product qualities achieved in the pilot plant using the FeS based anti-coking additive without the benefit of the implementations of the present disclosure. In this study, Athabasca bitumen VTB was distilled using supercritical distillation to yield 1256− F and a 1256+ F cuts. The nC7 asphaltenes were essentially all segregated into the 1256+ F cut. The higher-boiling cut had an nC7 asphaltene content of about 37.5 wt %, a CCR of about 39.9 wt %, and a hydrogen content of about 9.18 wt %. The low boiling range cut contained only about 0.2 wt % nC7 asphaltenes, about 8.8 wt % CCR and had an elevated hydrogen content of about 10.92 wt %. The yields shown in FIG. 29A, show that almost 2 wt % more hydrogen was required to achieve 90% 975+ F conversion on the heavy cut relative to the light cut, which is consistent with the hydrogen-content differences in the feeds. The nitrogen ratio for the unconverted 975+ F relative to the gasoil nitrogen content shown in FIG. 29B is consistent with the partitioning effect associated with the base commercial-operation. This partitioning effect was also observed with the hydrogen content of the 975+ F product at about 7 wt %.

Table 1 below shows the hydrogen balance between the lower boiling point cut and the higher boiling point cut.

TABLE 1

Hydrogen balance of two different boiling point cuts.

| Hydrogen Balance | 1256 F.− | 1256 F.+ |
|---|---|---|
| Feedstock | 10.92 | 9.18 |
| Chemical $H_2$ Added | 1.8 | 3.78 |
| Total Hydrogen Of Products | 12.72 | 12.96 |
| Hydrogen in C4− Gases | 1.99 | 2.31 |
| Hydrogen Content Of C5+ Liquid | 10.73 | 10.65 |

The lower hydrogen content in the 1256+ F cut yielded a higher C1 to C4 yield with the hydrogen contained in the C1-C4 yield being about 1.99 wt % and about 2.31 wt % for the 1256− F and the 1256+ F cuts, respectively. The C5+ liquid yield for both feedstocks was essentially the same at 10.7 wt % of the total product.

This example shows that the base commercial-operation is capable of upgrading nC7 asphaltenes. The inclusion of the nC7 asphaltenes in the SHC feed resulted in a higher density and lower hydrogen content feedstock. When upgraded, the higher density feedstock yielded about 14.5 vol % more liquid yield than the lower boiling VTB cut where the nC7 asphaltenes had been removed. Processing these feedstocks with implementations of the present disclosure could be beneficial to the low hydrogen-content feedstock. Not only is there a greater C1-C4 yield to be reduced, there are more large aromatic molecules and asphaltenes in the feedstock that can provide a base for alkylating any higher hydrogen-content materials that can be introduced through the gas contactor. Effectively, the direct incorporation of the high hydrogen-content hydrocarbons can result in essentially the same decreased amount of chemical hydrogen input (for example from a reformer) to achieve similar feedstock conversion and product qualities. However, the C5+ liquid yield would be substantially higher for a higher density feedstock.

FIG. 30 shows typical chemical constituents of Athabasca bitumen, Athabasca bitumen VTB, a delayed coker fractionator bottoms stream and a fluid coker heavy gasoil. Visbreaker bottoms derived from processing Athabasca VTB would exhibit qualities similar to those shown for Mene Mota on FIG. 19. At the flocculating ratio limit, the nC7 asphaltene content would be expected to be in about the mid 30 wt % range. Since both the delayed and fluid coker operations reject carbon as coke, the coker fractionator bottoms and the coker gasoil are very low in nC7 asphaltene content. All the Athabasca bitumen and thermally processed products from the Athabasca bitumen are well within the nC7 asphaltene processing range, as demonstrated by the commercial-operations. The coker derived products are excellent for use as polar aromatic oil TIOR stabilizing co-processing streams. The very low hydrogen content, high density characteristics of these thermally processed materials make these types of feedstocks excellent for directly incorporating light hydrocarbon via direct incorporation.

The invention claimed is:

1. A method of upgrading a low hydrogen-content hydrocarbon feedstock, the method comprising steps of:

i) directly incorporating a first high hydrogen-content light hydrocarbon gas feedstock having an average molecular weight of at least 5 g/mol into the low hydrogen-content hydrocarbon feedstock for producing a mixed effluent;

ii) performing at least one separating step on the mixed effluent thereby producing a liquid product stream and a gas stream; and iii) separating the gas stream into one or more products, wherein the step (i) of directly incorporating comprises contacting the first high hydrogen-content light hydrocarbon gas feedstock with the low hydrogen-content hydrocarbon feedstock at a nozzle exit velocity of at least 200 ft/second for causing an alkylation reaction that results in a mass transfer of carbon atoms and hydrogen atoms from the first high hydrogen-content light hydrocarbon gas feedstock into the liquid product stream, wherein the first high hydrogen-content light hydrocarbon gas feedstock is at a temperature of least 800° F.

2. The method of claim 1, further comprising steps of:

iv) directly incorporating a second high hydrogen-content light hydrocarbon gas feedstock having an average molecular weight of at least 5 g/mol into the liquid product stream for producing a second mixed effluent;

v) separating the second mixed effluent into a further liquid product stream and a further gas stream; and vi) subjecting the further gas stream to the separating step (iii) for producing one or more products, wherein the step (iv) of directly incorporating comprises contacting the second high hydrogen-content light hydrocarbon gas feedstock with the liquid product stream at a nozzle exit velocity of at least 200 ft/second for causing an alkylation reaction that results in a mass transfer of carbon atoms and hydrogen atoms from the second high hydrogen-content light hydrocarbon gas feedstock into the liquid product stream.

3. The method of claim 1, wherein the separating step (iii) of claim 1 is a boiling-point separation.

4. The method of claim 2, wherein step (i) is performed at a first partial pressure of hydrogen, and the step (iv) of claim 2 is performed at a second partial pressure of hydrogen, and wherein the first partial pressure of hydrogen is lower than the second partial pressure of hydrogen.

5. The method of claim 1, wherein the low hydrogen-content hydrocarbon feedstock is a feedstock of one of: a nC7 asphaltene, bitumen, an aromatic hydrocarbon, a coker fractionator bottom, a coker gas oil, a visbreaker bottom, a hydro-visbreaker bottom, a mixture of a diluent and a heavy oil, a mixture of a solvent and a steam-assisted gravity drainage derived bitumen, and combinations thereof.

6. The method of claim 1, wherein the step (i) is performed at a temperature of at least 800° F.

7. The method of claim 6, wherein step (i) is performed at a temperature of between 890° F. and 1000° F.

8. The method of claim 2, wherein the step (iv) is performed at a temperature of at least 800° F.

9. The method of claim 8, wherein the step (iv) is performed at a temperature of between 890° F. and 1000° F.

10. The method of claim 1, wherein the first high hydrogen-content light hydrocarbon gas feedstock contacts the low hydrogen-content hydrocarbon feedstock at a nozzle exit velocity of between 300 and 500 ft/second.

11. The method of claim 1, wherein the first high hydrogen-content light hydrocarbon gas feedstock has an average molecular weight of at least 8 g/mol.

12. The method of claim 11, wherein the first high hydrogen-content light hydrocarbon gas feedstock has an average molecular weight of at least 15 g/mol.

13. The method of claim 2, wherein the second high hydrogen-content light hydrocarbon gas feedstock contacts the liquid product stream at a nozzle exit velocity of between 300 and 500 ft/second.

14. The method of claim 2, wherein the second high hydrogen-content light hydrocarbon gas feedstock has an average molecular weight of at least 8 g/mol.

15. The method of claim 14, wherein the second high hydrogen-content light hydrocarbon gas feedstock has an average molecular weight of at least 15 g/mol.

16. The method of claim 1, further comprising a step of adding an additive that is configured to concentrate toluene insoluble organic residues (TIOR) with ash.

17. The method of claim 1, further comprising a step of establishing an average ash concentration of less than 30 wt % of a total reactor contents during the step (i) of claim 1.

18. The method of claim 17, wherein the average ash concentration is between 5 and 10 wt % of a total reactor contents during the step (i) of claim 1.

19. The method of claim 2, further comprising a step of establishing an average ash concentration of less than 30 wt % of a total reactor contents during the step (iv) of claim 2.

20. The method of claim 19, wherein the average ash concentration is between 5 and 10 wt % of a total reactor contents during the step (iv) of claim 2.

21. The method of claim 1, wherein the liquid product stream has a volume that is greater than a volume of the low hydrogen-content hydrocarbon feedstock.

22. The method of claim 1, wherein the method is performed in a slurry phase hydrocracker.

23. The method of claim 1, wherein the method is performed in an integrated thermal processing unit.

24. The method of claim 1, wherein the first high hydrogen-content light hydrocarbon gas feedstock comprises a gas field product, a FCCU derived fuel-gas, a coker derived fuel-gas, a visbreaker derived fuel-gas, a purge gas from a hydrotreater, a light hydrocarbon from a downstream separation unit separator and combinations thereof.

25. The method of claim 2, wherein the first high hydrogen-content light hydrocarbon gas feedstock and the second high hydrogen-content light hydrocarbon gas feedstock are from one source selected from the group of a gas field product, a FCCU derived fuel-gas, a coker derived fuel-gas, a visbreaker derived fuel-gas, a purge gas from a hydrotreater, a light hydrocarbon from a downstream separation unit separator and combinations thereof.

26. The method of claim 2, wherein the first high hydrogen-content light hydrocarbon gas feedstock and the second high hydrogen-content light hydrocarbon gas feedstock are from different sources.

27. The method of claim 26, wherein the first high hydrogen-content light hydrocarbon gas feedstock comprises a gas field product, a FCCU derived fuel-gas, a coker derived fuel-gas, a visbreaker derived fuel-gas, a purge gas from a hydrotreater, a light hydrocarbon from a downstream separation unit separator and combinations thereof.

28. The method of claim 1, wherein the temperature of the first high hydrogen-content light hydrocarbon gas feedstock is between 850° F. and 1100° F.

29. The method of claim 2, wherein the second high hydrogen-content light hydrocarbon gas feedstock is at a temperature of at least 800° F.

30. The method of claim 29, wherein the temperature of the second high hydrogen-content light hydrocarbon gas feedstock is between 850° F. and 1100° F.

* * * * *